US006715630B2

(12) United States Patent
Littlejohn et al.

(10) Patent No.: US 6,715,630 B2
(45) Date of Patent: Apr. 6, 2004

(54) DISPOSABLE FOOD CONTAINER WITH A LINEAR SIDEWALL PROFILE AND AN ARCUATE OUTER FLANGE

(75) Inventors: Mark B. Littlejohn, Appleton, WI (US); Gerald J. Van Handel, Neenah, WI (US); Thomas W. Zelinski, Menasha, WI (US); Jerome G. Dees, Appleton, WI (US)

(73) Assignee: Fort James Corporation, Atlanta, GA (US)

( * ) Notice: Subject to any disclaimer, the term of this patent is extended or adjusted under 35 U.S.C. 154(b) by 0 days.

(21) Appl. No.: 10/348,278

(22) Filed: Jan. 21, 2003

(65) Prior Publication Data

US 2003/0173366 A1 Sep. 18, 2003

Related U.S. Application Data

(60) Provisional application No. 60/351,186, filed on Jan. 23, 2002.

(51) Int. Cl.[7] ..... B65D 5/22

(52) U.S. Cl. ..... 220/573; 220/657; 229/407

(58) Field of Search ..... 229/406, 407, 229/400; 220/573, 657

(56) References Cited

U.S. PATENT DOCUMENTS

| | | | | |
|---|---|---|---|---|
| 2,911,320 A | | 11/1959 | Phillilps | 117/64 |
| 3,963,843 A | | 6/1976 | Hitchmough et al. | 427/361 |
| 4,078,924 A | | 3/1978 | Keddie et al. | |
| 4,238,533 A | | 12/1980 | Pujol et al. | 427/359 |
| 4,503,096 A | | 3/1985 | Specht | 427/359 |
| 4,567,099 A | | 1/1986 | Van Gilder et al. | 428/327 |
| 4,588,539 A | | 5/1986 | Rossi et al. | 264/40.5 |
| 4,606,496 A | | 8/1986 | Marx et al. | 229/2.5 R |
| 4,609,140 A | | 9/1986 | Van Handel et al. | 229/2.5 R |
| 4,609,704 A | | 9/1986 | Hausman et al. | 524/710 |
| 4,721,499 A | | 1/1988 | Marx et al. | 493/152 |
| 4,721,500 A | | 1/1988 | Van Handel et al. | 493/152 |
| 4,781,566 A | | 11/1988 | Rossi et al. | 425/400 |
| 4,832,676 A | | 5/1989 | Johns et al. | 493/152 |
| 4,898,752 A | | 2/1990 | Cavagna et al. | 427/265 |
| 4,948,635 A | | 8/1990 | Iwasaki | 427/345 |
| 4,997,682 A | | 3/1991 | Coco | 427/362 |
| 5,033,373 A | | 7/1991 | Brendel et al. | 100/38 |
| 5,049,420 A | | 9/1991 | Simons | 427/361 |
| 5,088,640 A | | 2/1992 | Littlejohn | 229/2.5 R |
| 5,169,715 A | | 12/1992 | Maubert et al. | 428/331 |
| 5,203,491 A | | 4/1993 | Marx et al. | 229/2.5 R |
| 5,230,939 A | * | 7/1993 | Baum | 428/84 |
| 5,249,946 A | | 10/1993 | Marx | 425/142 |
| 5,326,020 A | | 7/1994 | Cheshire et al. | 229/2.5 R |
| 5,334,449 A | | 8/1994 | Bergmann et al. | 428/327 |
| 5,340,611 A | | 8/1994 | Kustermann et al. | 427/361 |
| 5,603,996 A | | 2/1997 | Overcash et al. | 428/34.2 |
| 5,609,686 A | | 3/1997 | Jerry et al. | 118/123 |
| 5,770,303 A | | 6/1998 | Weinert et al. | 428/326 |
| 5,776,619 A | | 7/1998 | Shanton | 428/511 |
| 5,795,928 A | | 8/1998 | Janssen et al. | 524/48 |
| 5,830,548 A | | 11/1998 | Andersen et al. | 428/36.4 |
| 5,852,166 A | | 12/1998 | Gruber et al. | 528/354 |
| 5,869,567 A | | 2/1999 | Fujita et al. | 524/608 |
| 5,932,651 A | | 8/1999 | Liles et al. | 524/838 |
| 5,938,112 A | * | 8/1999 | Sandstrom | 229/407 |
| 5,972,167 A | | 10/1999 | Hayasaka et al. | 162/135 |

(List continued on next page.)

*Primary Examiner*—Joseph Man-Fu Moy
(74) *Attorney, Agent, or Firm*—Michael W. Ferrell

(57) ABSTRACT

The present invention is directed to rigid disposable food containers provided with a relatively steep sidewall with a generally linear profile and an outwardly flared arcuate flange portion. The containers are further characterized by a flange outer vertical drop wherein the ratio of the length of the vertical drop to the characteristic diameter of the container is greater than about 0.01. By virtue of unique geometry, the containers of the invention exhibit improved rigidity and/or rim stiffness yet have favorable runnability in pressware manufacturing systems characteristic of plates of lower strength.

182 Claims, 32 Drawing Sheets

(INVENTION DESIGN)

U.S. PATENT DOCUMENTS 5,981,011 A 11/1999 Overcash et al. ..... 428/40.9
6,039,682 A 3/2000 Dees et al. ..... 493/58
6,211,500 B1 4/2001 Cochran, II et al. ..... 219/725
6,211,501 B1 4/2001 McCarthy et al. ..... 219/725
6,287,247 B1 9/2001 Dees et al. ..... 493/58
6,440,509 B1 * 8/2002 Littlejohn et al. ..... 428/35.7

* cited by examiner (U.S. PATENT NO. 5,326,020)

(INVENTION DESIGN)

(INVENTION DESIGN)

(U.S. PATENT NO. 5,088,640)

(U.S. PATENT NO. 5,326,020)

(INVENTION DESIGN)

(INVENTION DESIGN)

(U.S. PATENT NO. 5,088,640)

INSTRON RIGIDITY (LOAD VS. DEFLECTION):
163LB/REAM BOARD, WITH SCORING

INSTRON RIGIDITY (LOAD VS. DEFLECTION):
20LB/REAM BOARD, WITH SCORING

INSTRON RIGIDITY (LOAD VS. DEFLECTION):
163LB/REAM BOARD, WITHOUT SCORING

INSTRON RIGIDITY (LOAD VS. DEFLECTION): 206LB/REAM BOARD, WITHOUT SCORING

PANEL PERFORMANCE RATINGS

DISPOSABLE FOOD CONTAINER WITH A LINEAR SIDEWALL PROFILE AND AN ARCUATE OUTER FLANGE

CLAIM FOR PRIORITY

This non-provisional application claims the benefit of the filing date of U.S. Provisional Patent Application Ser. No. 60/351,186, of the same title, filed Jan. 23, 2002.

TECHNICAL FIELD

The present invention relates generally to disposable food containers. A preferred embodiment is a disposable paper plate prepared from a scored paperboard blank having densified areas made up of a plurality of layers of paperboard re-formed into substantially integrated fibrous structures. The containers are provided with a relatively steep sidewall having a generally linear sidewall profile and an arcuate outer flange.

BACKGROUND ART

Disposable containers are made from a suitable feedstock material by way of a variety of processes employing many types of equipment. Such materials, techniques and equipment are well known to those of skill in the art.

Paper disposable food containers may be made by way of pulp-molding processes or by way of pressing a planar paperboard container blank in a matched metal heated die set. Pressed paperboard containers may be made as noted in one or more of U.S. Pat. No. 4,606,496 entitled "Rigid Paperboard Container" of R. P. Marx et al; U.S. Pat. No. 4,609,140 entitled "Rigid Paperboard Container and Method and Apparatus for Producing Same" of G. J. Van Handel et al; U.S. Pat. No. 4,721,499 entitled "Method of Producing a Rigid Paperboard Container" of R. P. Marx et al; U.S. Pat. No. 4,721,500 entitled "Method of Forming a Rigid Paper-Board Container" of G. J. Van Handel et al; and U.S. Pat. No. 5,203,491 entitled "Bake-In Press-Formed Container" of R. P. Marx et al. Equipment and methods for making paperboard containers are also disclosed in U.S. Pat. No. 4,781,566 entitled "Apparatus and Related Method for Aligning Irregular Blanks Relative to a Die Half" of A. F. Rossi et al; U.S. Pat. No. 4,832,676 entitled "Method and Apparatus for Forming Paperboard Containers" of A. D. Johns et al; and U.S. Pat. No. 5,249,946 entitled "Plate Forming Die Set" of R. P. Marx et al. The forming section may typically include a plurality of reciprocating upper die halves opposing, in facing relationship, a plurality of lower die halves. The upper die halves are mounted for reciprocating movement in a direction that is oblique or inclined with respect to the vertical plane. The paperboard blanks, after cutting, are gravity fed to the inclined lower die halves in the forming section. The construction of the die halves and the equipment on which they are mounted may be substantially conventional; for example, as utilized on presses manufactured by the Peerless Manufacturing Company. Optionally included are hydraulic controls. See U.S. Pat. No. 4,588,539 to Rossi et al. For paperboard plate stock of conventional thicknesses i.e. in the range of from about 0.010 to about 0.040 inches, it is preferred that the spacing between the upper die surface and the lower die surface decline continuously from the nominal paperboard thickness at the center to a lower value at the rim.

The paperboard which is formed into the blanks is conventionally produced by a wet laid paper making process and is typically available in the form of a continuous web on a roll. The paperboard stock is preferred to have a basis weight in the range of from about 100 pounds to about 400 pounds per 3000 square foot ream and a thickness or caliper in the range of from about 0.010 to about 0.040 inches as noted above. Lower basis weight and caliper paperboard is preferred for ease of forming and realizing savings in feedstock costs. Paperboard stock utilized for forming paper plates is typically formed from bleached pulp furnish, and is usually impregnated with starch and double clay coated on one side as is further discussed herein. Such paperboard stock commonly has a moisture (water content) varying from about 4.0 to about 8.0 percent by weight.

The effect of the compressive forces at the rim is greatest when the proper moisture conditions are maintained within the paperboard: at least 8% and less than 12% water by weight, and preferably 9.5 to 10.5%. Paperboard in this range has sufficient moisture to deform under pressure, but not such excessive moisture that water vapor interferes with the forming operation or that the paperboard is too weak to withstand the high compressive forces applied. To achieve the desired moisture levels within the paperboard stock as it comes off the roll, the paperboard is treated by spraying or rolling on a moistening solution, primarily water, although other components such as lubricants may be added. The moisture content may be monitored with a hand held capacitive type moisture meter to verify that the desired moisture conditions are being maintained. It is preferred that the plate stock not be formed for at least six hours after moistening to allow the moisture within the paperboard to reach equilibrium.

In a typical forming operation, the web of paperboard stock is fed continuously from a roll through a cutting die to form the circular blanks which are then fed into position between the upper and lower die halves. The die halves are heated to aid in the forming process. It has been found that best results are obtained if the upper die half and lower die half—particularly the surfaces thereof—are maintained at a temperature in the range of from about 250° F. to about 400° F. These die temperatures have been found to facilitate the plastic deformation of paperboard in the rim areas if the paperboard has the preferred moisture levels. At these preferred die temperatures, the amount of heat applied to the blank is sufficient to liberate the moisture within the blank and thereby facilitate the deformation of the fibers without overheating the blank and causing blisters from liberation of steam or scorching the blank material. It is apparent that the amount of heat applied to the paperboard will vary with the amount of time that the dies dwell in a position pressing the paperboard together. The preferred die temperatures are based on the usual dwell times encountered for normal production speeds of 40 to 60 pressings a minute, and commensurately higher or lower temperatures in the dies would generally be required for higher or lower production speeds, respectively.

Paperboard for disposable pressware typically includes polymer coatings. Illustrative in this regard are U.S. Pat. No. 5,776,619 to Shanton and U.S. Pat. No. 5,603,996 to Overcash et al. The '619 patent discloses plate stock provided with a base coat which includes a styrene-acrylic polymer as well as a clay filler as a base coat as well as a top coat including another styrene acrylic polymer and another clay filler. The use of fillers is common in the art as may be seen in the '996 patent to Overcash et al. In the '996 patent a polyvinyl alcohol polymer is used together with an acrylic emulsion as well as a clay to form a barrier coating for a paperboard oven container. See column 12, lines 50 and following. Indeed, various coatings for paper form the subject matter of many patents including the following: U.S. Pat. No. 5,981,011 to Overcash et al.; U.S. Pat. No. 5,334,449 to Bergmann et al.; U.S. Pat. No. 5,169,715 to Maubert et al.; U.S. Pat. No. 5,972,167 to Hayasaka et al.; U.S. Pat. No. 5,932,651 to Liles et al.; U.S. Pat. No. 5,869,567 to Fujita et al.; U.S. Pat. No. 5,852,166 to Gruber et al.; U.S. Pat. No. 5,830,548 to Andersen et al.; U.S. Pat. No. 5,795,928 to Janssen et al.; U.S. Pat. No. 5,770,303 to Weinert et al.; U.S. Pat. No. 4,997,682 to Coco; U.S. Pat. No. 4,609,704 to Hausman et al.; U.S. Pat. No. 4,567,099 to Van Gilder et al.; and U.S. Pat. No. 3,963,843 to Hitchmough et al.

Various methods of applying aqueous polymer coatings and smoothing them are known in the art. See U.S. Pat. No. 2,911,320 to Phillips; U.S. Pat. No. 4,078,924 to Keddie et al.; U.S. Pat. 4,238,533 to Pujol et al.; U.S. Pat. No. 4,503,096 to Specht; U.S. Pat. No. 4,898,752 to Cavagna et al.; U.S. Pat. No. 5,033,373 to Brendel et al.; U.S. Pat. No. 5,049,420 to Simons; U.S. Pat. No. 5,340,611 to Kustermann et al; U.S. Pat. No. 5,609,686 to Jerry et al; and U.S. Pat. No. 4,948,635 to Iwasaki.

Likewise, disposable food containers are oftentimes plastic or polymer articles made from thermoplastic polymers such as styrene polymers or polypropylene. Techniques for forming such disposable food containers include injection molding, thermoforming and the like. A preferred method is thermoforming due to its speed and suitability for lower caliper materials. In the simplest form, thermoforming is the draping of a softened sheet over a shaped mold. In the more advanced form, thermoforming is the automatic high speed positioning of a sheet having an accurately controlled temperature into a pneumatically actuated forming station whereby the article's shape is defined by the mold, followed by trimming and regrind collection as is well known in the art. Suitable materials and techniques for fabricating the disposable containers of the present invention from thermoplastic materials appear in U.S. Pat. No. 6,211,501 to McCarthy et al. as well as U.S. Pat. No. 6,211,500 to Cochran II et al.

Configurations for disposable food containers have been improved over the years. One configuration which has enjoyed substantial commercial success is shown in U.S. Pat. No. 5,088,640 to Littlejohn. The '640 patent discloses a disposable plate provided with a smooth outer profile which defines four (4) radii of curvature subtending arcs of the outer portions of the plate. The various radii are selected for enhancing rigidity of the pressed paper plate as compared to other conventional designs made from the same paperboard stock. The flowing arcuate design of the '640 patent offers additional advantages, notably with respect to manufacturing. It is possible to achieve high press speeds with design of the '640 patent, exercise pleating control and maintain product consistency, even when product is formed slightly off-center due to the forgiving tolerances inherent in the design.

Another configuration for pressed paperboard food containers which has also enjoyed substantial commercial success is taught in U.S. Pat. No. 5,326,020 to Cheshire et al. A pressed paper plate configured according to the '020 patent includes three frustoconical or linear profiled regions about its sidewall and rim. The sidewall region includes a generally annular region flaring upwardly and outwardly from a periphery of a planar inner region and a first frustoconical, linear profiled region adjoining the annular region with the frustoconical region sloping outwardly and upwardly from the annular region. The rim region includes an outwardly flaring arcuate annular region adjoining an outer periphery of the first frustoconical region, and a second frustoconical region extending generally tangentially from the arcuate annular region. The second frustoconical or linear profiled region extends outwardly and downwardly at an angle of about 6° to about 12° and preferably about 6°–10.5° relative to the plane defined by the planar inner region. The rim of the container further includes an outwardly and downwardly flaring frustoconical lip with a linear profile adjoining an outer periphery of the second frustoconical region in order to aid in grasping of the paperboard container by the consumer. Additionally, a plurality of radially extending mutually spaced pleats are also formed in the rim region and are internally bonded with portions of the rim region during formation of the paperboard container by a die press. Pressed paperboard containers configured in accordance with the '020 patent are capable of exhibiting very high flexural strength relative to other available containers.

Achievable press speeds, pleating control and product consistency of products made according to the '020 patent are not generally as attractive as compared with like attributes observed with products made in accordance with the '640 patent noted above. The tolerances required for the product of the '020 patent are more demanding and the product less forgiving with respect to manufacturing variances. In any case, it is preferred in many embodiments to employ die sets with articulated knock-outs as are seen in U.S. Pat. No. 4,832,676 to Johns et al.

An object of the present invention is accordingly to combine high rigidity of the product with favorable processing characteristics.

SUMMARY OF INVENTION

There is provided in accordance with the present invention a disposable food container exhibiting improved rigidity and/or rim stiffness having a characteristic diameter including a generally planar bottom portion; a first annular transition portion extending upwardly and outwardly from the generally planar bottom portion; a sidewall portion extending upwardly and outwardly from the first annular transition portion as well as a second annular transition portion extending outwardly from the sidewall portion. The sidewall portion defines a generally linear, inclined profile between the first annular transition portion and the second annular transition portion typically having an angle of inclination of from about 10° to about 50° with respect to a vertical from the generally planar bottom portion. From about 10° to about 40° is preferred in many embodiments. An arcuate outer flange portion, having a convex upper surface and extending outwardly and generally downwardly with respect to the second annular transition portion defines generally an outer radius of curvature of the arcuate outer flange portion and there is optionally included an inner flange portion extending between the second annular transition portion and the arcuate outer flange portion. The radial span of the optional inner flange is typically of a length of from 0 to 0.1 times the characteristic diameter of the container. The disposable containers are characterized by a ratio of the radius of curvature of the arcuate outer flange portion to the characteristic diameter of the disposable food container of from about 0.0175 to about 0.1. The containers are characterized further in that they have a flange outer vertical drop wherein the ratio of the length of the flange outer vertical drop to the characteristic diameter of the container is greater than about 0.01. The ratio of the flange outer vertical drop length to the characteristic diameter of the container is typically greater than about 0.013, usually greater than about 0.015 and in many cases greater than 0.0175. In many preferred products, the ratio of the radius of curvature of the arcuate outer flange to the characteristic diameter of the food container is greater than about 0.025. The ratio of the outer radius of curvature of the arcuate outer flange portion to the characteristic diameter of the disposable food container is typically from about 0.035 to about 0.07 or 0.06 in some embodiments, and preferably from about 0.04 to about 0.055. If an arc is characterized by more than one radius of curvature, such as an elliptical shape or the like, an average radius of curvature defined by the arc may be used to describe the shape, as a single radius defines an arc of constant curvature. In many preferred embodiments, the arcuate outer flange portion of the container extends to the outer periphery of the container. One may, if so desired, provide an optional outward linear portion extending generally downwardly, for example, from the arcuate outer flange. The generally linear, inclined profile between the first annular transition portion and the second annular transition portion typically has an angle of inclination of from about 15° to about 40° with respect to a vertical from the generally planar bottom portion, whereas an angle of inclination of from about 25° to about 35° is preferred in some embodiments. The ratio of the length of the generally linear inclined profile between the first annular transition portion and the second annular transition portion to the characteristic diameter of the container is typically greater than about 0.025 and usually greater than 0.03. Values of this ratio between about 0.025 and 0.15 may be utilized for plates and deep dish containers; whereas for plates, values of this ratio are typically between about 0.025 and 0.06. Generally, the ratio of the length of the generally linear inclined sidewall profile to the characteristic diameter of the disposable food container is from about 0.025 to about 0.3. For bowls, values of the ratio of the length of the generally linear inclined profile between the first annular transition portion and the second annular transition portion to the characteristic diameter of the container is usually from about 0.1 to about 0.3 and typically from about 0.15 to about 0.25.

The arcuate outer flange portion typically extends downwardly with respect to the second annular transition portion, especially with respect to its uppermost parts, and is configured so that the outer radius or radii of curvature is defined thereby over an included angle of from about 30° to about 80°. In a preferred embodiment, the arcuate outer flange portion is configured so that the outer radius of curvature is defined thereby over an included angle of from about 50° to about 75°. From about 55° to about 75° is typical as is from about 55° to about 65°.

The first annular transition portion typically defines an upwardly concave upper surface defining an inner radius of curvature, wherein the ratio of the inner radius of curvature to the characteristic diameter of the disposable food container is from about 0.014 to about 0.14 and preferably from about 0.035 to about 0.07. The second annular transition portion usually defines a convex upper surface defining an intermediate radius of curvature, wherein the ratio of the intermediate radius of curvature to the characteristic diameter of the disposable food container is from about 0.014 to about 0.07. The ratio of the height of the container to the characteristic diameter is from about 0.06 to about 0.12 in most embodiments where the container is a disposable plate. Bowls or deep dish containers may require a greater height to diameter ratio to obtain the desired volumetric capacity or functional use requirements. In general, the ratio of the height of the containers to their characteristic diameters is from about 0.06 to about 0.3; the aforesaid ratios of from about 0.06 to about 0.12 being typical for plates, whereas bowls more typically have a ratio of the height of the container to its characteristic diameter of from about 0.1 to about 0.3. The optional inner flange portion extending between the second annular transition portion and the outer arcuate flange portion over a radial span may be of any suitable length, such as where the ratio of said radial span to the characteristic diameter of the food container is typically from about 0.01 to about 0.09. The optional inner flange portion may be horizontal, or at a slight upward or downward angle, such angle being typically (plus or minus) 10 degrees or less with respect to a horizontal line parallel to the bottom of the container.

The containers of the invention may be made of paper, plastic, and so forth as is known in the art and described in the patents and texts noted above, the disclosures of which are hereby incorporated by reference. Containers made by way of press-forming a paperboard blank are particularly preferred. The following co-pending patent applications contain further information as to materials, processing techniques and equipment and are also incorporated by reference: U.S. patent application Ser. No. 09/921,264, entitled "Disposable Serving Plate With Sidewall-Engaged Sealing Cover" U.S. application Ser. No. 09/603,579, filed Jun. 26, 2000, entitled "Smooth Profiled Food Service Articles", now U.S. Pat. No. 6,474,497; U.S. application Ser. No. 10/004,874, filed Dec. 7, 2001, entitled "High Gloss Disposable Pressware"; U.S. patent application Ser. No. 09/418,851, entitled "A Paperboard Container Having Enhanced Grease Resistance and Rigidity and a Method of Making Same"; U.S. application Ser. No. 09/978,484, filed Oct. 17, 2001, entitled "Deep Dish Disposable Pressed Paperboard Container"; U.S. application Ser. No. 09/653,572, filed Aug. 31, 2000, entitled "Side Mounted Temperature Probe for Pressware Die Sets", now U.S. Pat. No. 6,585,506; U.S. application Ser. No. 09/653,577, filed Aug. 31, 2000, entitled "Rotating Inertial Pin Blank Stops for Pressware Die Sets", now U.S. Pat. No. 6,592,357; U.S. application Ser. No. 09/678,930, filed Oct. 4, 2000, entitled "Punch Stripper Ring Knock-Out for Pressware Die Sets", now U.S. Pat. No. 6,589,043; U.S. Provisional Application Serial No. 60/392,091, filed Jun. 27, 2002, entitled "Disposable Servingware Containers with Flange Tabs"; U.S. patent application Ser. No. 10/236,721, filed Sep. 6, 2002, entitled "Improved Pressware Die Set with Product Ejectors at Outer Forming Surfaces"; and U.S. application Ser. No. 10/156,342, filed May 28, 2002, entitled "Coated Paperboard, Method and Apparatus for Producing Same".

When made from paper, the containers may be pulp-molded or formed from a paperboard blank which is pressed in a heated die-set. Paperboard blanks may be provided with a substantially liquid-impervious coating including an inorganic pigment and/or filler and a water-based, press applied overcoat. The paperboard may be provided with a styrene-butadiene polymer coating, preferably including a carboxylated styrene-butadiene polymer in some embodiments.

The containers may likewise be prepared from paperboard laminates, for example, having multiple paperboard layers and may include three paperboard layers, two of which layers may be embossed. Each of the paperboard layers generally has a basis weight of from about 20 lbs. to about 400 lbs. per 3000 square foot ream, with from about 80 lbs. to about 220 lbs. per 3000 square foot ream being somewhat typical.

When made of plastic, the containers are typically fabricated from a thermoplastic material by way of a technique selected from the group consisting of injection molding, injection blow molding, injection stretch blow molding and composite injection molding. The containers may be formed from a foamed polymeric material, or formed from a sheet of thermoplastic material. The sheet may be thermoformed, thermoformed by the application of vacuum or thermoformed by a combination of vacuum and pressure, preferably thermoformed by the application of vacuum.

The thermoplastic material may be a foamed or solid polymeric material selected from the group consisting of: polyamides, polyacrylates, polysulfones, polyetherketones, polycarbonates, acrylics, polyphenylene sulfides, acetals, cellulosic polymers, polyetherimides, polyphenylene ethers or oxides, styrene-maleic anhydride copolymers, styrene-acrylonitrile copolymers, polyvinylchlorides and mixtures thereof, or a foamed or solid polymeric material selected from the group consisting of: polyesters, polystyrenes, polypropylenes, polyethylenes and mixtures thereof. A mineral-filled polypropylene sheet used for making the articles may have a wall thickness from about 10 to about 80 mils and consist essentially of from about 40 to about 90 percent by weight of a polypropylene polymer, from about 10 to about 60 percent by weight of a mineral filler, from about 1 to about 15 percent by weight polyethylene, up to about 5 weight percent titanium dioxide and optionally including a basic organic or inorganic compound comprising the reaction product of an alkali metal or alkaline earth element with carbonates, phosphates, carboxylic acids as well as alkali metal and alkaline earth element oxides, hydroxides, or silicates and basic metal oxides, including mixtures of silicon dioxide with one or more of the following oxides: magnesium oxide, calcium oxide, barium oxide, and mixtures thereof.

Mineral-filled thermoplastic material such as polypropylene includes compositions wherein the predominant mineral filler is mica. A mineral filler is said to be predominantly mica when mica makes up at least 50% by weight of mineral filler present in the composition based on the combined weight of all mineral fillers present.

Containers made from solid as opposed to foamed plastics may have a wall caliper of from about 10 to about 50 mils, typically from about 15 to about 25 mils, and may be formed of a styrene polymer composition including polystyrene or any mineral-filled or unfilled thermoplastic composition.

When formed from a paperboard blank, at least one of the second annular transition portion, the sidewall, the optional inner flange portion and/or the outer arcuate flange portions are preferably provided with a plurality of circumferentially spaced, radially extending regions formed from a plurality of paperboard lamellae preferably rebonded into substantially integrated fibrous structures substantially inseparable into their constituent lamellae; preferably having a thickness generally equal to adjacent areas of the food container. When a scored paperboard blank is used the sidewall, the second annular transition portion, the outer arcuate flange portion and/or the optional inner flange portion are preferably provided with a plurality of circumferentially spaced radially extending regions formed from a plurality of paperboard lamellae preferably rebonded into substantially integrated fibrous structures generally inseparable into their constituent lamellae preferably having a thickness generally equal to adjacent areas of the sidewall, transition or flange portions wherein the regions formed from a plurality of lamellae extend over a profile distance corresponding to at least a portion of the length of the scores of the paperboard blank from which said container is formed. The regions formed from a plurality of lamellae typically extend over a profile distance corresponding to at least about 50 percent of the length of the scores in the paperboard blank from which the container is formed, and preferably these regions extend over a profile distance corresponding to at least about 75 percent of the length of the scores in the paperboard blank from which the container is formed. For a typical product, the radially scored paperboard blank has from about 20 to about 150 radial scores, wherein the scores of the radially scored paperboard blank have a width of from about 0.01 inches to about 0.05 inches. For typical basis weights, the scores of the radially scored paperboard blank have a width of about 0.03 inches.

For paper or paperboard containers, the caliper is typically at least about 10 mils and usually at least about 12 mils. A wall thickness of generally from about 10 mils to about 25 mils is suitable with from about 12 to about 22.5 mils being typical. In preferred embodiments a paperboard blank has a substantially liquid-impervious coating comprising an inorganic pigment or filler and a water-based press-applied overcoat. Kaolin is used as a filler in a base coat typically with latex binder resins.

BRIEF DESCRIPTION OF DRAWINGS

The invention is described in detail below in connection with the various Figures wherein like numbers designate similar parts and wherein.

DETAILED DESCRIPTION

Figure 1A:
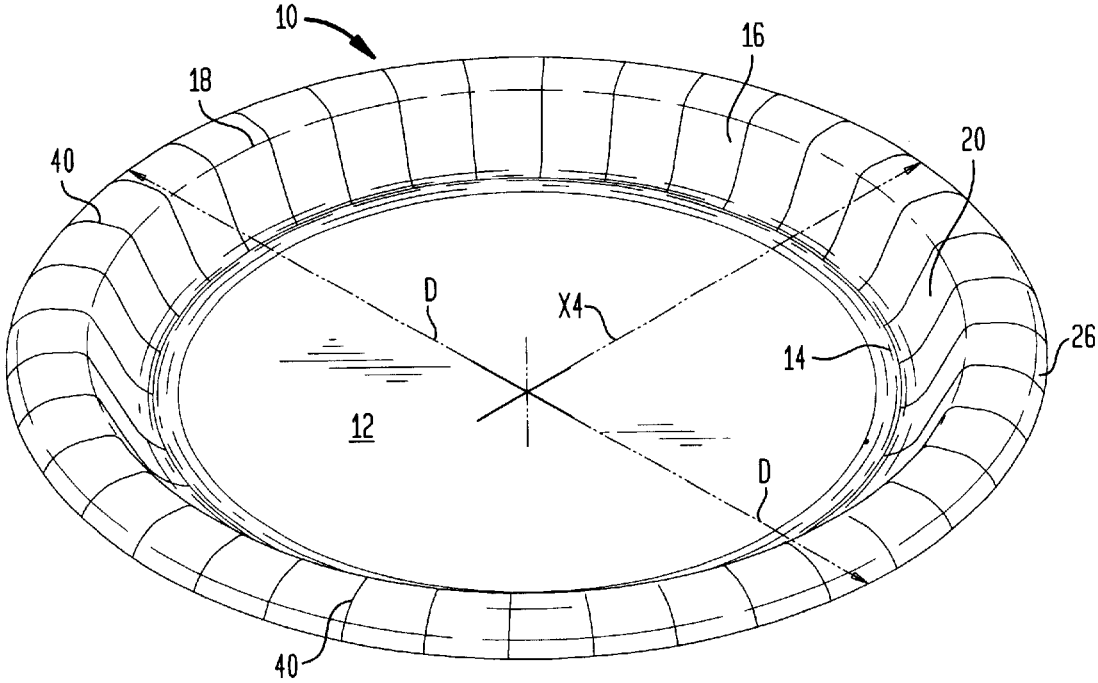
FIG. 1A is a view in perspective of a disposable plate configured in accordance with the present invention.
Figure 1B:
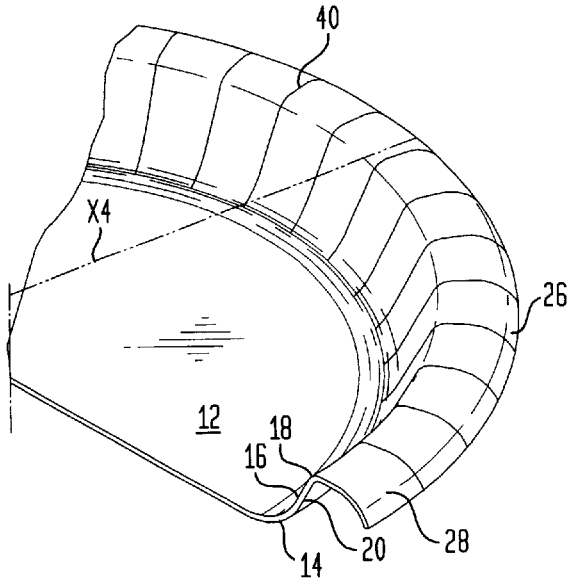
FIG. 1B is detail of the plate of FIG. 1A, partially in section, showing the profile from the center of the article.
Figure 1C:
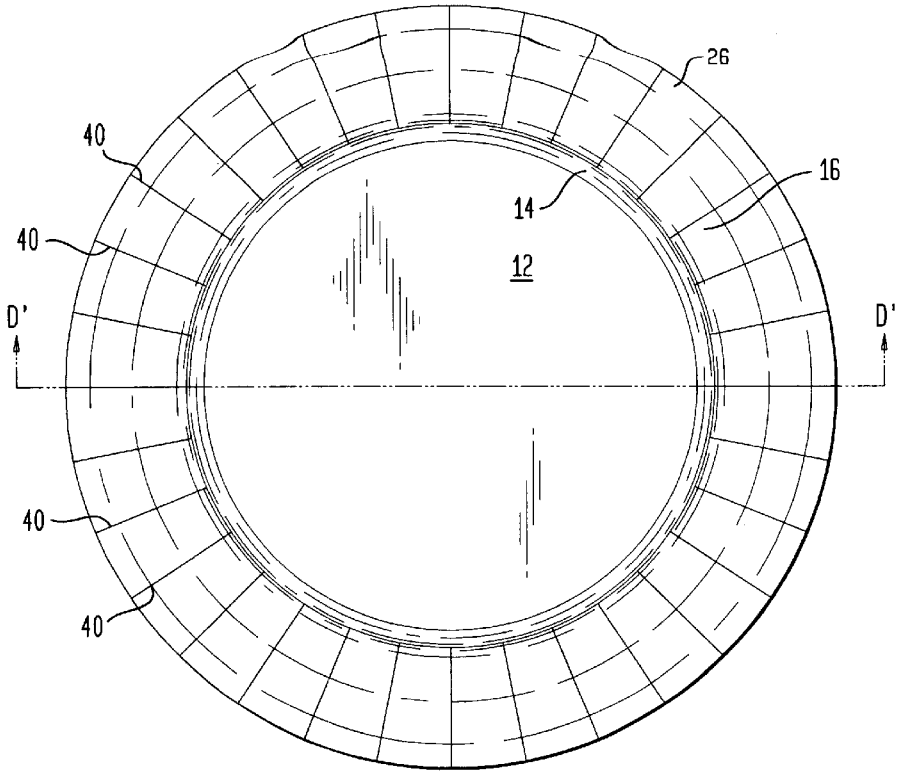
FIG. 1C is a top plan view of the plate of FIG. 1A.
Figure 1D:
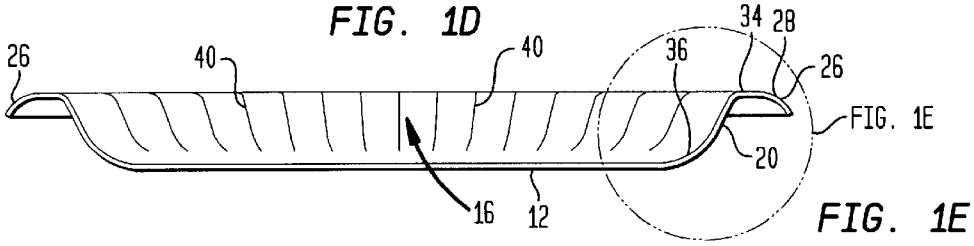
FIG. 1D is a view in elevation and section of the plate of FIGS. 1A, 1C along line D'—D' of FIG. 1C.
Figure 1E:
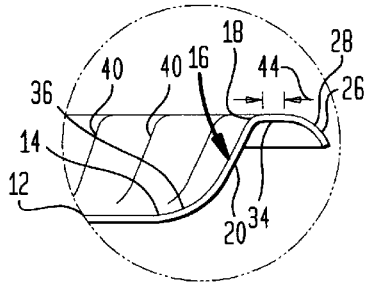
FIG. 1E is an enlarged detail illustrating the rim profile of the plate of FIGS. 1A–1D.

The present invention is described in detail below in connection with numerous embodiments. Such discussion is for purposes of illustration only and not intended to be limitative of the invention. Modifications to particular embodiments within the spirit and scope of the present invention, set forth in the appended claims, will be readily apparent to those of skill in the art.

Test Methods and Definitions

SSI rigidity is measured with the Single Service Institute Plate Rigidity Tester of the type originally available through Single Service Institute, 1025 Connecticut Ave., N.W., Washington, D.C. The SSI rigidity test apparatus has been manufactured and sold through Sherwood Tool, Inc. Kensington, Conn. This test is designed to measure the rigidity (i.e., resistance to bending) of paper and plastic plates, bowls, dishes, and trays by measuring the force required to deflect the rim of these products a distance of 0.5 inch while the product is supported at its geometric center. Specifically, the plate specimen is restrained by an adjustable bar on one side and is center supported. The rim or flange side opposite to the restrained side is subjected to 0.5 inch deflection by means of a motorized cam assembly equipped with a load cell, and the force (grams) is recorded. The test simulates in many respects the performance of a container as it is held in the hand of a consumer, supporting the weight of the container's contents. SSI rigidity is expressed as grams per 0.5 inch deflection. A higher SSI value is desirable since this indicates a more rigid product. All measurements were done at standard TAPPI conditions for paperboard testing, 72° F. and 50% relative humidity. Geometric mean averages for the machine direction (MD) and cross machine direction (CD) are reported herein.

The particular apparatus employed for SSI rigidity measurements was a Model No. ML-4431-2 SSI rigidity tester as modified by Georgia Pacific Corporation, National Quality Assurance Lab, Lehigh Valley Plant, Easton, Pa. 18040 using a Chatillon gauge available from Chatillon, Force Measurements Division, P.O. Box 35668, Greensboro, N.C. 27425-5668.

In order to further assess performance of the disposable containers of the invention a series of disposable plates was evaluated using an apparatus similar to the SSI rigidity tester described above in connection with an Instron® tester to obtain continuous load versus deflection curves as opposed to the SSI rigidity test described above which only provides a load reading at one deflection, typically at a 0.5 inch deflection. Here again, all measurements were done at standard TAPPI conditions for paperboard testing, 72° F. and 50% relative humidity, reporting geometric mean (GM) averages for the machine direction (MD) and cross machine direction (CD). Different containers were used for the various MD and CD tests so that the larger deflections did not influence the measurements. That is, a given container was tested for CD characteristics and another container was tested for MD characteristics. As in the SSI rigidity test, the containers were restrained in a mounting apparatus about one side thereof and supported about their geometric centers while a probe advanced and deflected the container on its side opposite the side restrained in the mounting apparatus. The force required to deflect the flange of the container a given distance was recorded. GM load at various deflection increments appears in connection with Examples 1–8 and Comparative Examples A–H hereinafter. Plots of the data appear in FIGS. 10–13.

Performance of the containers of the invention was still further evaluated by a rim stiffness test which measures the local bending resistance of the rim with the adjacent bottom portion of the plate restrained from movement by clamp pads. While the SSI and Instron® rigidity tests described above measure overall rigidity of the container, some studies have shown that such overall rigidity measurements do not always correlate well with,consumer perception of plate sturdiness. This is especially true if the consumers test a plate for sturdiness without a food load. SSI rigidity still is a valid and meaningful test to determine plate sturdiness with food loads during actual usage. A rim stiffness test was developed which included clamping a container about its bottom portion and measuring the force required for a given deflection of the rim at a location on the rim outwardly disposed with respect to the clamped bottom portion of the plate. This test measures local rim bending and has been observed to correlate well with perceptions of plate sturdiness as noted above.

Lower basis weight products having lower calipers and flex stiffness in the rim area can be perceived to be less sturdy due to local rim bending, even though SSI rigidity may be adequate for typical loads. The flex stiffness of materials in a pure bending mode (cantilever beam deflection) varies with the cube of the caliper. The lower basis weight products may require a profile configured to obtain enhanced rim stiffness while maintaining adequate SSI rigidity for food loads. There is typically some trade-off between SSI rigidity and rim stiffness in known containers. Higher basis weight containers having higher calipers and flex stiffness in the rim area may require enhanced SSI rigidity for heavy food loadings while maintaining adequate local rim stiffness. Rim stiffness is determined as the force required (in grams unless otherwise specified) to deflect the rim of a container 0.1 inches while clamped about its bottom as is further described hereinafter.

Disposable containers of the present invention have a characteristic diameter. For circular bowls, plates, platters and the like, the characteristic diameter is simply the outer diameter of the product. For other shapes, an average diameter can be used; for example, the arithmetic average of the major and minor axes could be used for elliptical shapes, whereas the average length of the sides of a rectangular shape is used as the characteristic diameter and so forth.

The terminology "generally linear" sidewall profile refers generally to the geometry shown in connection with the profiles of the inventive containers where it is seen that the sidewall of the inventive containers between transition portions is essentially frustoconical in shape and typically has a substantial length as opposed to the geometry shown in U.S. Pat. No. 5,088,640. In the '640 patent, the sidewall is curved and defines a radius of curvature of about 2 inches over an included angle of about 4 degrees for an 8¾-inch plate, suggesting a sidewall arc length of about 0.14 inches and a sidewall length/diameter ratio of 0.016 or so.

"Laminate" refers to a product having more than one layer.

Sheet stock refers to both a web or roll of material and to material that is cut into sheet form for processing.

Unless otherwise indicated, "mil", "mils" and like terminology refers to thousandths of an inch and dimensions appear in inches. Likewise, caliper is the thickness of material and is expressed in mils unless otherwise specified.

The term major component, predominant component and the like refers to a component making up at least about 50% of a composition or that class of compound in the composition by weight as the context indicates; for example, a filler is the predominant filler in a filled plastic composition if it makes up more than about 50% by weight of the filler in the composition based on the combined weight of fillers in the composition.

"Rigidity" refers to SSI rigidity (grams/0.5 inches) or Instron® rigidity as the context indicates.

"Rim stiffness" refers to the rim stiffness in grams at 0.1 inch deflection as further discussed below.

Basis weights appear in lbs per 3000 square foot ream unless otherwise indicated.

Preferred Embodiments

Disposable food containers configured in accordance with the present invention generally include a generally planar bottom portion, a relatively steep, generally straight sidewall portion as well as an outer arcuate flange portion. This profile has been found to be particularly suitable for disposable containers such as plates, platters, bowls and the like because it combines improved physical properties with manufacturing advantages such as pleating control, and off-center forming tolerance. Currently available pressware plate lines include, for example, those disclosed and generally described in U.S. Pat. No. 5,088,640 to Littlejohn and U.S. Pat. No. 5,326,020 to Cheshire et al. Products configured in accordance with the design described in the '640 patent are typically intended to be a lower basis weight, lower performance, less expensive product for everyday, typically lighter duty usage. Generally speaking these products use a four radius profile which generally provides: (1) enhanced strength versus previously known designs, (2) higher press speeds than otherwise available, (3) improved pleating control (with or without scoring) and (4) improved product consistency in terms of rigidity and individual product appearance versus other designs.

Available products of the general class described in the '020 patent are typically intended to be the higher basis weight and higher performance, more durable and costly disposable products for special use applications where additional strength is required including buffets or parties where heavy food loads are likely. Such products include for example, oval platters, deep dish containers, and bowls. These products typically exhibit: (1) enhanced product rigidity per material utilization, especially for the higher basis weight paperboards, (2) adequate press converting speeds and (3) adequate pleating control for mid to high basis weight paperboards. Scoring is typically required for adequate pleating control for these products.

The containers of the present invention as will be seen from the rigidity and rim stiffness data discussed below, generally exhibit the desirable features of both the '640 and '020 patents in a single product. That is to say, containers manufactured in accordance with the present invention generally exhibit rigidity seen with products made in accordance with the '020 patent when produced with similar materials while exhibiting press speeds, pleating control, and off-center forming tolerance seen with products generally configured in accordance with the '640 patent. Containers of the present invention thus combine desirable features of radically different disposable container designs. The plates of the present invention may be manufactured using existing paperboard blank diameters if so desired.

Without intending to be bound by any theory or specific geometry of the inventive containers, it is believed that the generally linear, inclined profile of the sidewall and its location from the product center, the arcuate outer flange portion radius and included angle as well as the optional inner flange portion in combination have beneficial effects on the overall rigidity of the product as related to food carrying capacity. The overall sidewall and outer rim profile can be configured to provide enhanced local rim stiffness as well. In some cases it is desirable to optimize rim stiffness while in others, one may wish to maximize SSI rigidity. For example, one may wish to maximize rim stiffness for lower caliper products of adequate overall rigidity, whereas for a higher caliper product with more than adequate rim stiffness, one may wish to maximize overall (SSI) rigidity.

Typical disposable plates and bowls are sold in packaging showing their relative nominal sizes. Diameters are given for plates in inches and capacity in fluid ounces for bowls. Actual product diameters vary; for a nominal 9 inch plate, the actual diameter is typically 8½ inches to 9¼ inches. Actual product diameters for nominal 10 inch plates is typically 10 to 10½ inches. It is desirable to have product diameters reasonably close to competitive products for each nominal size. A product that is substantially smaller in diameter and selling for a comparable price may not be perceived to have the same value even though the bottom food container area for example, and product height may be parity or better. In any event, it will be seen from the various product designs possible within the spirit and scope of the present invention that the product diameter may be adjusted by changing, for example, the product height or an optional transition portion length to achieve the desired characteristics.

The products of the present invention may be made from any suitable material for example plastic, paper, paperboard, and like materials. Typically paperboard is a material of choice and the manufacturing process consists of hot pressing the plates in a heated die set as is well known in the art. Plates so formed may be made utilizing paperboard calipers anywhere from about 10 mils to about 25 mils (163 pound/3000 sq. ft ream being a 14 mil caliper and a 206 pound/3000 sq. ft. ream being an 18.5 mil caliper paperboard.)

Utilizing a 163 pound per ream paperboard and scored blanks the products of the invention exhibited a 33% increase in SSI rigidity over similar products made using the shape generally disclosed in the U.S. Pat. No. 5,088,640. A 48% increase in SSI rigidity was observed with plates made from 206 pound/3000 sq. ft. ream (scored blanks) over similar products formed with the shape of the '640 patent. The continuous Instron® rigidity curves also show the clear strength advantage of the plates of the invention versus the plates made in accordance with the '640 patent.

There are additional advantages associated with the containers of the present invention. That is to say, the plates of the invention are more tolerant of manufacturing conditions in terms of off-center forming and pleating control than are the plates of the '020 Cheshire et al. patent. This is especially true in connection with various types of equipment as discussed in more detail below.

Referring now to FIGS. 1A through 9, the present invention is illustrated in connection with several designs for disposable paper plates made from paperboard blanks and pressed in a heated die set as described hereinafter.

Figure 5:
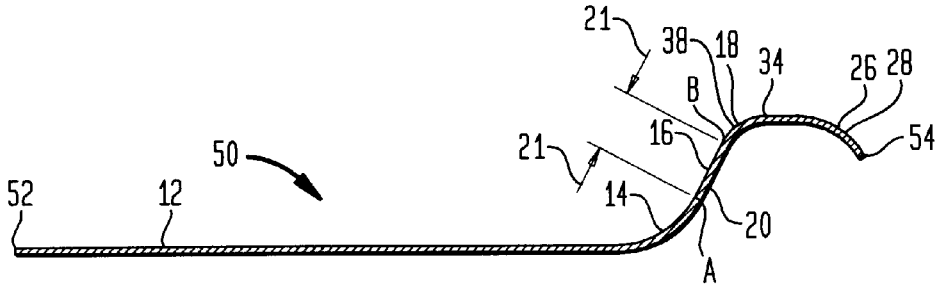
FIG. 5 is a diagram showing the profile from center of the plate of FIGS. 1A–1E.
Figure 6:
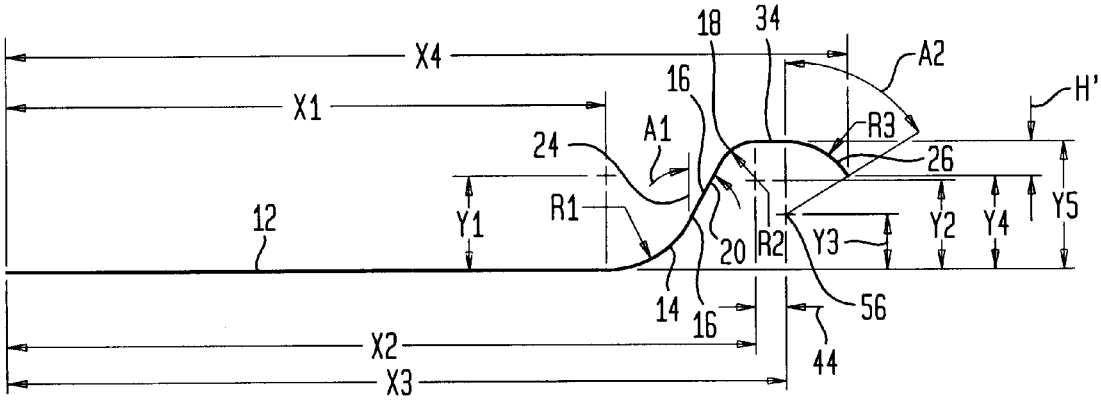
FIG. 6 is a schematic diagram showing various dimensions of the plate of FIGS. 1A–1E and FIG. 5.
Figure 7A:
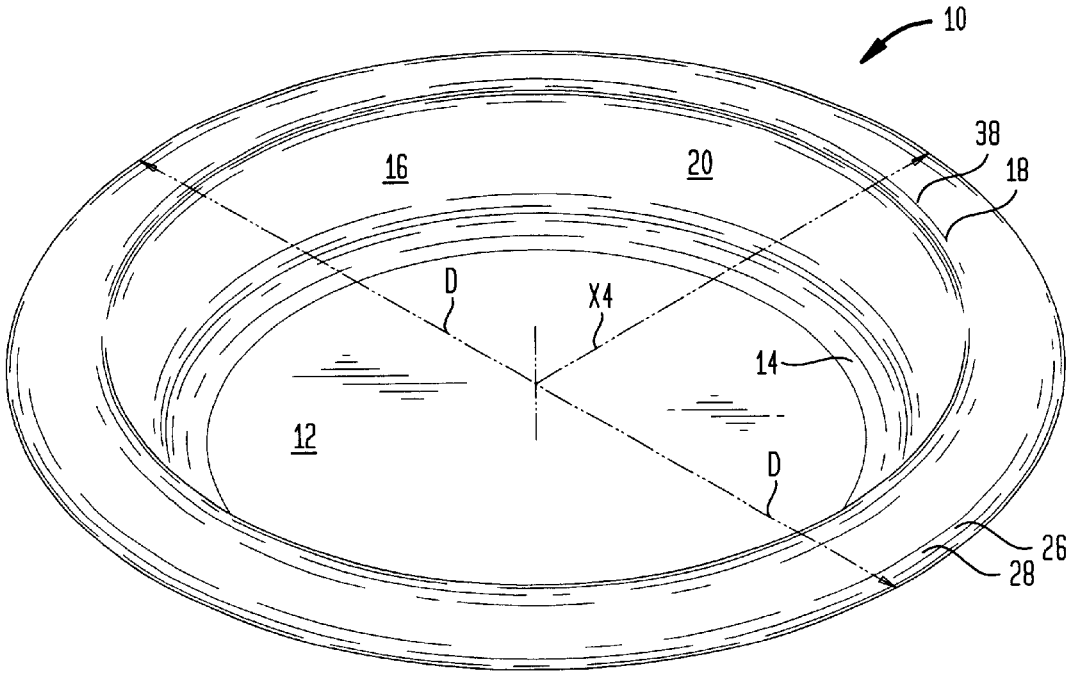
FIG. 7A is a view in perspective of another plate configured in accordance with the present invention.
Figure 7B:
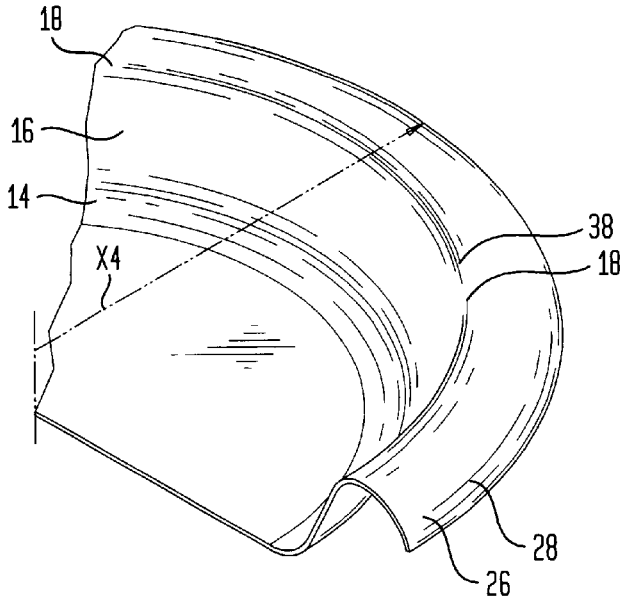
FIG. 7B is a partial view in perspective and section illustrating the geometry of the plate of FIG. 7A.
Figure 7C:
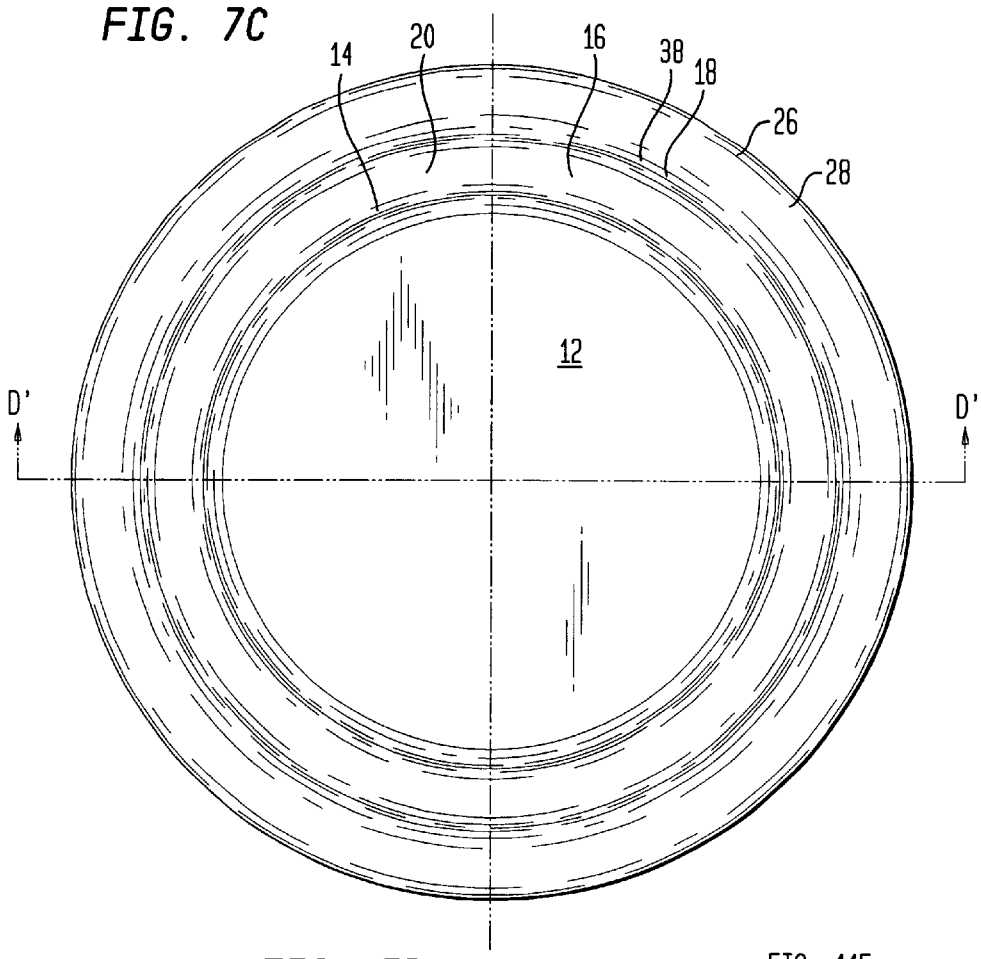
FIG. 7C is a plan view showing the plate of FIGS. 7A and 7B.
Figure 7D:
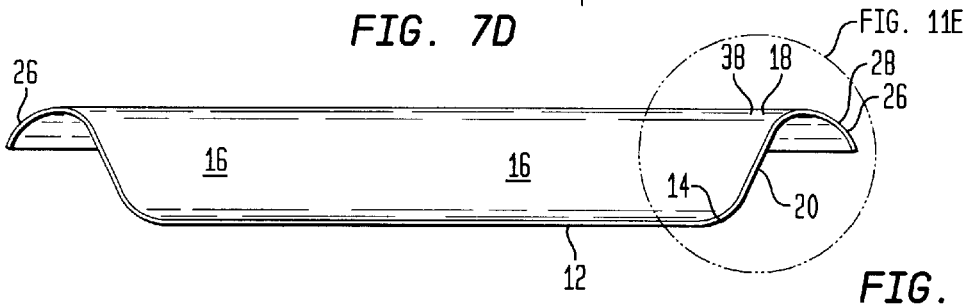
FIG. 7D is view in section in elevation of the plate of FIGS. 7A–7C along line D'—D' of FIG. 7C.
Figure 7E:
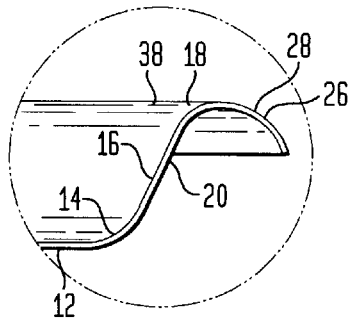
FIG. 7E is an enlarged detail illustrating the geometry of the disposable plate of FIGS. 7A–7D.
Figure 8:
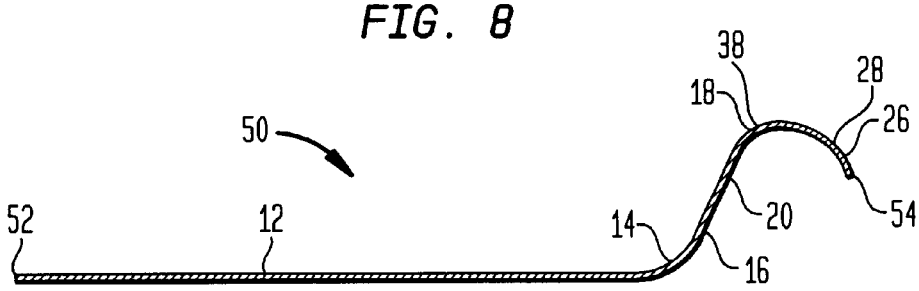
FIG. 8 is a diagram showing the profile from center of the plate of FIGS. 7A–7E)
Figure 9:
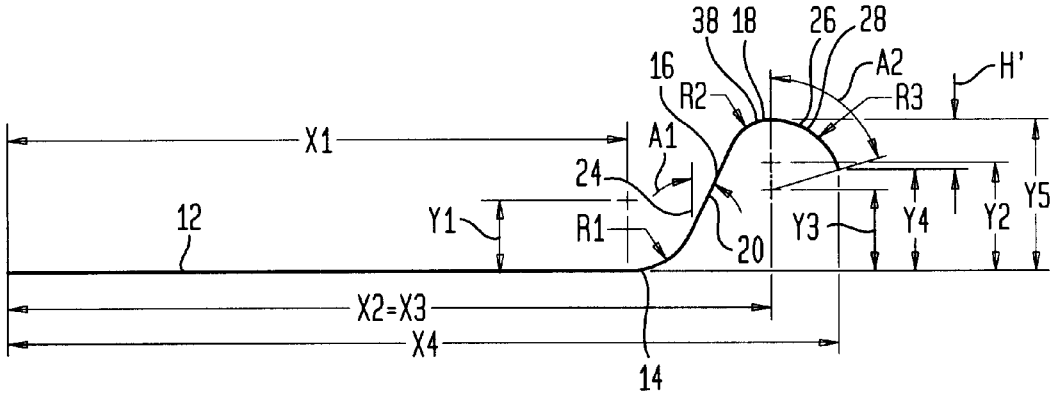
FIG. 9 is a schematic diagram illustrating various dimensions of the plate of FIGS. 7A–8.
Figure 10:
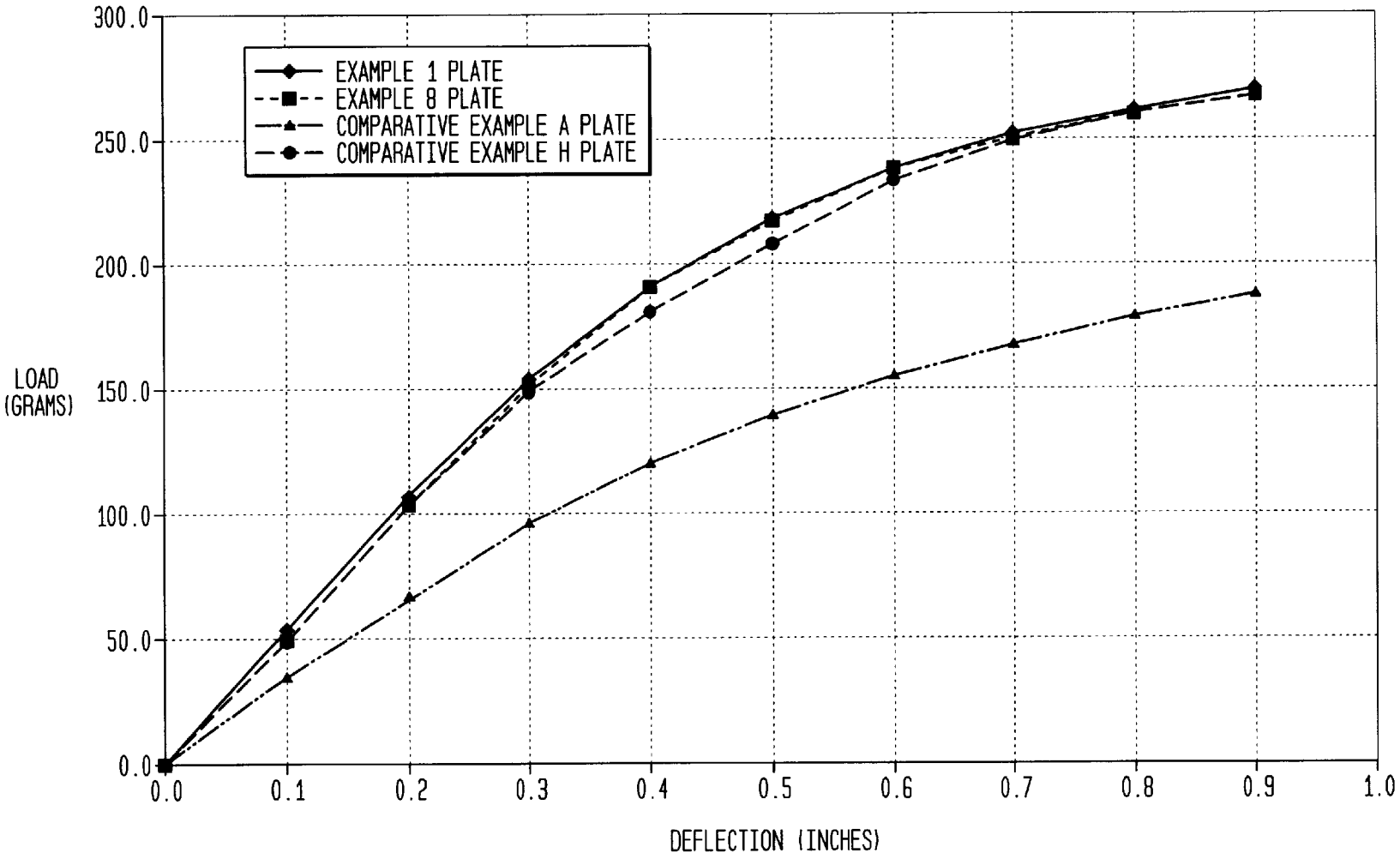
FIG. 10 is a plot of load versus deflection for various plates of the invention and plates formed generally in accordance with prior art designs made from 163 lb/3000 sq ft. ream paperboard with scoring.
Figure 11:
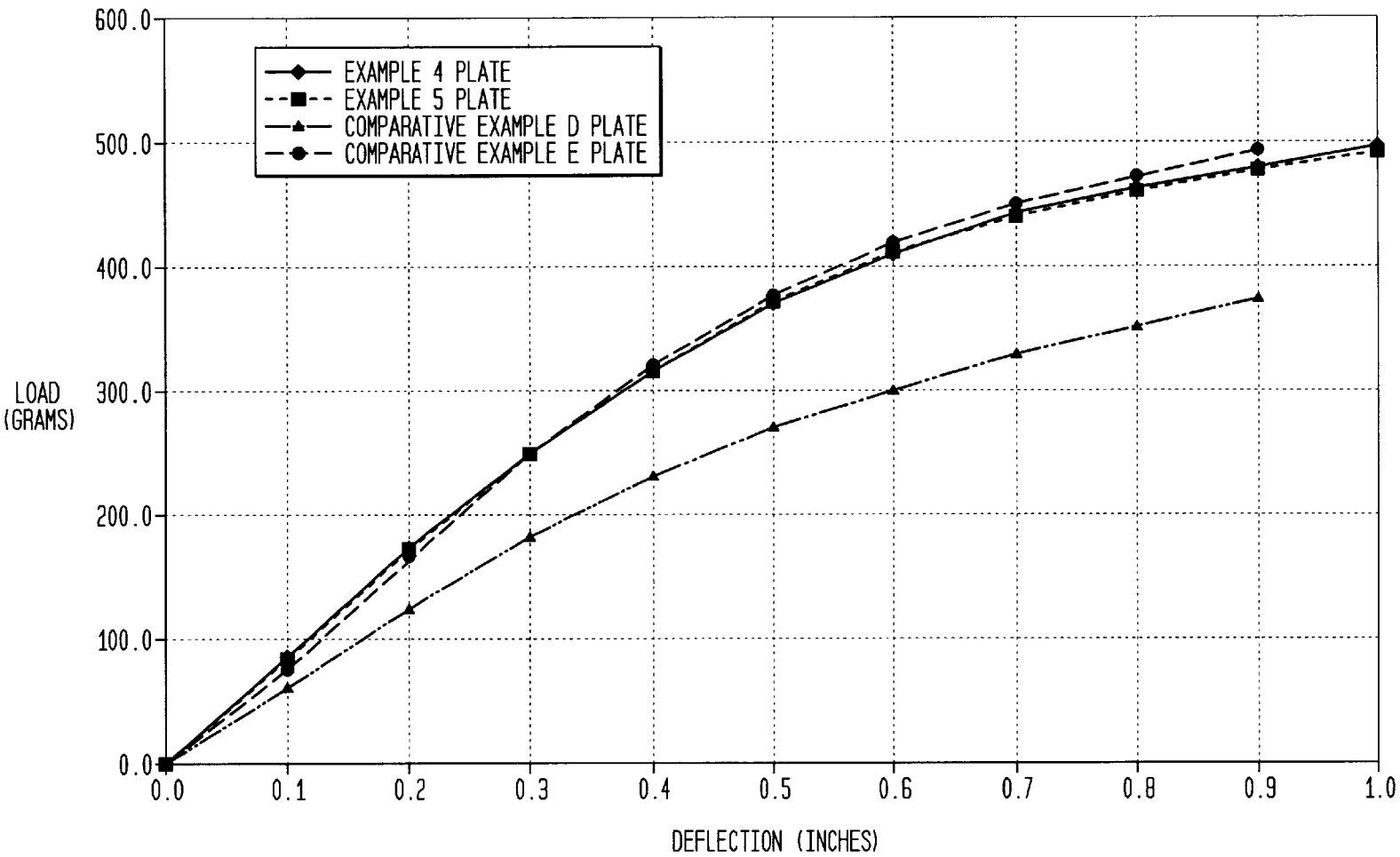
FIG. 11 is a plot of load versus deflection for plates of the invention and various plates made from prior art designs each of which plates was made with 206 lb/3000 sq. ft. ream paperboard with scoring.
Figure 12:
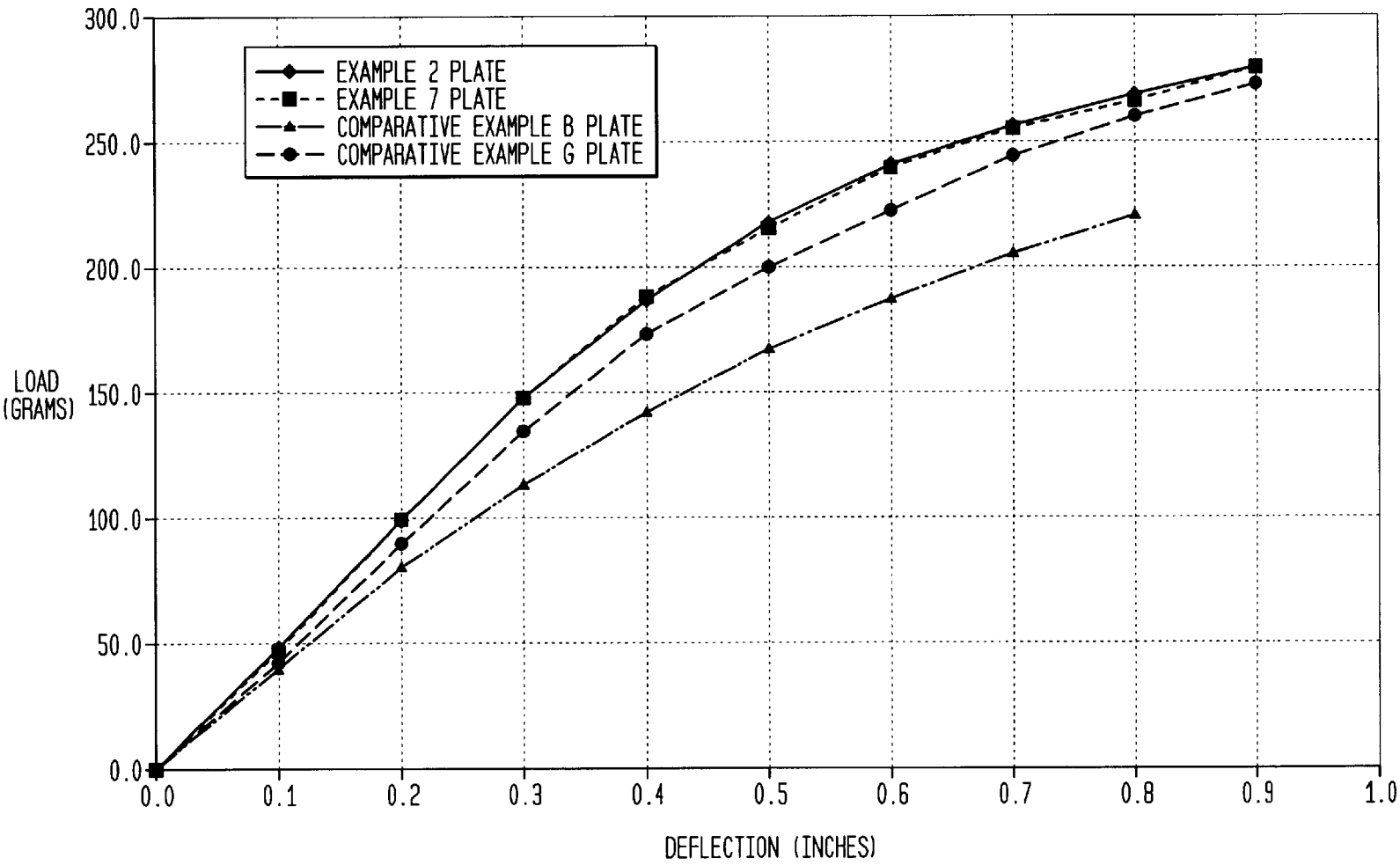
FIG. 12 is a plot of load versus deflection for plates made in accordance with the invention and plates made by way of various prior art designs each of which plates was made with 163 lb/3000 sq. ft. ream paperboard and prepared from blanks without scoring.
Figure 13:
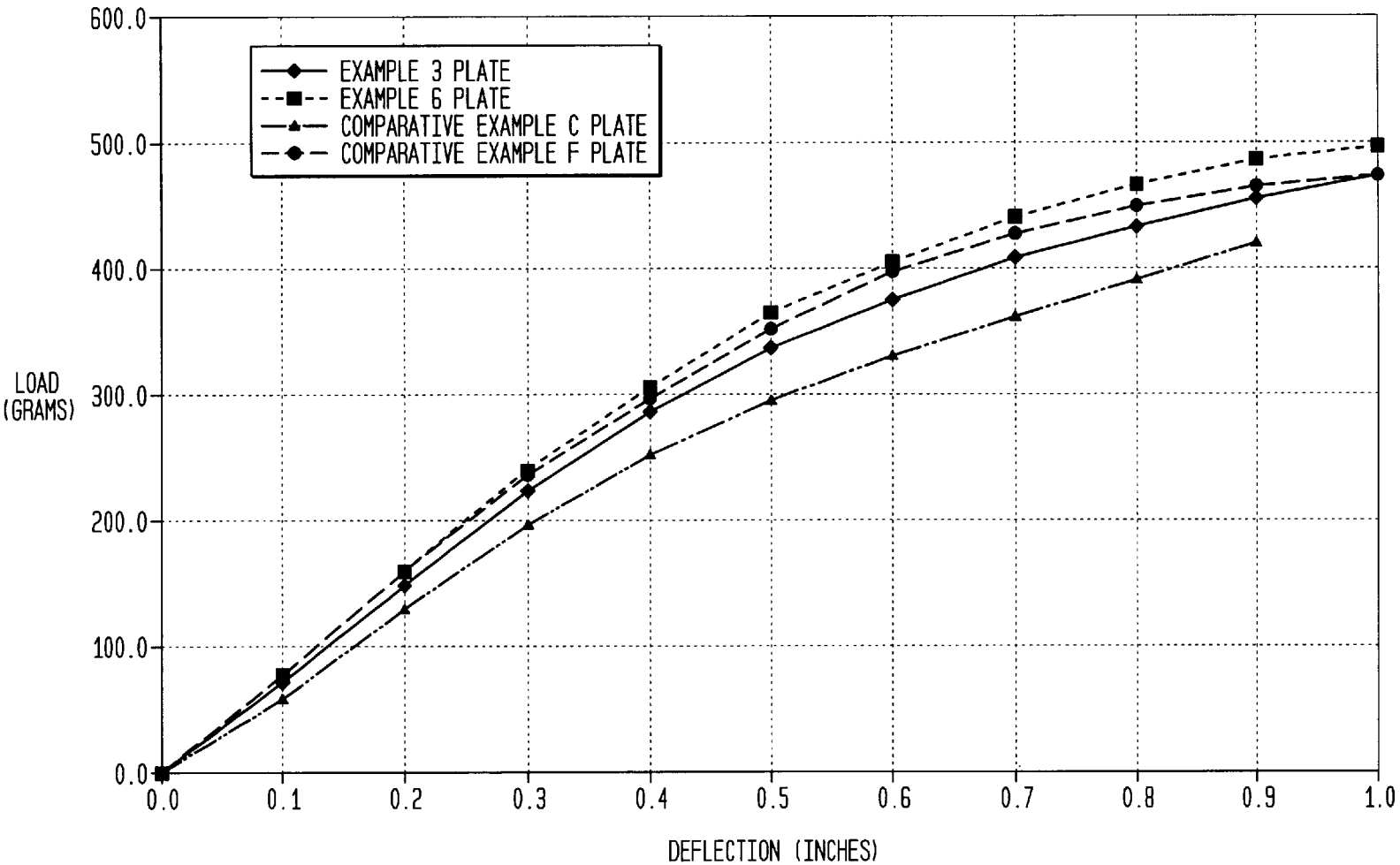
FIG. 13 is a plot of load versus deflection for various plates made in accordance with the present invention and various plates made from prior art designs, each of which plates was made from 206 lb/3000 sq. ft. ream paperboard without scoring of the paperboard blanks from which the containers were prepared.

A disposable paper plate 10 having a characteristic diameter D generally includes a bottom generally planar portion 12, a first annular transition portion 14, a sidewall portion 16 as well as a second annular transition portion 18. The sidewall has a generally linear profile 20 between the first annular transition portion 14 and the second annular transition portion 18. Generally speaking, the inclined profile defines an angle of inclination A1 with respect to a vertical 24 of from about 10 to about 40°. An outer arcuate flange portion 26 has an upper convex surface 28 and defines an outer radius of curvature R3. There is optionally included an inner flange transition portion 34 linking outer arcuate flange portion 26 with second annular transition portion 18. The ratio of the outer radius of curvature R3 of the outer arcuate flange portion to the characteristic diameter of the plate is generally from about 0.0175 to about 0.1. The angle of inclination A1 of sidewall 16 about its linear portion 20 with respect to a vertical 24 is typically from about 10 to about 40° and preferably from about 25 to about 30°. Linear portion 20 of sidewall 16 extends over a length 21 from point A to point B along the sidewall as shown on FIG. 5 between the outermost part of transition section 14 and the innermost portion of transition section 18. Outer arcuate flange portion 26 typically extends downwardly with respect to the second annular transition portion 18 as will be appreciated particularly from FIGS. 3B and 6. In most embodiments, the outer arcuate flange portion terminates well below the height of the uppermost portions of second annular transition portion 18 as can be seen in FIGS. 5 and 6 in particular and defines a flange outer vertical drop as discussed hereafter.

The container is usually configured so that the outer radius of curvature R3 is defined by an outer arcuate flange portion 26 over an included angle A2 of from about 30° to about 80°. Typically included angle A2 is from about 50° to about 75° or so.

In a typical embodiment whether the containers configured in accordance with the invention are made from paperboard or plastic, first annular transition portion 14 defines a concave upper surface 36 defining an inner radius of curvature R1. The ratio of the inner radius of curvature to the characteristic diameter of the disposable container is generally from about 0.014 to about 0.14. So also, the second annular transition portion typically defines a convex upper surface 38 defining an intermediate radius of curvature R2. The ratio of the intermediate radius of curvature to the characteristic diameter of the disposable food container is generally from about 0.014 to about 0.07.

When made from paperboard, the containers of the invention are pleated paperboard containers, being provided with a plurality of pleats such as pleats 40 about their entire periphery, extending from slightly above bottom portion 12 to the outer periphery of arcuate flange portion 26 as is shown in FIG. 1 and following. In preferred embodiments, pressed paperboard containers of the invention are prepared from scored paperboard blanks.

As noted above, the containers of the invention may be plates, bowls, platters, deep dish containers and so forth. When the containers of the present invention are disposable plates, the ratio of the height of the container Y5 to the diameter of the plate, D is from about 0.06 to about 0.12. As noted above plates of the invention may or may not include an inner flange portion 34. When an inner flange portion connecting the outer arcuate flange to the second annular transition portion of the container is provided, it characteristically defines a radial span 44 therebetween. The radial span of the inner flange portion is the horizontal distance between the end of the second annular transition portion and the beginning of the outer arcuate flange portion. This distance is shown as X3–X2 in FIG. 6. Typically the ratio of the radial span to the characteristic diameter of the container is from 0 to about 0.1. The inner flange portion may be horizontal over its radial span or may be inclined upwardly or downwardly, typically by +/− 10 degrees or less with respect to a horizontal line parallel to the bottom of the container.

For better understanding of the invention vis-à-vis the prior art there is provided in FIG. 2 a schematic diagram comparing the profiles of various nominally 9 inch disposable plates. In FIG. 2A there is shown the profile of a plate configured generally in accordance with U.S. Pat. No. 5,326,020 to Cheshire et al. This plate as can be seen from the diagram is characterized by way of an inner profile 46 extending from its center point at the left of the diagram through its second transition portion. This inner profile has a relatively steep generally straight upwardly and outwardly extending sidewall.

Figure 2A:
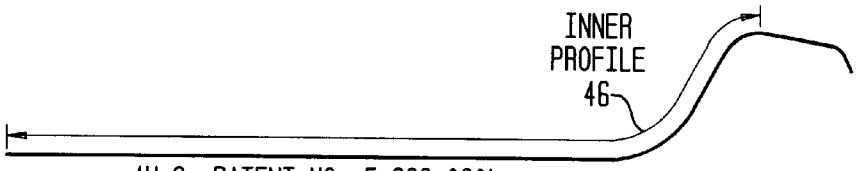
FIG. 2A (PRIOR ART)
FIG. 2A is a schematic diagram illustrating the profile from center of a prior art disposable plate of the general class disclosed in U.S. Pat. No. 5,326,020 to Cheshire et al.
Figure 2B:
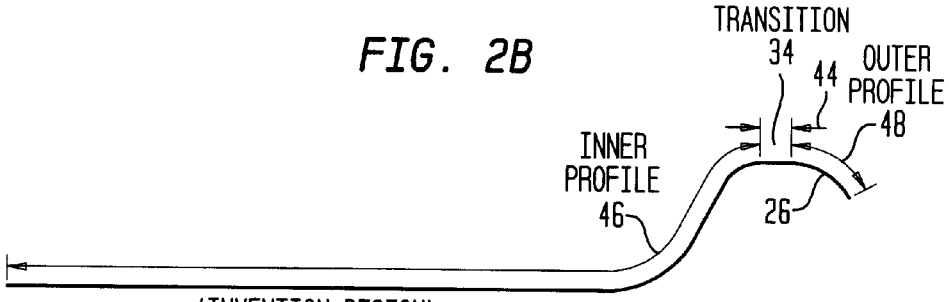
FIG. 2B is a schematic diagram illustrating the profile from center of a disposable plate configured in accordance with the present invention.
Figure 2C:
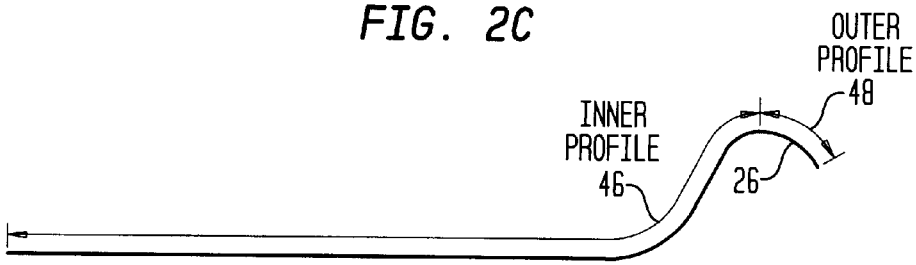
FIG. 2C is a schematic diagram illustrating the profile from center of another plate configured in accordance with the present invention.
Figure 2D:
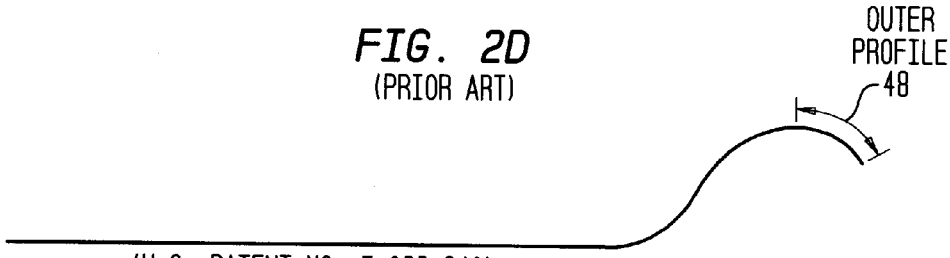
FIG. 2D (PRIOR ART)
FIG. 2D is a schematic diagram illustrating the profile from center of a prior art plate of the general class disclosed in U.S. Pat. No. 5,088,640 to Littlejohn.

There is shown in FIG. 2D a schematic diagram illustrating the profile from center of a nominally 9 inch plate configured generally in accordance with the teachings of U.S. Pat. No. 5,088,640 to Littlejohn. It can be seen from the diagram here, that the profile includes an outer arcuate profile 48 which has a shape corresponding to the outer arcuate flange 26 of a container configured to the present invention.

FIG. 2B shows a profile of a container of the present invention wherein the container has an inner profile 46 resembling the inner profile of the prior art plate of FIG. 2A, an outer profile 48 resembling the outer profile of a container configured in accordance with the U.S. Pat. No. 5,088,640 to Littlejohn as well as an optional transition region 34 over a radial span 44. FIG. 2C shows a profile of another container of the present invention wherein the container has an inner profile 46 resembling the inner profile of the container of FIG. 2A and an outer profile 48 resembling the outer profile of the container of FIG. 2D.

Each of the diagrams of FIGS. 2A through 2D are shown in FIGS. 3A through 3D wherein the various dimensions have been labeled. The parameters for the different plates are set forth below in Table 1.

TABLE 1

Comparison of Dimensions for Nominal 9" Plates

| Item | Description | Nominal 9" Plate of Invention (Profile 1) | Nominal 9" Plate of Invention (Profile 7) | Nominal 9" Plate of U.S. Pat. No. 5,326,020 | Nominal 9" Plate of U.S. Pat. No. 5,088,640 |
|---|---|---|---|---|---|
| X4 | Plate radius, inches | 4.304 | 4.304 | 4.292 | 4.376 |
| X1 | Inner container bottom radius, inches | 3.047 | 3.047 | 3.047 | 3.069 |
| R1 | Inner radius of curvature, inches | 0.501 | 0.499 | 0.501 | — |
| R2 | Intermediate radius of curvature, inches | 0.208 | 0.210 | 0.208 | — |
| R3 | Outer radius of curvature, inches | 0.374 | 0.376 | <0.1 | 0.374 |
| Y4 | Height of Outermost Edge, inches | 0.477 | 0.478 | 0.469 | 0.438 |
| Y5 | Overall Height, inches | 0.664 | 0.664 | 0.664 | 0.62 |
| A1 | Sidewall angle, degrees | 27.5 | 27.5 | 27.5 | — |

TABLE 1-continued

Comparison of Dimensions for Nominal 9" Plates

| Item | Description | Nominal 9" Plate of Invention (Profile 1) | Nominal 9" Plate of Invention (Profile 7) | Nominal 9" Plate of U.S. Pat. No. 5,326,020 | Nominal 9" Plate of U.S. Pat. No. 5,088,640 |
|---|---|---|---|---|---|
| A2 | Included angle of outer arcuate flange portion, degrees | 60 | 60 | — | 60 |

The characteristic diameter, D, is twice X4 for circular containers such as plates.

Dimensions appearing in Table 1 and given below for various embodiments are those that are measured from the die side, that is the lower surface of the product, unless otherwise indicated. The numbers provided are based on forming die dimensions. It should be appreciated that for many products such as pressed paperboard products or thermoformed plastic products, the dimensions of the product may vary slightly from the die dimensions due to relaxation after forming, for example, a radius of curvature of a portion of the container may increase after forming and the corresponding included angle may decrease slightly. Intra-product variances may exist due to, for example, off-center forming. In such cases, average or mean values are used to characterize the container. A preferred technique is to measure a value such as flange outer vertical drop every ninety degrees, that is, at 0, 90°, 180° and 270° about the periphery of a container and then take the arithmetic average in order to determine the flange outer vertical drop of the container. Such averaging is also generally applied to included angles and curvatures of a container in order to determine the characteristic values thereof.

Figure 3A:
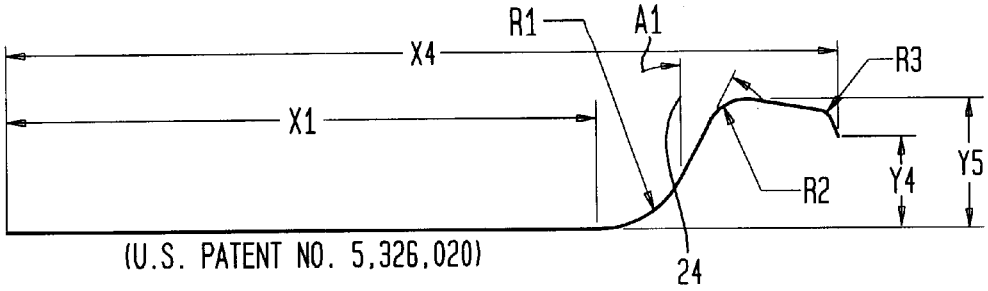
FIG. 3A (PRIOR ART)
FIG. 3A is another schematic diagram illustrating various dimensions of the profile of a prior art disposable plate of the general class disclosed in U.S. Pat. No. 5,326,020 of Cheshire et al.
Figure 3B:
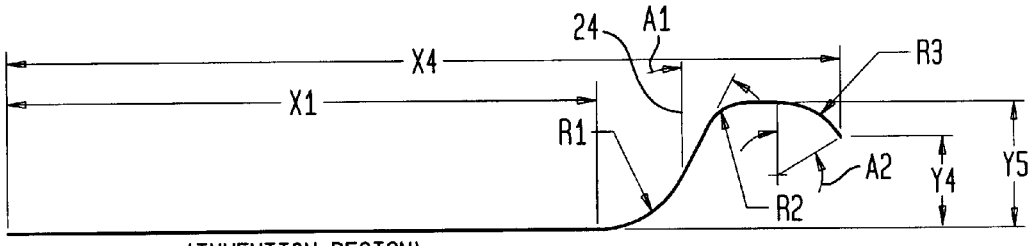
FIG. 3B is a schematic diagram showing the profile from center as well as various dimensions of a disposable plate configured in accordance with the present invention.
Figure 3C:
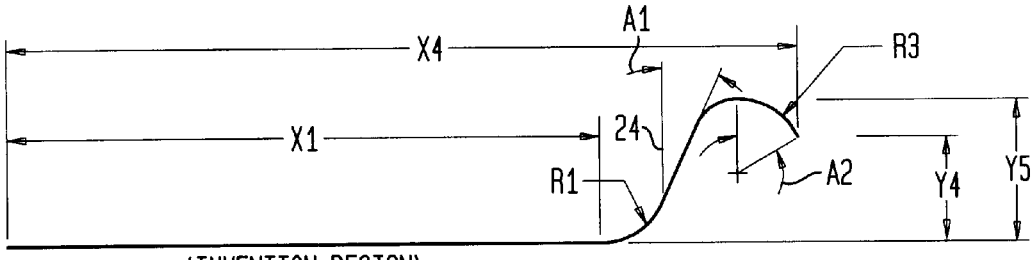
FIG. 3C is a schematic diagram showing the profile from center as well as various dimensions of another disposable plate configured in accordance with the present invention.
Figure 3D:
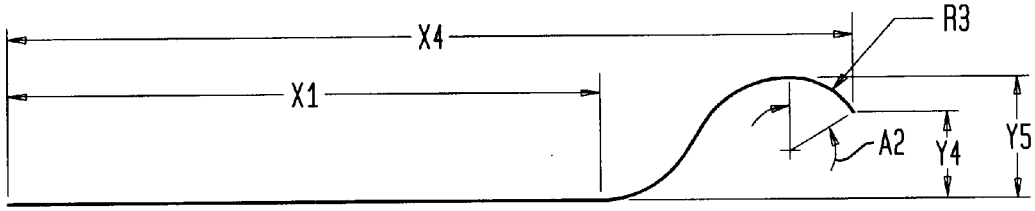
FIG. 3D (PRIOR ART)
FIG. 3D is a schematic diagram illustrating the profile from center along with various dimensions of a prior art plate of the general class disclosed in U.S. Pat. No. 5,088,640 to Littlejohn.

There is shown in FIG. 4 various profiles for containers of the present invention. For example there is shown in FIG. 4A Invention Profile 1 which is generally the profile of the plate of FIG. 1 and is shown in FIGS. 2B and 3B as well as FIGS. 5 and 6. There is shown in FIG. 4B an alternate profile, Invention Profile 2 which differs slightly from that of FIG. 4A in that there is no radial span between the second annular transition region and outer arcuate flange. Likewise, FIGS. 4C–4I show still yet other profiles of the containers of the present invention having a generally linear sidewall and an arcuate outer flange as discussed hereinafter. Generally, the products of the invention are characterized by a generally linear sidewall profile, an arcuate outer flange portion of a specified curvature, as well as a flange outer vertical drop, illustrated on FIGS. 4A through 4I.

It can be seen on the various Figures that the height H' of the downturn is the difference between the overall height of the container H and the height H" of the outermost peripheral portion of the container.

In FIGS. 5 and 6 there is shown in more detail the profile of the inventive container of FIG. 1A and following. In FIG. 5 there is shown in schematic cross section a portion 50 of a plate extending outwardly from its center 52 to its outermost periphery 54. The plate includes generally planar bottom portion 12, sidewall portion 16 with its inclined generally linear profile 20 between the annular transition portions 14 and 18 as has been described hereinabove. There is further provided an inner horizontal flange portion 34 extending between second annular transition portion 18 and outer arcuate flange portion 26. The profile of FIG. 5 is shown schematically in FIG. 6 wherein the various parts and dimensions are labeled. Here again dimensions are generally given for the "die side" or lower surface of a plate manufactured in a press. While bottom portion 12 is generally planar, it may have a step contour ("gravy ring") or a crown of a few degrees or so. As is known in the art, such features help prevent the container from "rocking" when placed on a surface.

Figure 4A:
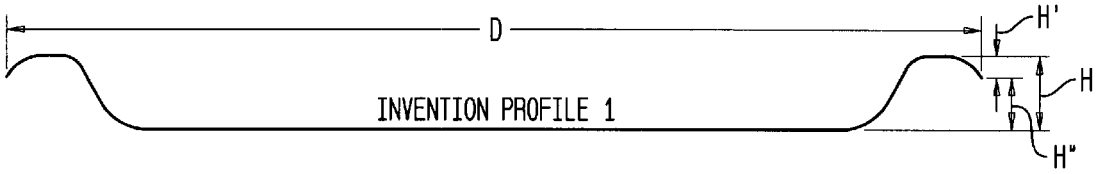
FIGS. 4A–4I are schematic diagrams showing the profiles of various configurations of plates of the present invention.
Figure 4B:
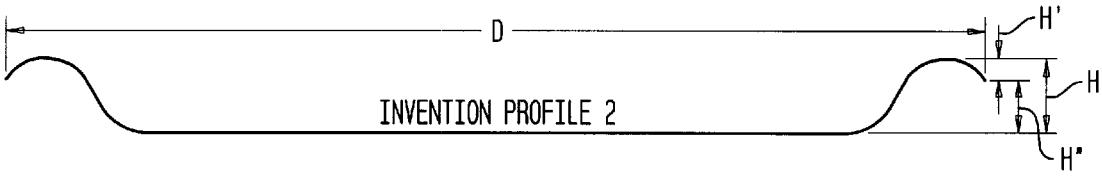
Figure 4C:
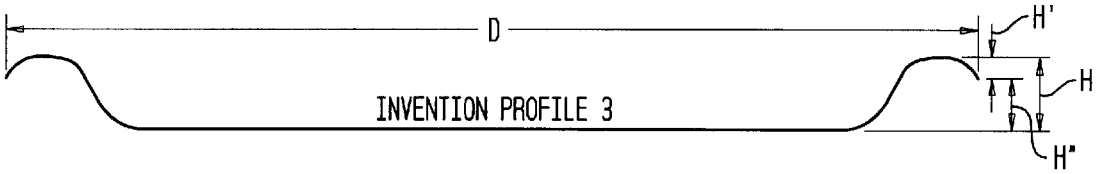
Figure 4D:
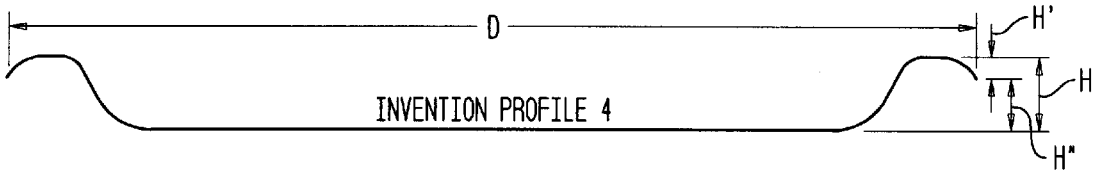
Figure 4E:
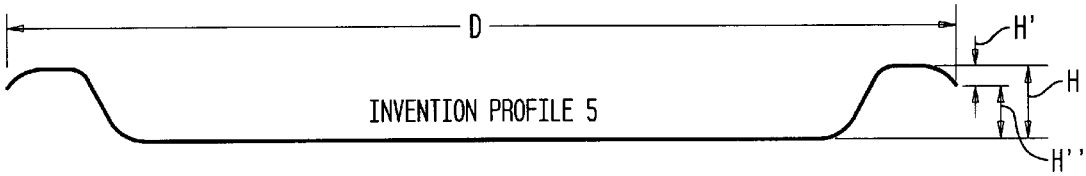
Figure 4F:
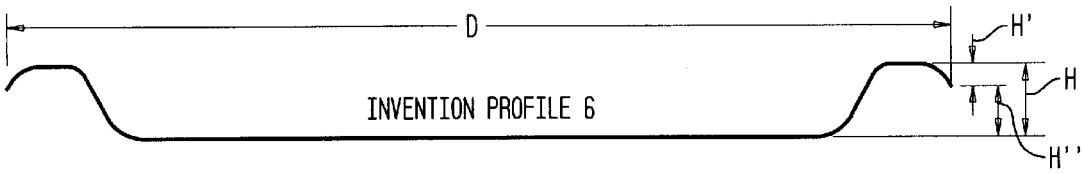
Figure 4G:
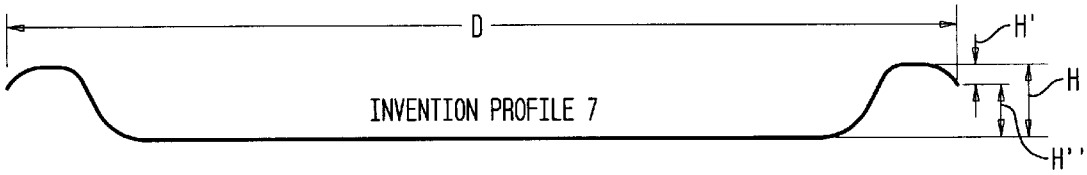
Figure 4H:
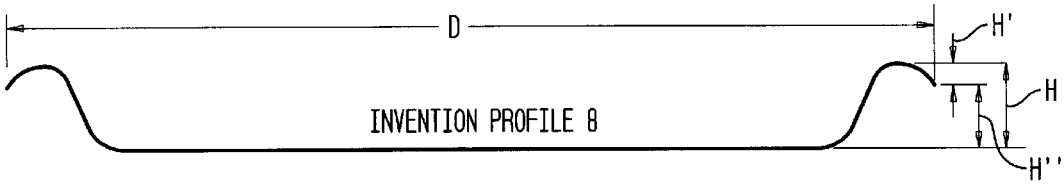
Figure 4I:
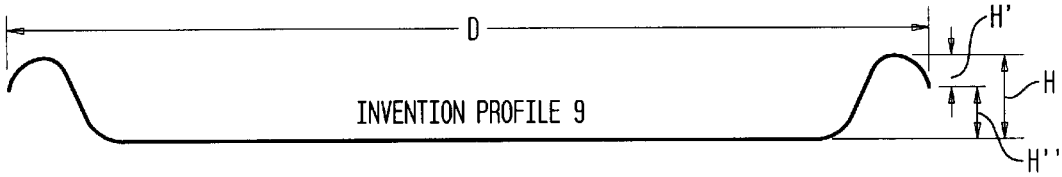

There is shown in FIGS. 7A through 9 various illustrations of a disposable container in accordance with the present invention having the shape designated Invention Profile 9 in FIG. 4I. The container of FIGS. 7A through 9 may be a thermoformed plate, for example, made from polystyrene or the like. In such case it will be appreciated that the article is not a pleated article as was shown above in connection with FIG. 1 and following. Pleated paperboard containers having generally the shape shown in FIG. 7A and following may advantageously be made in accordance with the present invention; however, the geometry of the configuration of the present invention likewise has benefits for disposable plastic articles as will be appreciated from the stiffness and rigidity data appearing below.

There is shown in FIGS. 7A through 9 a disposable food container in the form of a plate 10 having a characteristic diameter D which simply corresponds to the diameter of the plate since the plate is generally circular. The plate has a generally planar bottom portion 12, a first annular transition portion 14 and a sidewall portion 16. A secondary transition annular portion 18 extends between sidewall portion 16 and the arcuate outer flange 26 as before. The sidewall defines a generally linear profile 20 between annular transition portion 14 and annular transition portion 18. The inclined generally linear profile portion 20 defines an angle of inclination A1 with a vertical 24. Outer arcuate flange portion 26 has a convex upper surface 28 and defines an outer radius of curvature R3 as was discussed above in connection with the embodiment shown in FIG. 1 and following. The outer radius of curvature is defined by portion 26 over an included angle A2. There is likewise typically defined an intermediate radius of curvature R2 as well as an inner radius of curvature R1 as was shown in FIG. 1. The various dimensions for the embodiment of FIGS. 7A through 9 are typically like those shown and discussed in connection with FIGS. 1, 5 and 6. A notable difference is however, that is that there is no transition portion 34 between annular transition portion 18 and the outer arcuate flange. In other words, X2 is equal to X3 such that the profile transitions directly to the outer arcuate flange. Otherwise, the dimensions of the embodiment of Invention Profile 9 of articles incorporating Invention Profile 9 is generally that described above. Note that here again the profile 50 extends from the center 52 to the outermost portion 54 as can be appreciated from FIG. 8.

As will be appreciated from the various diagrams, X4 corresponds generally to the radius from center to the outer periphery of the plate, X1 corresponds to the radius of the bottom of the plate, that is the radius of the serving or cutting area of the container, Y1 corresponds to the height of the origin of inner radius of curvature, R1, above the bottom of the plate, X2 is the radius from the center of the plate to the beginning of inner flange portion 34, X3 is the radius from the center of the plate to the end of the inner flange portion 34, R1 is the radius of curvature of the first annular transition portion 14, A1 is the sidewall angle defined between the linear portion 20 of the sidewall and a vertical 24, R2 is the intermediate radius of curvature, the origin of which is a height Y2 above the bottom of the container, R3 is the radius of curvature of arcuate outer flange portion 26. Y3 is the height above the bottom of the container of the origin of the radius R3 (labeled 56 on FIG. 6), A2 is the included angle of the arc defined by the outer arcuate flange portion 26 having radius of curvature, R3, Y4 is the height above the bottom of the container of the outermost periphery 54 of arcuate outer flange portion 26 and Y5 is the overall height of the product. Typical ratios or shape factors are conveniently based on the characteristic diameter of the product, that is, twice X4 for a circular product.

The ratio of the flange outer vertical drop to the characteristic diameter is generally greater than about 0.01. This quantity may be calculated by taking the difference between Y5, the overall height, and Y4, the height above the container bottom of the outermost periphery 54 of outer arcuate flange portion 26 and dividing by the characteristic diameter of the container.

This quantity is determined by measuring Y4 and Y5 at four equally spaced locations for averaging purposes as noted above by positioning a container on a measurement table flange down and placing a lightweight (150 gram) plate preferably generally matching the shape of the bottom of the container thereon. The container is thus positioned so that its flange is lightly pressed against the flat measurement surface and a height gauge can be used to measure Y4 and Y5 in order to calculate the flange outer vertical drop. Any other suitable technique may be used so long as the measurement apparatus does not distort the shape of the container. For example, one could measure the overall height from the bottom surface to uppermost surface of the container and adjust for caliper.

Typical dimensions, angles and ranges thereof for various plates are given in Tables 2, 3 and 4 below.

TABLE 2

Characteristic Dimensions And Angles (Die Side Dimensions)

| Ratio or Angle | Typical Value Invention Profile 1 | Typical Value Invention Profile 7 | Typical Value Invention Profile 6 | Typical Value Invention Profile 5 | Typical Value Invention Profile 8 | Preferred Range | General Range |
|---|---|---|---|---|---|---|---|
| R3/D | 0.043 | 0.044 | 0.044 | 0.044 | 0.047 | 0.035 to 0.07 | 0.0175 to 0.1 |
| A1, Degrees | 27.5 | 27.5 | 27.5 | 27.5 | 24.2 | 25 to 30 | 10 to 40 |
| A2, Degrees | 60 | 60 | 60 | 57 | 60 | 50 to 75 | 30 to 80 |
| R2/D | 0.024 | 0.024 | 0.022 | 0.022 | 0.026 | 0.020 to 0.030 | 0.014 to 0.07 |
| Y5/D | 0.077 | 0.077 | 0.077 | 0.077 | 0.092 | — | — |
| (Y5–Y4)/D | 0.02 | 0.02 | 0.02 | 0.02 | 0.02 | 0.015 to 0.035 | 0.01 to 0.050 |

TABLE 3

Typical Die Side Dimensions And Angles for 9" Plates

| Dimension or Angle (Inches or Degrees) | Typical Value Invention Profile 1 | Typical Value Invention Profile 7 | Typical Value Invention Profile 6 | Typical Value Invention Profile 5 | Typical Value Invention Profile 8 | Preferred Range | General Range |
|---|---|---|---|---|---|---|---|
| A1 | 27.5 | 27.5 | 27.5 | 27.5 | 24.2 | 25 to 30 | 10 to 40 |
| A2 | 60 | 60 | 60 | 57 | 60 | 50 to 75 | 30 to 80 |
| R1 | 0.5006 | 0.4991 | 0.3750 | 0.3750 | 0.3657 | 0.25 to 0.75 | 0.12 to 1.20 |
| R2 | 0.2075 | 0.2095 | 0.1875 | 0.1875 | 0.2200 | 0.18 to 0.25 | 0.12 to 0.43 |
| R3 | 0.3741 | 0.3761 | 0.3741 | 0.3741 | 0.3950 | 0.30 to 0.60 | 0.15 to 0.86 |
| X1 | 3.0473 | 3.0467 | 3.0470 | 3.0470 | 3.1340 | 2.90 to 3.20 | 2.80 to 3.30 |
| X2 | 3.8226 | 3.8226 | 3.7339 | 3.7339 | 3.8598 | 3.70 to 4.10 | 3.50 to 4.30 |
| X3 | 3.9799 | 3.9799 | 3.9620 | 3.9798 | 3.8598 | 3.70 to 4.10 | 3.50 to 4.30 |
| Y1 | 0.5006 | 0.4991 | 0.3750 | 0.3750 | 0.3657 | 0.25 to 0.75 | 0.12 to 1.20 |
| Y2 | 0.4563 | 0.4548 | 0.4763 | 0.4763 | 0.5518 | 0.35 to 0.60 | 0.07 to 0.88 |
| Y3 | 0.2897 | 0.2882 | 0.2897 | 0.2897 | 0.3768 | 0.00 to 0.50 | (−)0.36 to 0.85 |
| Y4 | 0.4768 | 0.4782 | 0.4768 | 0.4920 | 0.5745 | 0.20 to 0.60 | 0.10 to 0.95 |
| Y5 | 0.6638 | 0.6643 | 0.6638 | 0.6638 | 0.7718 | 0.60 to 0.80 | 0.50 to 1.00 |

TABLE 4

Typical Die Side Dimensions And Angles for 10" Plates

| Dimension or Angle (Inches or Degrees) | Typical Value Invention Profile 7 | Typical Value Invention Profile 6 | Typical Value Invention Profile 5 | Typical Value Invention Profile 8 | Preferred Range | General Range |
|---|---|---|---|---|---|---|
| A1 | 27.5 | 27.5 | 27.5 | 24.2 | 25 to 30 | 10 to 40 |
| A2 | 60 | 60 | 57 | 60 | 50 to 75 | 30 to 80 |
| R1 | 0.5924 | 0.4437 | 0.4437 | 0.4328 | 0.30 to 0.90 | 0.14 to 1.42 |
| R2 | 0.2455 | 0.2219 | 0.2219 | 0.2603 | 0.20 to 0.30 | 0.14 to 0.50 |
| R3 | 0.4427 | 0.4427 | 0.4427 | 0.4674 | 0.35 to 0.70 | 0.18 to 1.00 |
| X1 | 3.6056 | 3.6056 | 3.6056 | 3.7086 | 3.40 to 3.80 | 3.30 to 3.90 |
| X2 | 4.5230 | 4.4184 | 4.4184 | 4.5674 | 4.38 to 4.85 | 4.14 to 5.08 |
| X3 | 4.7095 | 4.6884 | 4.7095 | 4.5674 | 4.38 to 4.85 | 4.14 to 5.08 |
| Y1 | 0.5924 | 0.4437 | 0.4437 | 0.4328 | 0.30 to 0.90 | 0.14 to 1.42 |
| Y2 | 0.5400 | 0.5636 | 0.5636 | 0.6530 | 0.40 to 0.70 | 0.08 to 1.04 |
| Y3 | 0.3428 | 0.3428 | 0.3428 | 0.4459 | 0.00 to 0.60 | (−)0.42 to 1.00 |
| Y4 | 0.5642 | 0.5882 | 0.5822 | 0.6798 | 0.24 to 0.70 | 0.12 to 1.12 |
| Y5 | 0.7855 | 0.7855 | 0.7855 | 0.9133 | 0.70 to 0.95 | 0.60 to 1.18 |

The arcuate outer flange of containers of the present invention is characterized by a smooth, flowing profile as described and illustrated herein. That profile may define a single radius of curvature such as R3 in FIG. 6 for arcuate outer profiles of constant curvature. In embodiments where the arcuate outer profile has a plurality of characteristic radii, for example, if the profile is somewhat in the nature of spiral or elliptical in shape, a weighted mean curvature may be used, the radius of curvature being the reciprocal of curvature.

Such geometry may arise, for example, when the container is formed in a die set having a contour corresponding to the outer arcuate flange of the container with a single radius of curvature in that region and the product, after forming, relaxes slightly in some areas more than others. In cases where a somewhat segmented arcuate outer flange is employed, one may simply approximate the corresponding arcuate shape to determine the mean curvature (which may be a weighted mean curvature as noted above).

The arcuate outer flange may optionally be adjacent an inner flange portion with a linear or straight profile as is seen in FIGS. 5 and 6. The arcuate outer flange may optionally be adjacent an outer lip portion with a linear profile so long as the flowing arcuate outer profile having a radius of curvature of from about 0.0175 to about 0.1 times the characteristic diameter of the product is provided. The inner flange portion and/or an optional outer linear lip portion are not included in calculating the radius of curvature of the arcuate outer flange portion.

In other words, the curvature of the arc of the arcuate outer flange may be a constant curvature; that is, having a single radius of curvature such as R3 in FIG. 6 wherein the curvature of the arcuate outer flange is 1/R3 or the arc may have a mean curvature. The curvature of any arc of the container may be so characterized.

In preferred containers of the present invention, the (dimensionless) product of the curvature of the arcuate outer flange portion and the characteristic diameter is generally from about 10 to about 50. The product of the characteristic diameter with the curvature of the arcuate outer flange is typically from about 15 to about 30 and perhaps in some preferred embodiments between about 20 and 30. From about 22.5 to 25 is particularly preferred in connection with some paperboard plate designs.

The flowing outer profile is particularly important for forming the containers of the invention from paperboard in a heated die set, so that severe transitions involving two large relatively straight profile sections and a relatively small radius profile portion therebetween making a sharp corner on the outer part of the die and product profile are avoided. Such severe transitions in the outer flange profile as are seen, for example, in U.S. Pat. No. 5,326,020, can make manufacturing difficult in terms of pleating control (especially for lower basis weight paperboards) and off-center forming problems.

EXAMPLES 1–8

Comparative Examples A–H

A series of nominally 9" plates made from scored and unscored paperboard blanks were prepared having the configuration of the Invention Profile 1 container. These plates, Examples 1–8, had the SSI rigidity, Instron® rigidity values and various other properties recorded in Tables 5 through 7 below.

A first comparative series of nominally 9" plates having the configuration of U.S. Pat. No. 5,088,640 were also prepared and tested. The plates were also prepared from scored and unscored paperboard of various basis weights and are designated Comparative Examples A through D in Tables 5 and 8.

Further, a second comparative series of nominally 9" plates having the configuration of U.S. Pat. No. 5,326,020 were prepared and tested for rigidity. Their weights and calipers were recorded as in the other Examples. These plates are designated Comparative Examples E–H in Tables 5 and 9.

TABLE 5

Weight, Caliper and SSI Rigidity for Nominally 9" Plates

| Example | Basis Weight lb/3000 ft.$^2$ | Basis Weight Raw Wt. g/Plate | Caliper 1 Sheet mils/1 sht | SSI Plate Rigidity GM (grams) |
|---|---|---|---|---|
| 1 | 169.20 | 2.665 | 14.600 | 244 |
| 2 | 170.00 | 2.678 | 14.667 | 243 |
| 3 | 215.32 | 3.391 | 19.580 | 355 |
| 4 | 213.90 | 3.369 | 19.600 | 409 |
| 5 | 218.57 | 3.442 | 19.640 | 409 |
| 6 | 216.87 | 3.416 | 19.700 | 363 |
| 7 | 170.85 | 2.691 | 14.647 | 238 |
| 8 | 171.91 | 2.708 | 14.617 | 256 |
| A | 170.67 | 2.688 | 14.510 | 175 |
| B | 169.65 | 2.672 | 14.607 | 184 |
| C | 215.72 | 3.398 | 19.460 | 278 |
| D | 217.39 | 3.424 | 19.710 | 277 |
| E | 217.33 | 3.423 | 19.793 | 396 |
| F | 217.26 | 3.422 | 19.960 | 354 |
| G | 170.89 | 2.691 | 14.930 | 212 |
| H | 168.52 | 2.654 | 14.723 | 228 |

TABLE 6

Instron ® Rigidity for Nominally 9" Plates, 163 lb Nominal Basis Weight Paperboard and 206 lb Nominal Paperboard, Examples 1–4 (Invention Profile 1)

| Example<br>Paperboard<br>Scoring<br>Deflection<br>(inches) | 1<br>163 lb/rm<br>Yes<br>Load GM<br>(grams) | 2<br>163 lb/rm<br>No<br>Load GM<br>(grams) | 3<br>206 lb/rm<br>No<br>Load GM<br>(grams) | 4<br>206 lb/rm<br>Yes<br>Load GM<br>(grams) |
|---|---|---|---|---|
| 0.0 | 0.0 | 0.0 | 0.0 | 0.0 |
| 0.1 | 53.2 | 47.3 | 70.6 | 84.1 |
| 0.2 | 105.6 | 99.1 | 145.7 | 171.9 |
| 0.3 | 152.7 | 146.5 | 221.6 | 248.6 |
| 0.4 | 189.9 | 186.1 | 284.5 | 315.9 |
| 0.5 | 218.2 | 217.8 | 335.4 | 369.1 |
| 0.6 | 236.9 | 240.8 | 372.8 | 409.1 |
| 0.7 | 251.7 | 256.2 | 406.2 | 442.1 |
| 0.8 | 261.0 | 268.3 | 429.8 | 463.3 |
| 0.9 | 269.4 | 279.3 | 453.5 | 480.0 |
| 1.0 | — | — | 471.7 | 497.5 |

TABLE 7

Instron ® Rigidity for Nominally 9" Plates, 163 lb Nominal Basis Weight Paperboard and 206 lb Nominal Paperboard, Examples 5–8 (Invention Profile 1)

| Example<br>Paperboard<br>Scoring<br>Deflection<br>(Inches) | 5<br>206 lb/rm<br>Yes<br>Load GM<br>(grams) | 6<br>206 lb/rm<br>No<br>Load GM<br>(grams) | 7<br>163 lb/rm<br>No<br>Load GM<br>(grams) | 8<br>163 lb/rm<br>Yes<br>Load GM<br>(grams) |
|---|---|---|---|---|
| 0.0 | 0.0 | 0.0 | 0.0 | 0.0 |
| 0.1 | 82.8 | 75.0 | 46.0 | 49.1 |
| 0.2 | 171.1 | 157.5 | 99.1 | 102.3 |
| 0.3 | 248.1 | 237.9 | 147.4 | 151.1 |
| 0.4 | 316.3 | 304.3 | 188.1 | 191.2 |
| 0.5 | 371.7 | 362.7 | 215.4 | 217.3 |
| 0.6 | 411.6 | 402.8 | 239.4 | 238.1 |
| 0.7 | 440.0 | 438.5 | 254.9 | 249.7 |
| 0.8 | 460.4 | 465.0 | 265.6 | 259.6 |
| 0.9 | 478.2 | 484.5 | 278.9 | 267.0 |
| 1.0 | 491.6 | 494.8 | — | — |

TABLE 8

Instron ® Rigidity for Nominally 9" Plates 163 lb Nominal Basis Weight Paperboard and 206 lb Nominal Basis Weight Paperboard Configured As In U.S. Pat. No. 5,088,640, Comparative Examples A–D

| Example<br>Paperboard<br>Scoring<br>Deflection<br>(Inches) | A<br>163 lb/rm<br>Yes<br>Load GM<br>(grams) | B<br>163 lb/rm<br>No<br>Load GM<br>(grams) | C<br>206 lb/rm<br>No<br>Load GM<br>(grams) | D<br>206 lb/rm<br>Yes<br>Load GM<br>(grams) |
|---|---|---|---|---|
| 0.0 | 0.0 | 0.0 | 0.0 | 0.0 |
| 0.1 | 34.0 | 39.8 | 57.7 | 59.3 |
| 0.2 | 66.7 | 80.3 | 127.5 | 122.8 |
| 0.3 | 95.4 | 112.8 | 195.0 | 181.9 |
| 0.4 | 119.0 | 142.0 | 250.8 | 230.4 |
| 0.5 | 138.1 | 167.1 | 293.7 | 269.1 |
| 0.6 | 154.0 | 187.4 | 328.9 | 299.9 |
| 0.7 | 167.3 | 205.4 | 359.2 | 329.3 |
| 0.8 | 178.4 | 220.6 | 387.8 | 350.7 |
| 0.9 | 187.8 | — | 417.0 | 373.8 |
| 1.0 | 200.0 | — | — | — |

TABLE 9

Instron ® Rigidity for Nominally 9" Plates 163 lb Nominal Basis Weight Paperboard and 206 lb Nominal Basis Weight Paperboard Configured As In U.S. Pat. No. 5,326,020, Comparative Examples E–H

| Example<br>Paperboard<br>Scoring<br>Deflection<br>(Inches) | E<br>206 lb/rm<br>Yes<br>Load GM<br>(grams) | F<br>206 lb/rm<br>No<br>Load GM<br>(grams) | G<br>163 lb/rm<br>No<br>Load GM<br>(grams) | H<br>163 lb/rm<br>Yes<br>Load GM<br>(grams) |
|---|---|---|---|---|
| 0.0 | 0.0 | 0.0 | 0.0 | 0.0 |
| 0.1 | 73.8 | 75.7 | 41.1 | 49.8 |
| 0.2 | 164.7 | 158.1 | 88.9 | 102.1 |
| 0.3 | 248.3 | 233.6 | 133.7 | 147.4 |
| 0.4 | 320.0 | 293.8 | 172.8 | 180.5 |
| 0.5 | 375.9 | 349.2 | 199.3 | 207.9 |
| 0.6 | 418.4 | 395.2 | 222.1 | 232.9 |
| 0.7 | 449.1 | 424.3 | 243.6 | 249.2 |
| 0.8 | 471.3 | 446.1 | 259.5 | 260.4 |
| 0.9 | 492.5 | 462.4 | 271.6 | 267.0 |
| 1.0 | — | 471.1 | — | — |

The foregoing Instron® Rigidity Data is also plotted in FIGS. 10–13 which are plots of load in grams versus deflection in inches for the Invention Profile 1 design and the prior art designs for various weights and for products prepared from paperboard blanks with and without scoring.

It should be appreciated from the foregoing Tables and FIGS. 10–13 that product configured in accordance with the invention typically exhibits rigidity much greater than corresponding product configured in accordance with the design described in U.S. Pat. No. 5,088,640. For example, it can be seen in FIG. 10 that the plates of the invention deflect about ½" under a load of more than 200 grams, while a corresponding 4-radius plate deflects ½" under a load of about 140 grams; the plate of the invention thus exhibiting a rigidity of over 40% higher at this deflection.

It can further be seen from FIGS. 10–13 that the plates of the invention exhibit overall rigidity, as measured by either the SSI method or the Instron® method, comparable to the overall rigidity of containers configured in accordance with U.S. Pat. No. 5,326,020.

Rim Stiffness

Both paper and plastic plates were tested for SSI rigidity and rim stiffness as described herein. Rim stiffness is a measure of the local rim strength about the periphery of the container as opposed to overall or SSI rigidity. This test has been noted to correlate somewhat better with actual consumers' perception of product sturdiness. SSI rigidity is a measure of the load carrying capability of the plate, whereas rim stiffness relates to what a consumer feels when flexing a plate to gauge its strength. Preferably, specimens are conditioned and testing performed at standard conditions for paperboard testing when a paper container is tested, 72° F. and 50% relative humidity. Geometric averages for the machine direction and cross-direction are preferably reported.

Figure 14:
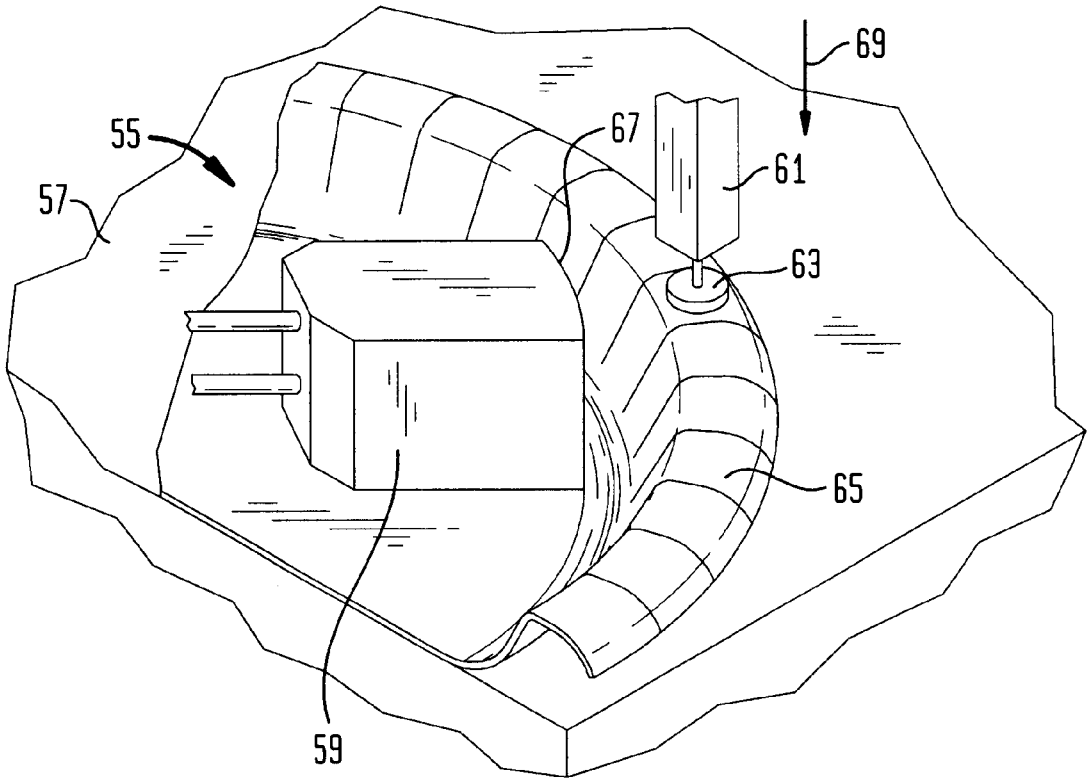
FIG. 14 is a schematic diagram illustrating a portion of an apparatus for determining rim stiffness.

The particular apparatus employed is referred to as a rim stiffness instrument, developed by Georgia-Pacific Corporation, Neenah Technical Center, 1915 Marathon Avenue, Neenah, Wis. 54956. This instrument includes a dial micrometer which reads to 0.001 inch available from Standard Gage Co., Inc., 70 Parker Avenue, Poughkeepsie, N.Y. 12601, as well as a load gauge available from Chatillon, Force Measurements Division, P.O. Box 35668, Greensboro, N.C. 27425-5688. The test procedure measures the force to deflect the rim downwardly 0.1 inch as the specimen is restrained about its bottom between a platen and a restraining member as will be further appreciated by reference to FIG. 14.

Rim stiffness instrument 55 includes generally a platen 57, a plurality of restraining members, preferably four equally spaced restraining members such as member 59 and a gauge 61 provided with a probe 63. A specimen such as plate 65 is positioned as shown and clamped tightly about its planar bottom portion to platen 57 by way of restraining members, such as member 59. The specimen is clamped over an area of several square inches or so such that the bottom of the specimen is fully restrained inwardly from the first transition portion. Note that restraining member 59 is disposed such that its outer edge 67 is positioned at the periphery of the serving area of the container, that is, at X1, the radius of the bottom of the container as shown in the various diagrams.

Probe 63 is then advanced downwardly in the direction of arrow 69 a distance of 0.1 inch while the force is measured and recorded by gauge 61. Only the maximum force is recorded, typically occurring at the maximum deflection of 0.1 inch. Probe 63 is preferably positioned in the center of the flange of plate 65 or on a high point of the flange as appropriate. The end of the probe may be disk-shaped or of other suitable shape and is preferably mounted on a universal-type joint so that contact with the rim is maintained during testing. Probe 63 is generally radially aligned with restraining clamp member 59.

EXAMPLES 9–18

Comparative Examples I–N

Using the procedures described above, 9" and 10" pressed paperboard plates having various shapes of the invention were prepared and tested for SSI rigidity and rim stiffness. The plates' stiffness and rigidity is compared, with plates of the '640 and '020 patents made from like paperboard in Tables 10 and 11. Results appear graphically in FIGS. 15 and 16.

TABLE 10

Nominal 9" Plate SSI Rigidity and Rim Stiffness

| Plate Shape (Basis Wt.) | SSI Rigidity gms/.5") | Rim Stiffness gms/.1" |
|---|---|---|
| Invention Profile 6 (163 lb/rm) | 288 | 880 |
| Invention Profile 6 (206 lb/rm) | 505 | 1527 |
| Invention Profile 7 (163 lb/rm) | 260 | 1034 |
| Invention Profile 8 (163 lb/rm) | 247 | 1404 |
| Invention Profile 8 (206 lb/rm) | 415 | 2289 |
| '020 Patent (163 lb/rm) | 260 | 804 |
| '640 Patent (163 lb/rm) | 154 | 614 |
| '020 Patent (206 lb/rm) | 454 | 1446 |

TABLE 11

Nominal 10" Plate SSI Rigidity Rim Stiffness

| Plate Shape (Basis Wt.) | SSI Rigidity (gms/.5") | Rim Stiffness (gms/.1") |
|---|---|---|
| Invention Profile 6 (210 lb/rm) | 374 | 1455 |
| Invention Profile 6 (220 lb/rm) | 498 | 1767 |
| Invention Profile 7 (210 lb/rm) | 340 | 1276 |
| Invention Profile 8 (210 lb/rm) | 286 | 1785 |
| Invnetion Profile 8 (220 lb/rm) | 384 | 2306 |
| '020 Patent (210 lb/rm) | 339 | 1304 |
| '640 Patent (210 lb/rm) | 332 | 943 |
| '020 Patent (220 lb/rm) | 466 | 1579 |

Figure 15:
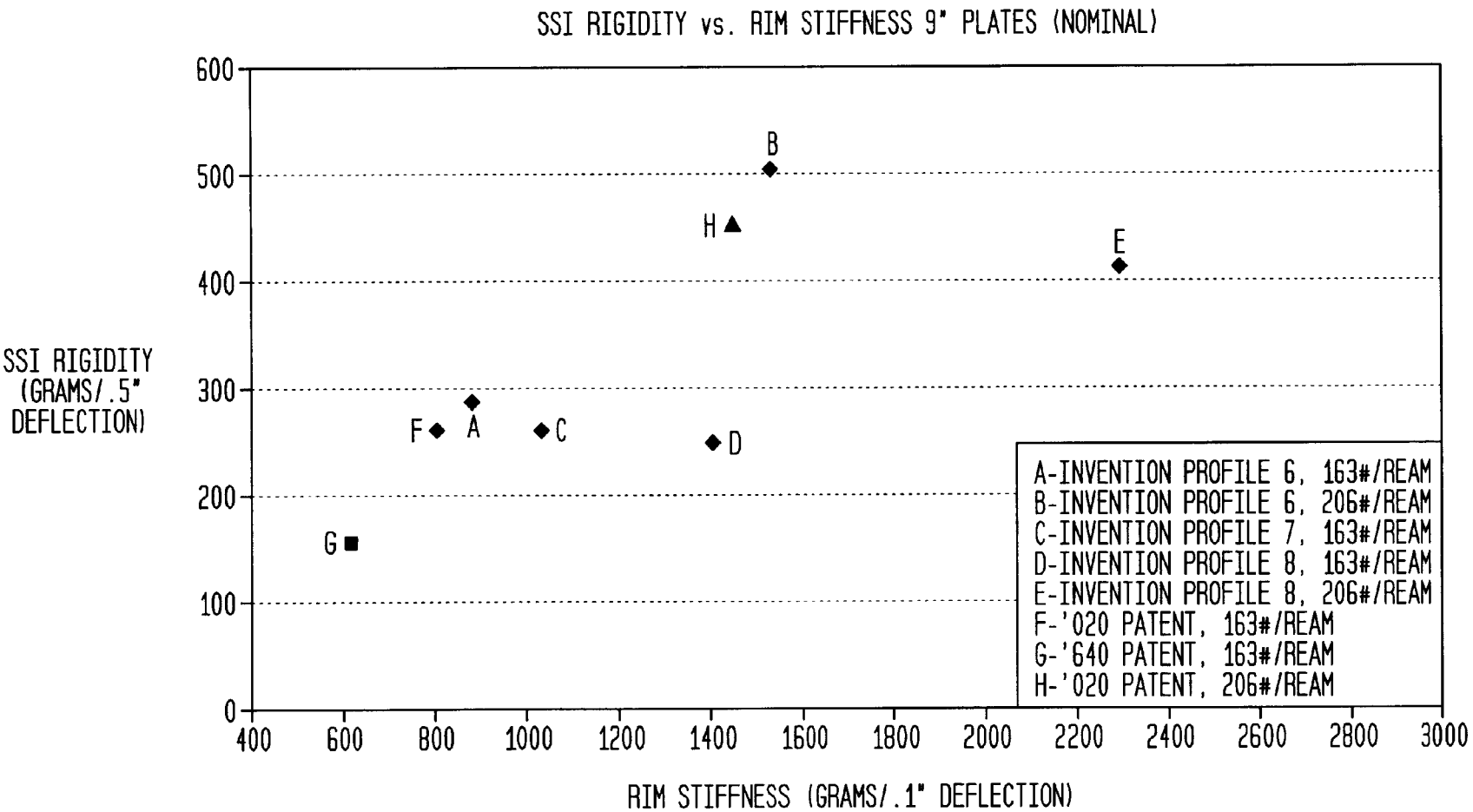
FIG. 15 is a plot of Rigidity vs. Rim Stiffness for various plates having a nominal diameter of 9 inches and like plates configured in accordance with U.S. Pat. No. 5,326,020 as well as U.S. Pat. No. 5,088,640.
Figure 16:
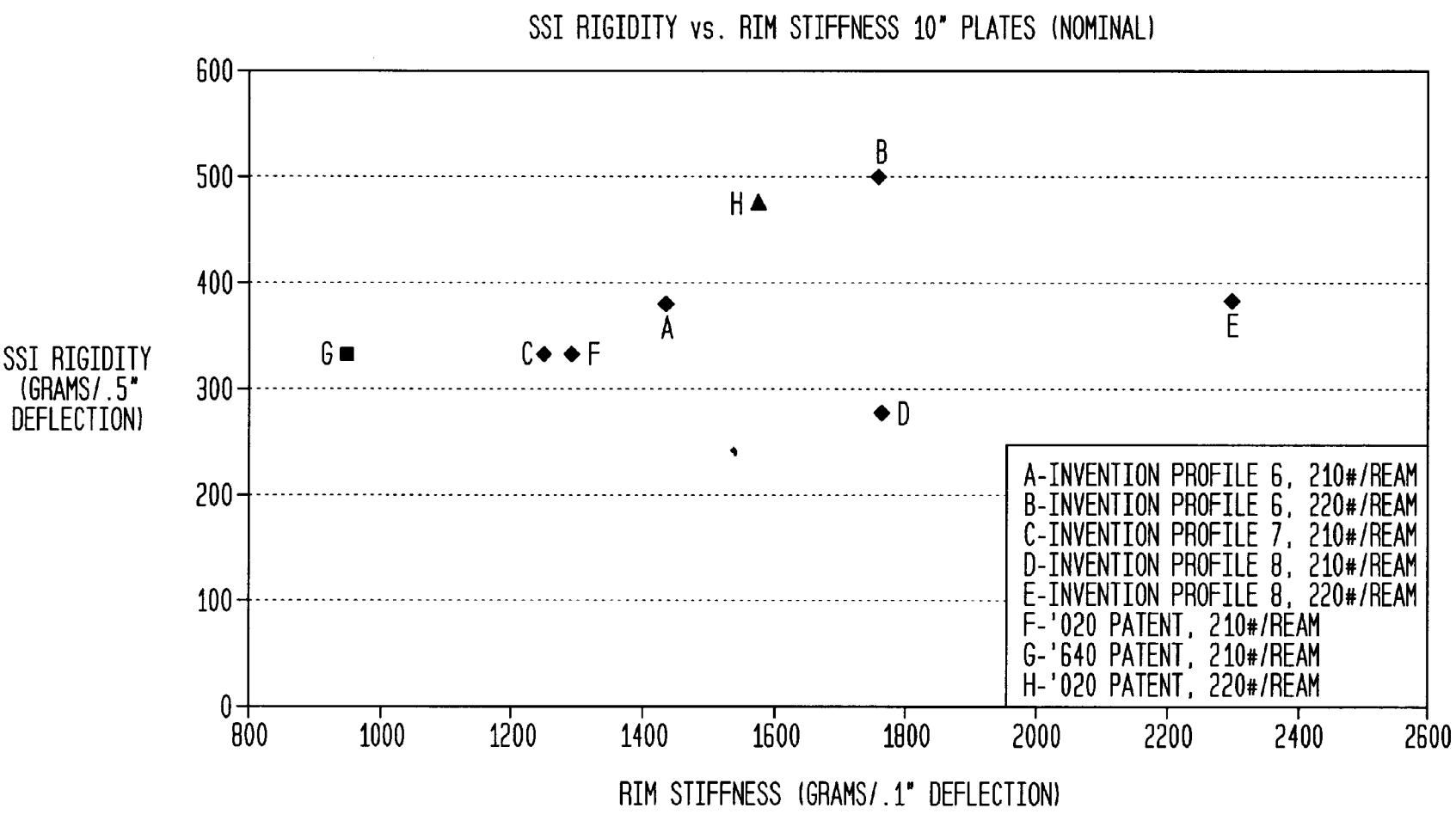
FIG. 16 is a plot of Rigidity vs. Rim Stiffness for various plates of the invention having a nominal diameter of 10 inches and like plates configured in accordance with U.S. Pat. No. 5,326,020 as well as U.S. Pat. No. 5,088,640.

It should be appreciated from the foregoing results, particularly as seen in FIGS. 15 and 16, that the plates of the invention exhibit significantly higher rigidity, rim stiffness or both as compared with pressed paperboard plates of the same basis weight having a prior art profile.

EXAMPLES 19, 20

Comparative Examples O,P

Nominally 9" and 10" plates having the configuration of Invention Profile 9 were thermoformed from PPO/HIPS (poly(phenylene)oxide/high impact polystyrene) and compared with like products configured in accordance with the teachings of U.S. Pat. No. 5,088,640. The various products were tested for SSI rigidity and rim stiffness. Results appear in Table 12 below.

TABLE 12

SSI Rigidity and Rim Stiffness Test Results for Thermoformed Plates

| Example | Product | SSI Rigidity (g/0.5 in) | Rim Stiffness (g/0.1 in) |
|---|---|---|---|
| 19 | Invention Profile 9, 9" Nominal Diameter | 282 | 1930 |
| 20 | Invention Profile 9, 10" Nominal Diameter | 239 | 1593 |
| Comparative I | U.S. Pat. No. 5,088,640, 9" Nominal Diameter | 254 | 1280 |
| Comparative J | U.S. Pat. No. 5,088,640, 10" Nominal Diameter | 216 | 1038 |

It is seen from Table 12 that the plates of the invention exhibited both higher rigidity and much higher rim stiffness than 4 radius plates configured as in U.S. Pat. No. 5,088,640. Nominal 9" plates of the '640 patent exhibited a rim stiffness of 1280 grams, whereas a corresponding Invention Profile 9 plate exhibited a rim stiffness of 1930 grams; an increase in rim stiffness of over 50 percent.

Additional Examples/Panel Testing

In some paperboard embodiments of the present invention, for example, in connection with nominal 10" plates it is possible to produce plates in accordance with U.S. Pat. No. 5,088,640 of comparable overall rigidity as compared with corresponding plates of Invention Profile 9. In such instances it has been found that the plates of Invention Profile 9 exhibit much higher rim stiffness. Representative properties appear in Table 13.

TABLE 13

Comparison of Overall Rigidity and Rim Stiffness

| Product | SSI Rigidity (g/0.5 in) | Rim Stiffness (g/0.1 in) |
|---|---|---|
| Invention Profile 9, 10" diameter, 225 lb Basis Weight | 370 | 2450 |
| U.S. Pat. No. 5,088,640, 10" diameter, 225 lb. Basis Weight | 390 | 1200 |
| Invention Profile 9, 10" diameter, 170 lb Basis Weight | 210 | 1300 |
| U.S. Pat. No. 5,088,640, 10" diameter, 170 lb. Basis Weight | 220 | 600 |

The 170 lb basis weight plates of Invention Profile 9 and those of U.S. Pat. Nos. 5,236,020 as well as 5,088,640 were evaluated in expert panel testing for overall performance, sturdiness, being easy to eat from, suitability for use with hot foods, suitability for use with greasy foods, durability through entire meal and ease of holding. The plates were fabricated from the same paperboard and thus differed only as to their configuration. Products were rated in each category on a scale of 1–9; 1 being extremely poor performance and 9 indicating the product performed extremely well. Results are summarized in FIG. 17.

Figure 17:
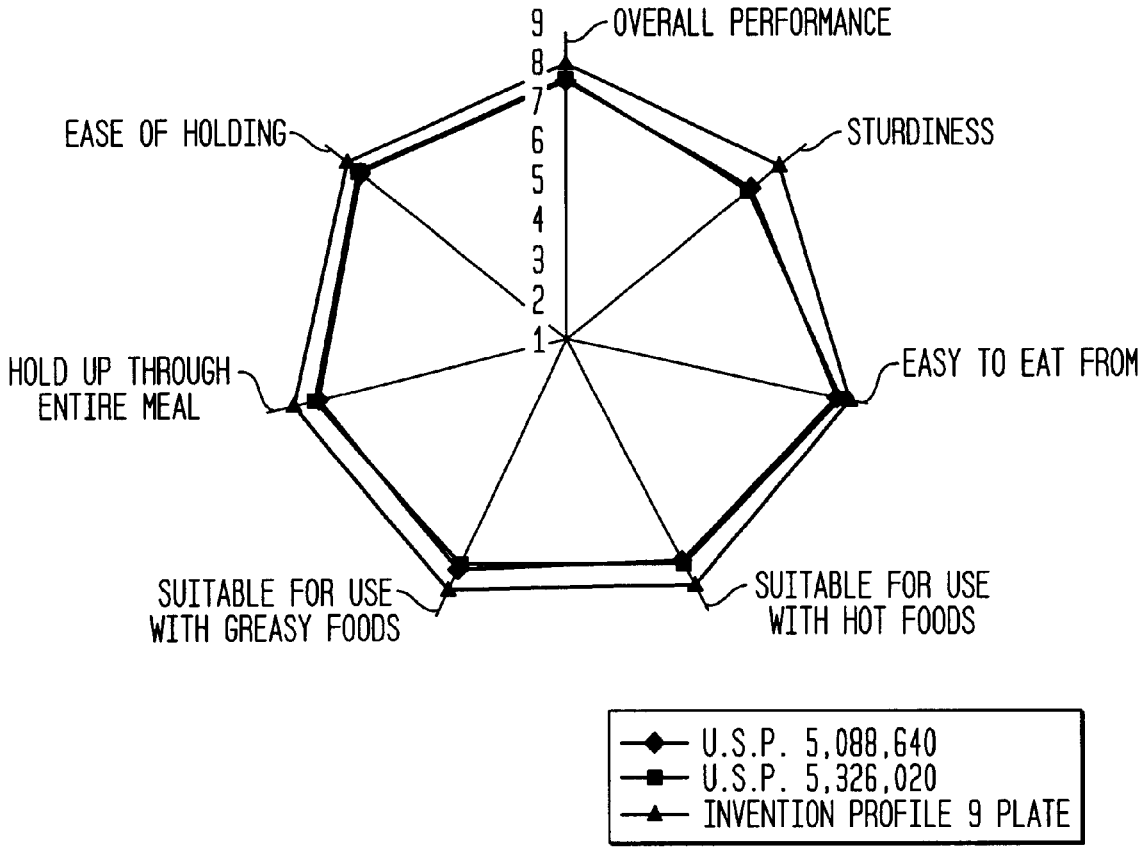
FIG. 17 is a diagram comparing overall performance ratings as well as performance ratings in 6 specific categories of disposable plates of the invention versus plates configured in accordance with U.S. Pat. Nos. 5,088,640 and 5,326,020.

From FIG. 17 it can be seen that the 170 lb basis weight disposable containers of the invention were rated superior in overall performance as well as in every category tested.

Fabrication

Figure 18:
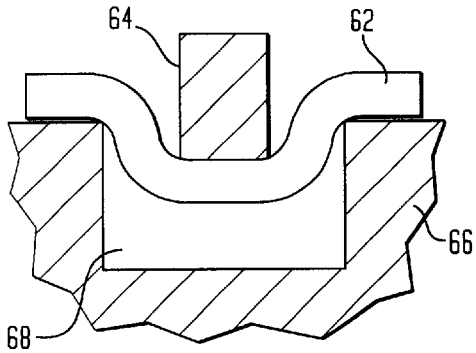
FIGS. 18–20 are diagrams illustrating a preferred mode of paper scoring for scoring paperboard.
Figure 19:
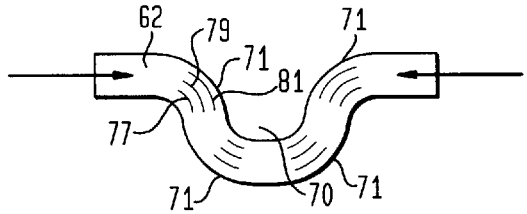
Figure 20:
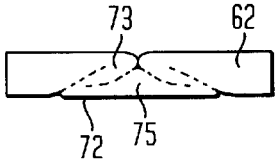

In FIG. 18 there is shown a portion of paperboard stock 62 positioned between a score rule 64 and a scoring counter 66 provided with a channel 68 as would be the case in a scoring press or scoring portion of a pressware forming press. The geometry is such that when the press proceeds reciprocally downwardly and scores blank 62, U-shaped score 70 results. At least incipient delamination of the paperboard into lamellae indicated at 77, 79, 81 is believed to occur in the sharp corner regions indicated at 71 in FIG. 19. The same reciprocal scoring operation could be performed in a separate press operation to create blanks that are fed and formed subsequently. Alternatively, a rotary scoring and blanking operation may be utilized as is known in the art. When the product is formed in a heated matched die set, a U-shaped pleat 72 with a plurality of lamellae of rebonded paperboard along the pleat in the product is formed such that pleats 72 (or 40 as shown in FIG. 1) generally have such configuration. The structure of pleat 72 is preferably as shown schematically in FIG. 20. During the forming process described hereinafter, internal delamination of the paperboard into a plurality of lamellae as a pleat is formed occurs, followed by rebonding of the lamellae under heat and pressure into a substantially integrated fibrous structure generally inseparable into its constituent lamellae. Preferably, the pleat has a thickness generally equal to the circumferentially adjacent areas of the rim and most preferably is more dense than adjacent areas. Integrated structures of rebonded lamellae are indicated schematically at 73, 75 in FIG. 20 on either side of paperboard fold lines in the pleat indicated in dashed lines.

The substantially rebonded portion or portions of the pleats 72 in the finished product preferably extend generally over the entire length (75% or more) of the score which was present in the blank from which the product was made. The rebonded portion of the pleats may extend only over portions of the pleats in an annular region of the periphery of the article in order to impart strength. Such an annular region or regions may extend, for example, around the container extending approximately from the transition of the bottom of the container to the sidewall outwardly to the outer edge of the container, that is, generally along the entire length of the pleats shown in FIGS. 1A–1E. The rebonded structures may extend over an annular region which is less than the entire profile from the bottom of the container to its outer edge. Referring to FIG. 5, for example, an annular region of rebonded structures oriented in a radial direction may extend around the container from inner transition 14 to outermost edge 54. Alternatively, an annular region or regions of such rebonded structures may extend over all or only a portion of length 21 of sidewall 16; over all or part of second annular transition portion 18; over all or part of outer arcuate flange portion 26; over all or part of flange region 34; or combinations thereof. It is preferable that the substantially integrated rebonded fibrous structures formed extend over at least a portion of the length of the pleat, more preferably over at least 50% of the length of the pleat and most preferably over at least 75% of the length of the pleat. Substantially equivalent rebonding can also occur when pleats are formed from unscored paperboard.

At least one of the sidewall portion, the second annular transition portion, the optional inner flange portion and the arcuate outer flange portion and, if present, the optional inner flange portion is provided with a plurality of circumferentially spaced, radially extending regions formed from a plurality of paperboard lamellae rebonded into substantially integrated fibrous structures generally inseparable into their constituent lamellae. The rebonded structures extend around an annular region corresponding to a part of the profile of the sidewall, second annular transition portion, the optional inner flange portion or the arcuate outer flange portion of the container. More preferably, the integrated structures extend over at least part of all of the aforesaid profile regions about the periphery of the container. Still more preferably, the integrated rebonded structures extend generally over the length of the pleats, over at least 75% of their length, for instance; however, so long as a majority of the pleats, more than about 50% for example, include the rebonded structures described herein over at least a portion of their length, a substantial benefit is realized. In some preferred embodiments, the rebonded structures define an annular rebonded array of integrated rebonded structures along the same part of the profile of the container around an annular region of the container. For example, the rebonded structures could extend along the sidewall portion of all of pleats 40 shown in FIGS. 1A–1E along length 21 shown in FIG. 5 to define an annular array around the sidewall portion of the container.

Figure 21:
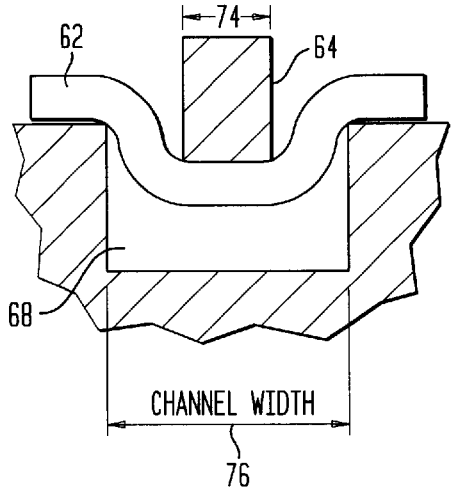
FIG. 21 is a schematic diagram illustrating preferred relative dimensions of a scoring operation showing a single rule, a single paperboard stock and one channel in a scoring press for fabricating scored paperboard blanks used to make the containers of the present invention.

Referring to FIG. 21, rule 64 typically has a width 74 of 0.028 inches, whereas scoring channel 68 has a width 76 equal to the score rule width 74 plus 2 paperboard thicknesses and a clearance which may be 0.005 inches or may be from about 0 to about 0.01 inches. In any event, it is preferred to achieve U-shaped symmetrical geometry and internal fiber delamination in the paperboard prior to cutting the blank into the desired shape. The scores thus formed in the paperboard blank have a width roughly corresponding to the width of the score rule that created them.

The product of the invention is advantageously formed with a heated matched pressware die set utilizing inertial rotating pin blank stops as described in co-pending application U.S. Ser. No. 09/653,577, filed Aug. 31, 2000. For paperboard plate stock of conventional thicknesses in the range of from about 0.010 to about 0.040 inches, the springs upon which the lower die half is mounted are typically constructed such that the full stroke of the upper die results in a force applied between the dies of from about 6000 to 8000 pounds. Similar forming pressures and control thereof may likewise be accomplished using hydraulics as will be appreciated by one of skill in the art. The paperboard which is formed into the blanks is conventionally produced by a wet laid paper making process and is typically available in the form of a continuous web on a roll. The paperboard stock is preferred to have a basis weight in the range of from about 100 pounds to about 400 pounds per 3000 square foot ream and a thickness or caliper in the range of from about 0.010 to about 0.040 inches as noted above. Lower basis weight paperboard is preferred for ease of forming and to save on feedstock costs. Paperboard stock utilized for forming paper plates is typically formed from bleached pulp furnish, and is usually double clay coated on one side. Such paperboard stock commonly has a moisture (water content) varying from about 4.0 to about 8.0 percent by weight.

The effect of the compressive forces at the rim is greatest when the proper moisture conditions are maintained within the paperboard: at least 8% and less than 12% water by weight, and preferably 9.0 to 10.5%. Paperboard having moisture in this range has sufficient moisture to deform under pressure, but not such excessive moisture that water vapor interferes with the forming operation or that the paperboard is too weak to withstand the high compressive forces applied. To achieve the desired moisture levels within the paperboard stock as it comes off the roll, the paperboard is treated by spraying or rolling on a moistening solution, primarily water, although other components such as lubricants may be added. The moisture content may be monitored with an in-line meter or with a hand held capacitive type moisture meter to verify that the desired moisture conditions are being maintained. It is preferred that the plate stock not be formed for at least six hours after moistening to allow the moisture within the paperboard to reach equilibrium.

Because of the intended end use of the products, the paperboard stock is typically impregnated with starch and coated on one side with a liquid proof layer or layers comprising a press-applied, water-based coating applied over the inorganic pigment typically applied to the board during manufacturing. In addition, for esthetic reasons, the paperboard stock is often initially printed before being coated. As an example of typical coating material, a first layer of latex coating may be applied over the printed paperboard with a second layer of acrylic coating applied over the first layer. These coatings may be applied either using the conventional printing press used to apply the decorative printing or may be applied using some other form of a conventional press coater. Preferred coatings utilized in connection with the invention may include 2 pigment (clay) containing layers, with a binder, of 3 lbs/3000 $ft^2$ ream or so followed by 2 acrylic layers of about 0.5–1 lbs/3000 $ft^2$ ream. The layers are applied by press coating methods, i.e., gravure, coil coating, flexographic methods and so forth as opposed to extrusion or film laminating methods which are expensive and may require off-line processing as well as large amounts of coating material. An extruded film, for example, may require 25 lbs/3000 $ft^2$ ream.

Carboxylated styrene-butadiene resins may be used with or without filler if so desired.

A layer comprising a latex may contain any suitable latex known to the art. By way of example, suitable latexes include styrene-acrylic copolymer, acrylonitrile styrene-acrylic copolymer, polyvinyl alcohol polymer, acrylic acid polymer, ethylene vinyl alcohol copolymer, ethylene-vinyl chloride copolymer, ethylene vinyl acetate copolymer, vinyl acetate acrylic copolymer, styrene-butadiene copolymer and acetate ethylene copolymer. Preferably, the layer comprising a latex contains styrene-acrylic copolymer, styrene-butadiene copolymer, or vinyl acetate-acrylic copolymer. More preferably, the layer comprising a latex contains vinyl acetate ethylene copolymer. A commercially available vinyl acetate ethylene copolymer is "AIRFLEX® 100 HS" latex. ("AIRFLEX® 100 HS" is a registered trademark of Air Products and Chemicals, Inc.) Preferably, the layer comprising a latex contains a latex that is pigmented. Pigmenting the latex increases the coat weight of the layer comprising a latex thus reducing runnability problems when using blade cutters to coat the substrate. Pigmenting the latex also improves the resulting quality of print that may be applied to the coated paperboard. Suitable pigments or fillers include kaolin clay, delaminated clays, structured clays, calcined clays, alumina, silica, aluminosilicates, talc, calcium sulfate, ground calcium carbonates, and precipitated calcium carbonates. Other suitable pigments are disclosed, for example, in *Kirk-Othmer, Encyclopedia of Chemical Technology*, Third Edition, Vol. 17, pp. 798, 799, 815, 831–836, which is incorporated herein by reference. Preferably the pigment is selected from the group consisting of kaolin clay and conventional delaminated coating clay. An available delaminated coating clay is "HYDRAPRINT" slurry, supplied as a dispersion with a slurry solids content of about 68%. "HYDRAPRINT" slurry is a trademark of Huber. The layer comprising a latex may also contain other additives that are well known in the art to enhance the properties of coated paperboard. By way of example, suitable additives include dispersants, lubricants, defoamers, film-formers, antifoamers and crosslinkers. By way of example, "DISPEX N-40" is one suitable organic dispersant and comprises a 40% solids dispersion of sodium polycarboxylate. "DISPEX N-40" is a trademark of Allied Colloids. By way of example, "BERCHEM 4095" is one suitable lubricant and comprises 100% active coating lubricant based on modified glycerides. "BERCHEM 4095" is a trademark of Bercap. By way of example, "Foamaster DF-177NS" is one suitable defoamer. "Foamaster DF-122 NS" is a trademark of Henkel. In a preferred embodiment, the coating comprises multiple layers that each comprise a latex.

The stock is moistened on the uncoated side after all of the printing and coating steps have been completed. In a typical forming operation, the web of paperboard stock is fed continuously from a roll through a scoring and cutting die to form the blanks which are scored and cut before being fed into position between the upper and lower die halves. The die halves are heated as described above, to aid in the forming process. It has been found that best results are obtained if the upper die half and lower die half—particularly the surfaces thereof—are maintained at a temperature in the range of from about 250° F. to about 400° F., and most preferably at about 325° F. ±25° F. These die temperatures have been found to facilitate the plastic deformation of paperboard in the rim areas if the paperboard has the preferred moisture levels. At these preferred die temperatures, the amount of heat applied to the blank is sufficient to liberate the moisture within the blank and thereby facilitate the deformation of the fibers without overheating the blank and causing blisters from liberation of steam or scorching the blank material. It is apparent that the amount of heat applied to the paperboard will vary with the amount of time that the dies dwell in a position pressing the paperboard together. The preferred die temperatures are based on the usual dwell times encountered for normal production speeds of 30 to 60 pressings a minute, and commensurately higher or lower temperatures in the dies would generally be required for higher or lower production speeds, respectively.

A die set wherein the upper assembly includes a segmented punch member and is also provided with a contoured upper pressure ring is advantageously employed in carrying out the present invention. Pleating control is achieved by lightly clamping the paperboard blank about a substantial portion of its outer portion as the blank is pulled into the die set and the pleats are formed. It is important during this process to avoid sharp corners about the outer flange because interaction of sharp features of the die with the paperboard blank may result in off-center forming. One such apparatus is illustrated schematically in FIGS. 22–26.

There is shown in schematic profile in FIGS. 22–26 a segmented matched die set 80 including a punch 82 as well as a die 84. Punch 82 is provided with an articulated knock-out 86, a punch forming contour 88, a punch base 90 as well as a pressure ring 92. Optionally, a non-articulated knock-out could be used without a spring pre-load. Non-articulated knock-outs are those which do not extend to the container sidewall forming area. Pressure ring 92 is mounted for reciprocating relative motion with respect to the other portions of the punch and is biased downwardly toward die 84 by way of springs such as spring 94. Spring preload is provided by means of several L-shaped brackets that are attached to the pressure ring around its perimeter and contact milled out regions in the punch base. The pressure ring is provided with a forming contour 95 as shown. Die 84 includes a die knock-out 96 and a die base 100 provided with a die forming contour 98.

Figure 22:
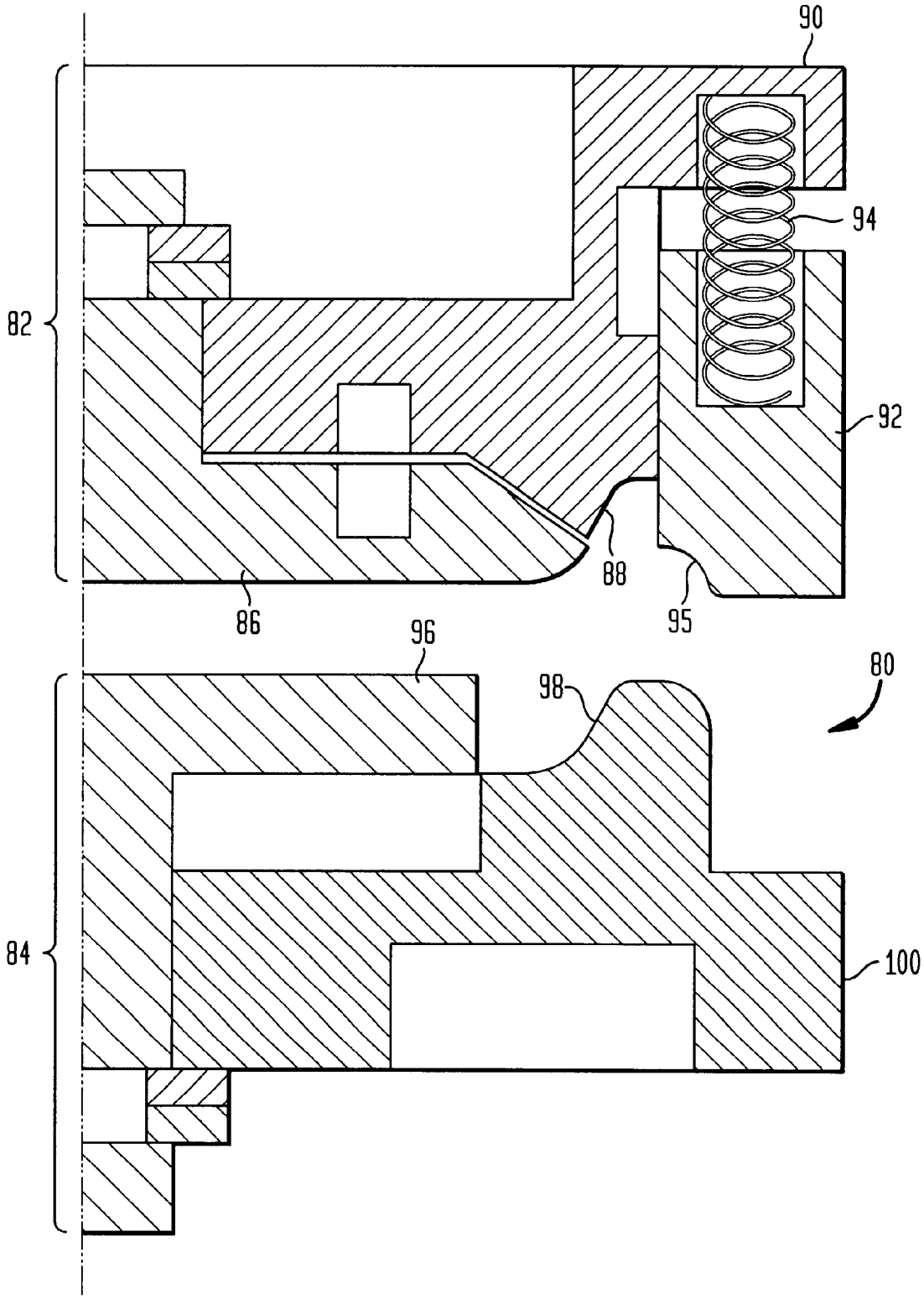
FIGS. 22–26 illustrate the sequential operation of a segmented die set useful for forming containers of the present invention.
Figure 23:
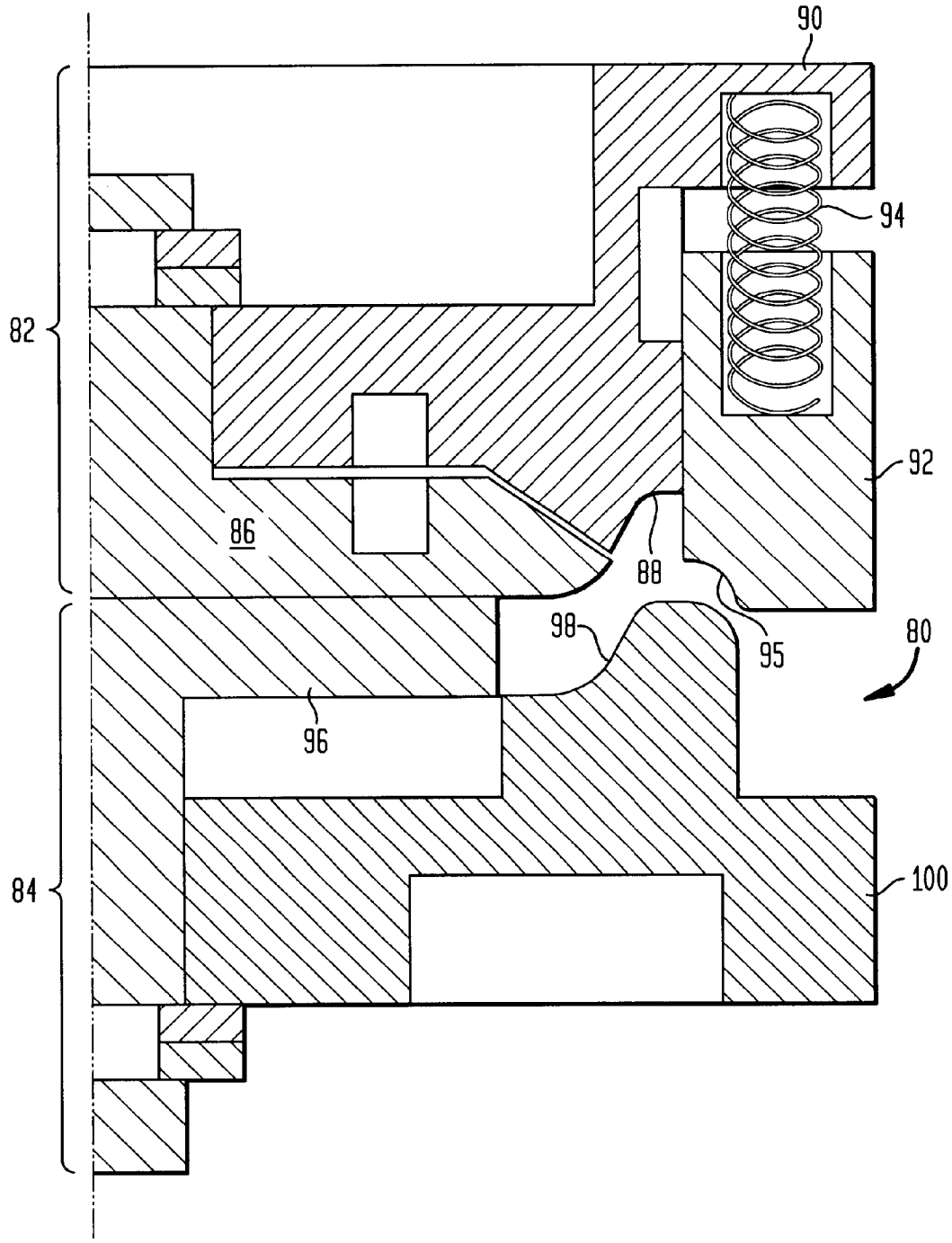
Figure 24:
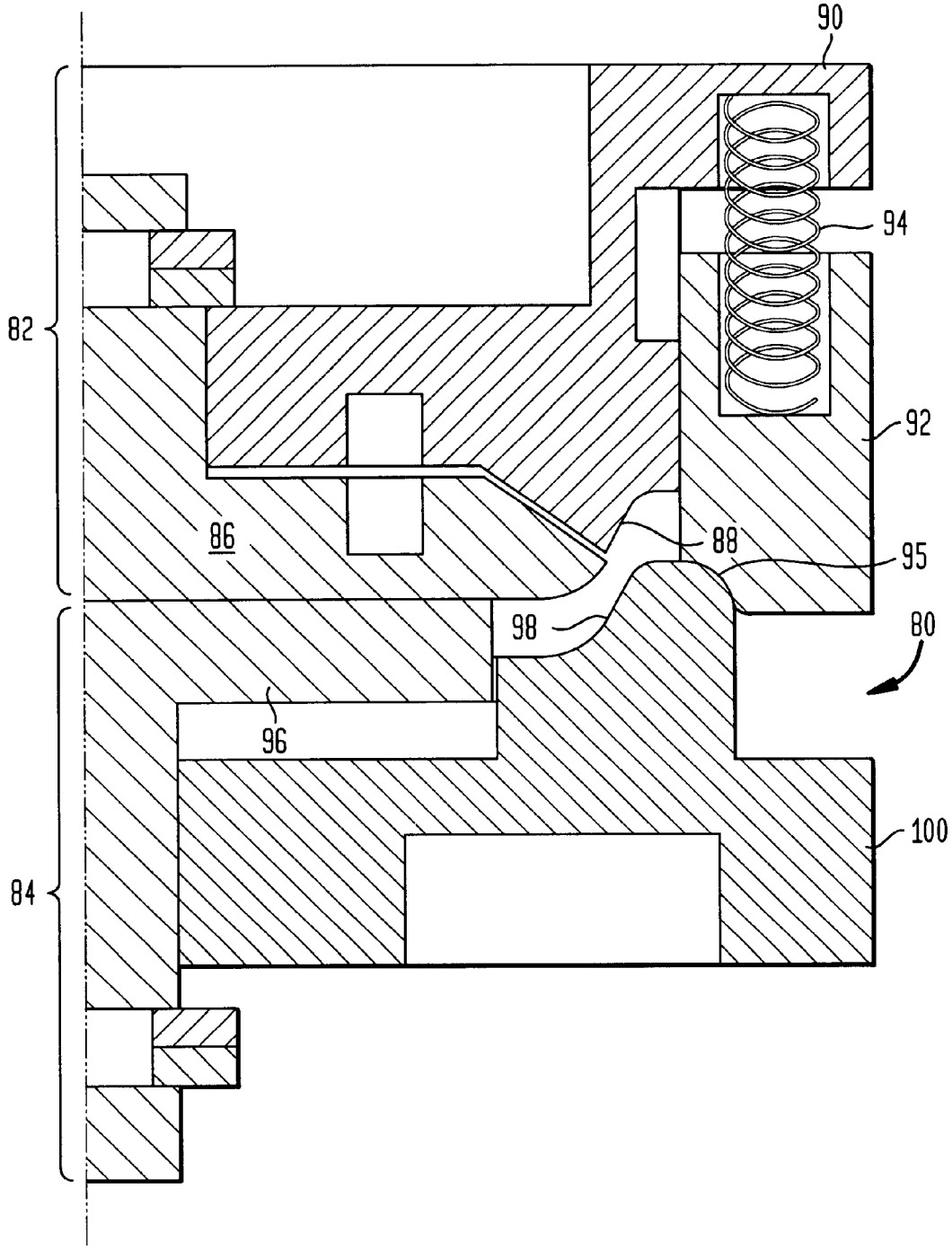
Figure 25:
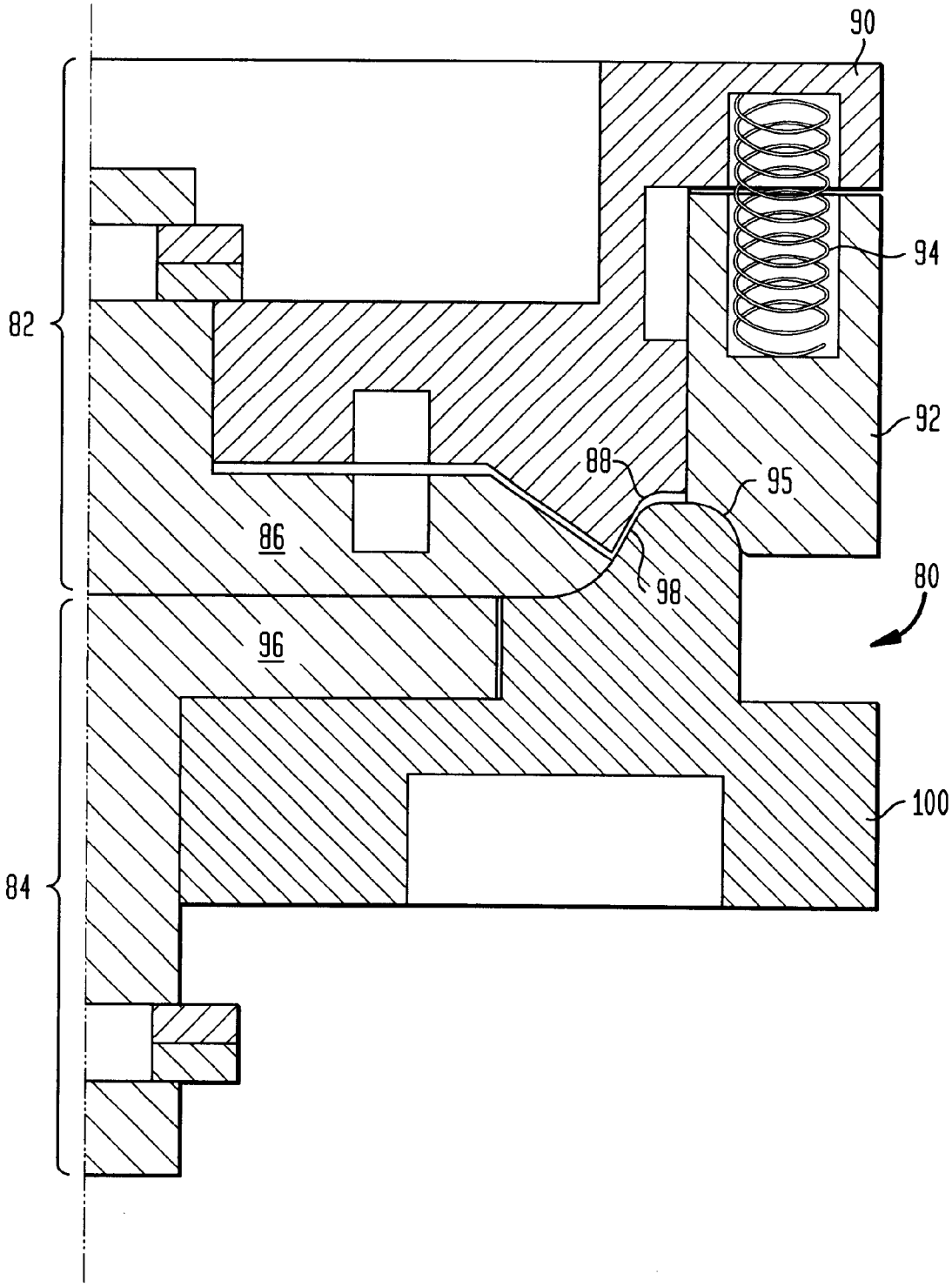
Figure 26:
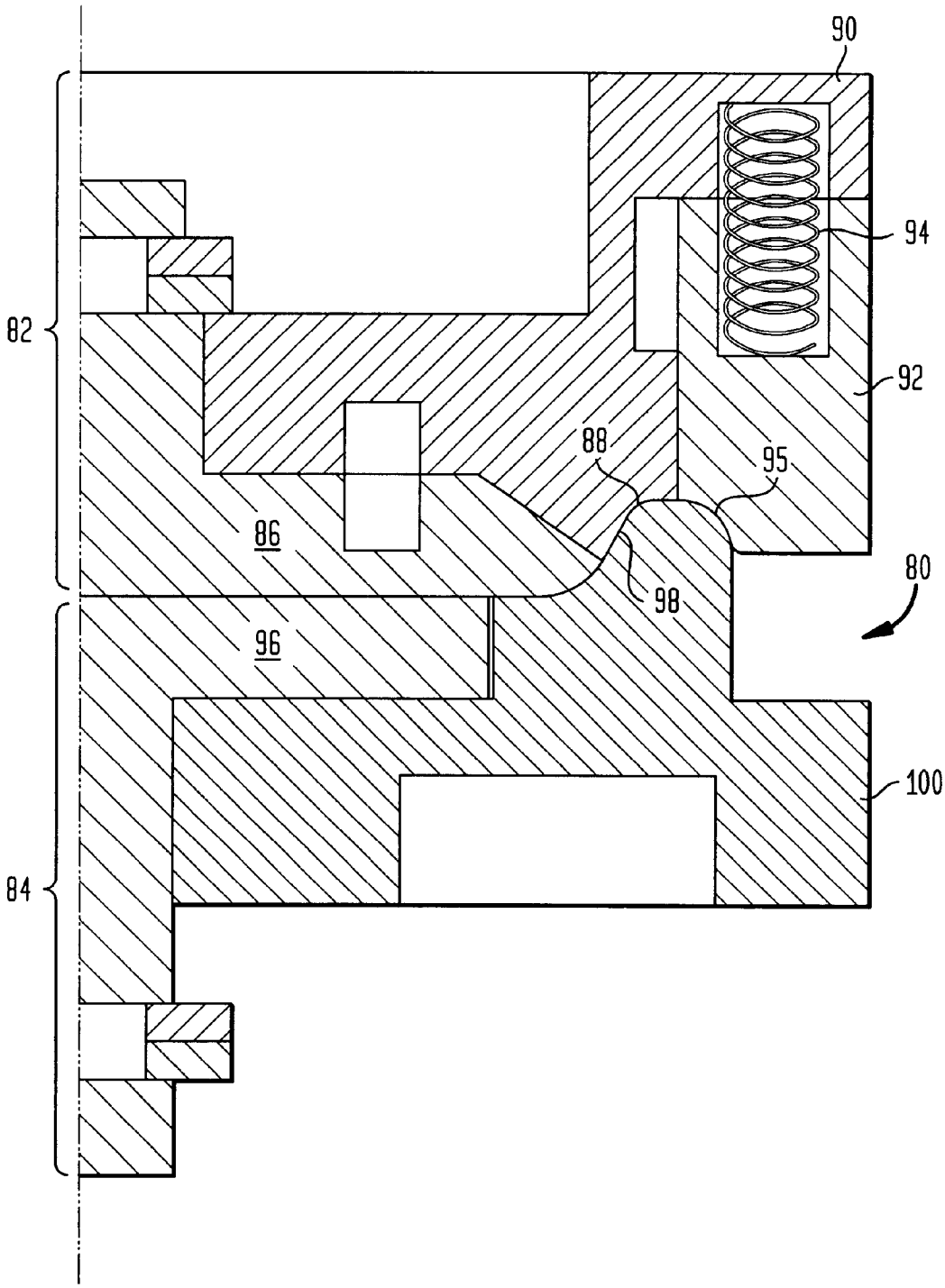

FIGS. 22–26 show sequentially the movement of a die set during forming. In FIG. 22, the die set is fully open as would be the case as a blank is positioned in the die set for forming. In FIG. 23, the die set has advanced such that a blank is gripped between knock-outs 86 and 96. As the process continues as shown in FIG. 24, a blank is clamped lightly between contour 95 of pressure ring 92 and die 84. Thereafter, as shown in FIG. 25, the punch and die continue to advance towards one another as the product is pressed into shape and pleats are formed in the paperboard between the various portions of the die set. Finally, there is shown in FIG. 26 a position where punch 82 and die 84 are fully advanced to conform the blank into the product shape.

On opening, the staging is reversed. Whereas commonly the formed product remains in punch 82, articulated punch knock-out 86 pushes product off of punch forming contour 88 and pressure ring 92 pushes the product out of the punch; preferably with air assist.

Alternative tools suitable for making pressed paperboard disposable containers of the invention include a segmented matched die set with an upper pressure ring having a portion of the product profile and a lower draw ring that are allowed to translate during the formation process as controlled by springs with specified spring rates (lbs/in) deflection and preloads. The rings and springs are chosen so as to allow clamping of the blank against the tooling during the formation process allowing a greater distance and time during the forming operation for pleating control. This technique has been employed for years in connection with containers configured in accordance with U.S. Pat. No. 5,088,640 noted above. The upper pressure ring springs, spring rates and preloads are sized so that the total force to deflect them from their initial preload state is approximately the same or slightly greater than the full deflection force of the opposing draw ring springs, such that the draw ring springs are ideally fully deflected before the pressure ring springs begin to compress. A relief area may exist on the lower draw ring to reduce the initial clamping force on the paper blank.

A die set 110 including both an upper pressure ring and a lower draw ring is illustrated in schematic profile and forming sequence in FIGS. 27–32. Die set 110 includes a punch 112 and a die 114. Punch 112 is provided with an articulated knock-out 116 and defines a punch contour 118. Optionally, a non-articulated knock-out could be used as noted above. There is provided further a punch base 120 as well as a pressure ring 122. Pressure ring 122 is mounted for reciprocating relative motion with respect to the other portions of the punch and is biased downwardly toward die 114 by way of springs such as spring 124. Spring preload is provided by means of several L-shaped brackets that are attached to the pressure ring around its perimeter and contact milled out regions in the punch base. The pressure ring is provided with a forming contour 125. Die 114 includes a die knock-out 126, a die base 130 provided with a forming contour 128. There is additionally a draw ring 132 which is provided with a relieved surface portion 134 as shown in the various figures. Draw ring 132 is mounted for relative reciprocating motion with respect to die base 130 and is upwardly biased by springs such as spring 136. Spring preload is provided by means of several L-shaped brackets that are attached to the draw ring around its perimeter and contact milled out regions in the base.

Die set 110 operates in much the same way as die set 80 except that the draw ring and pressure ring engage the blank early in the forming process, illustrated sequentially in FIGS. 22–27.

Figure 27:
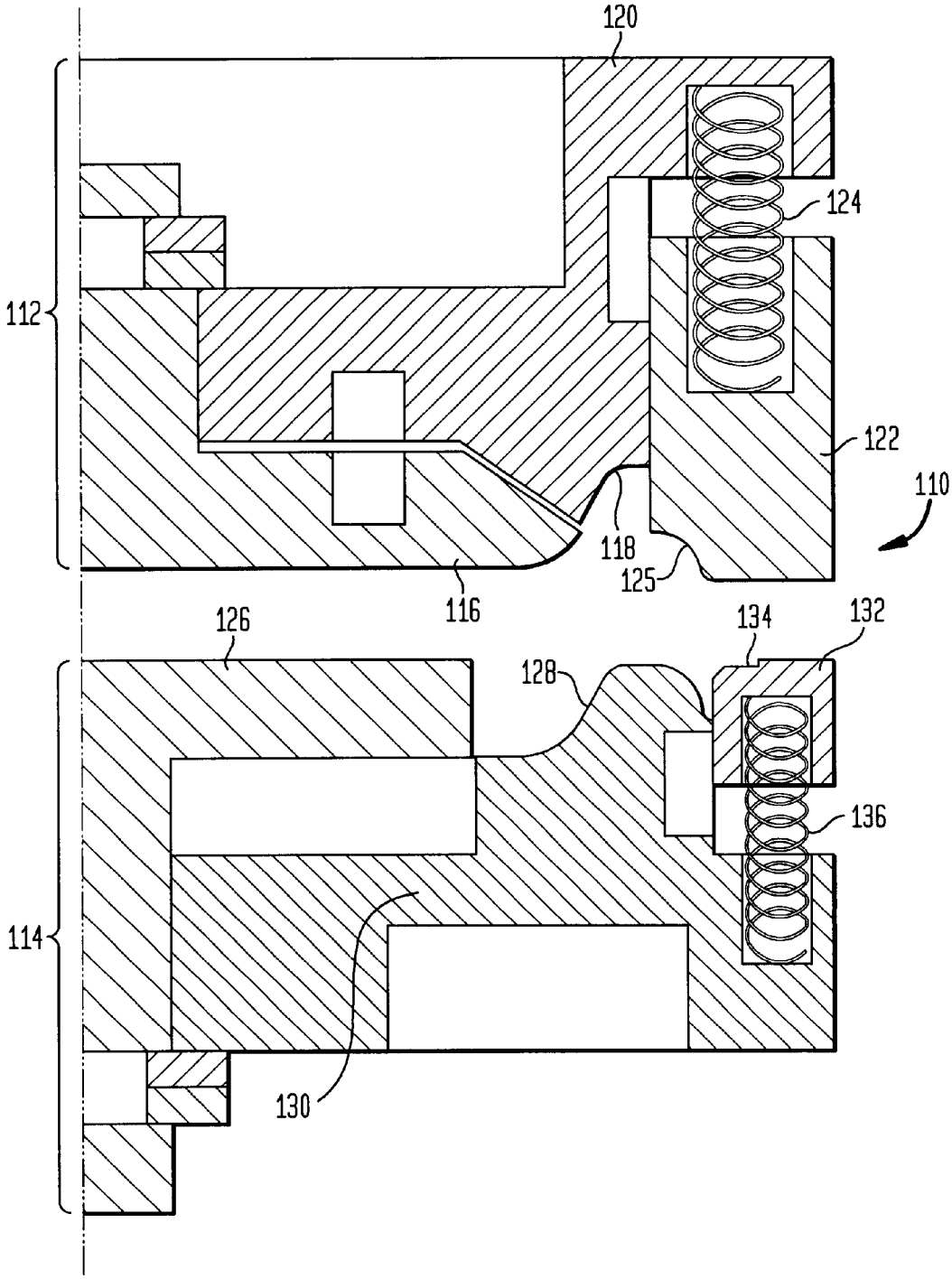
FIGS. 27–32 illustrate the sequential operation of another segmented die set useful for forming containers of the present invention.
Figure 28:
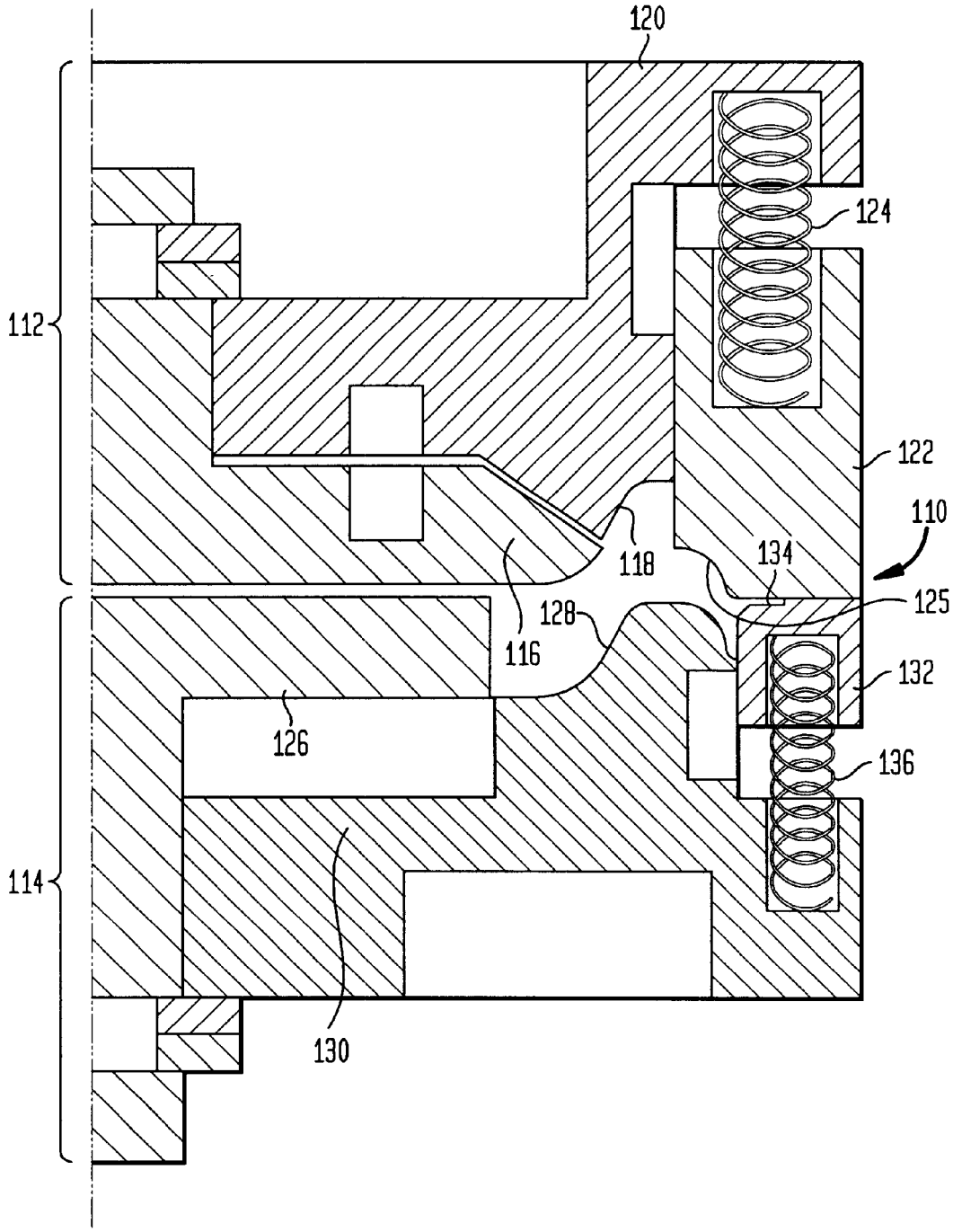
Figure 29:
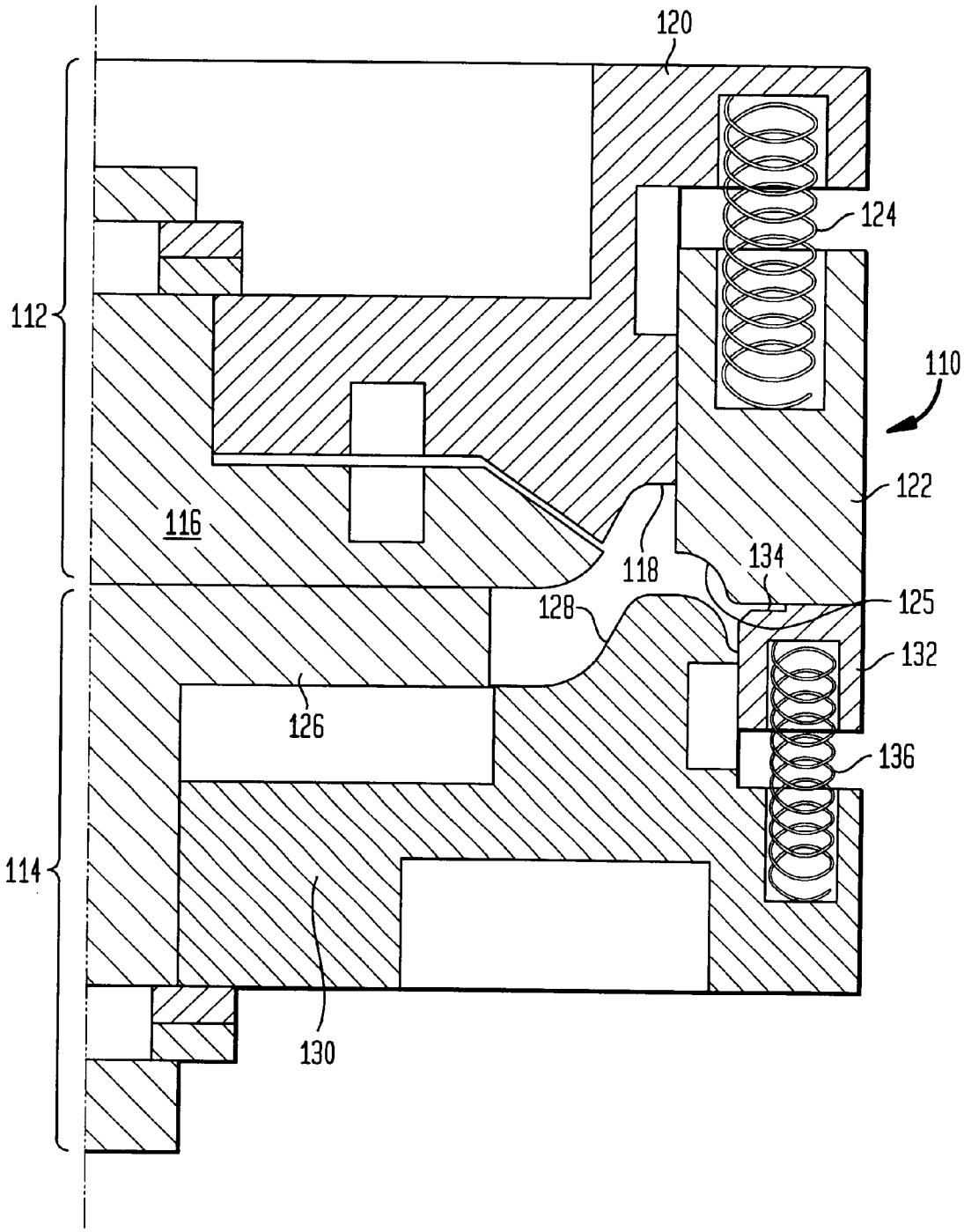
Figure 30:
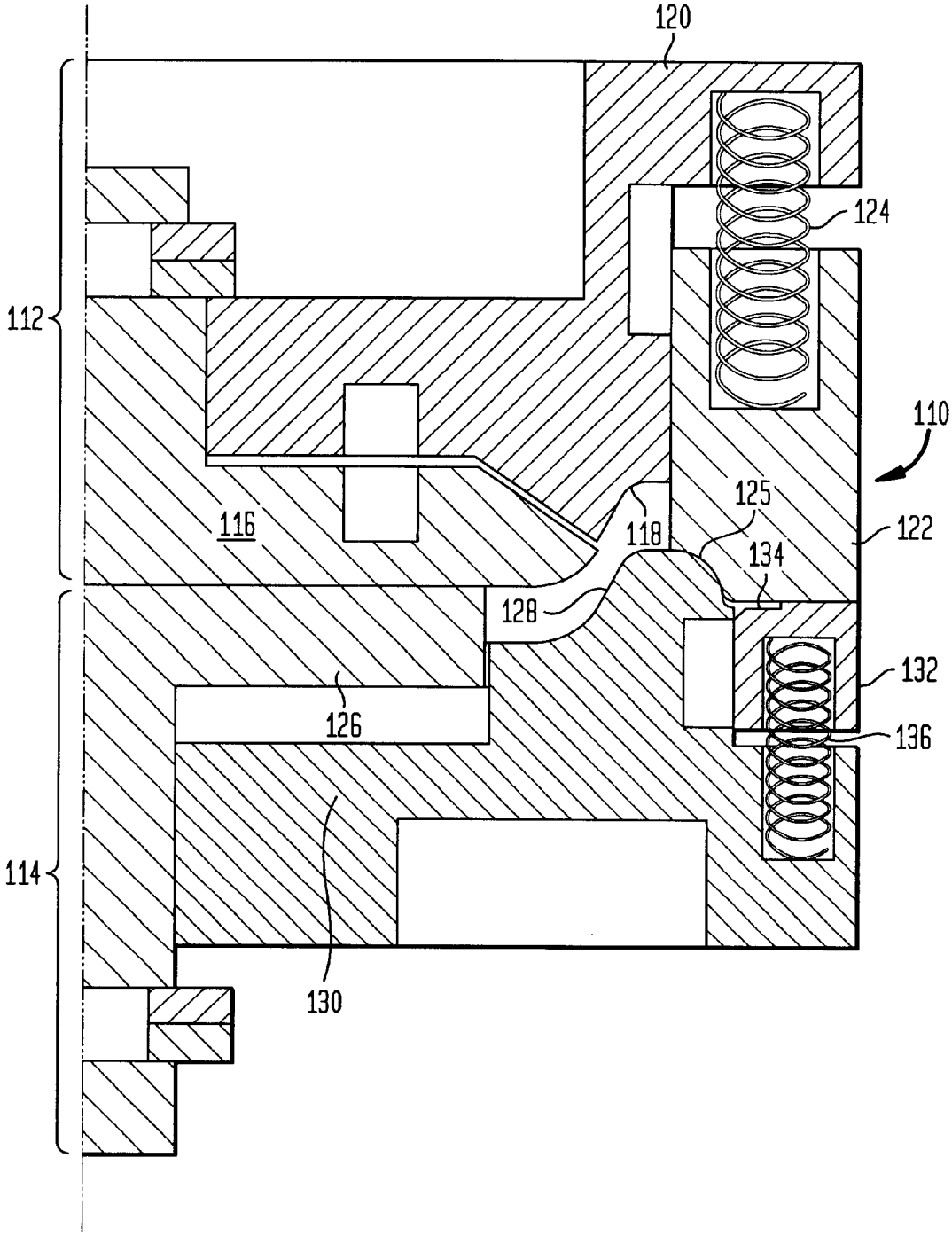
Figure 31:
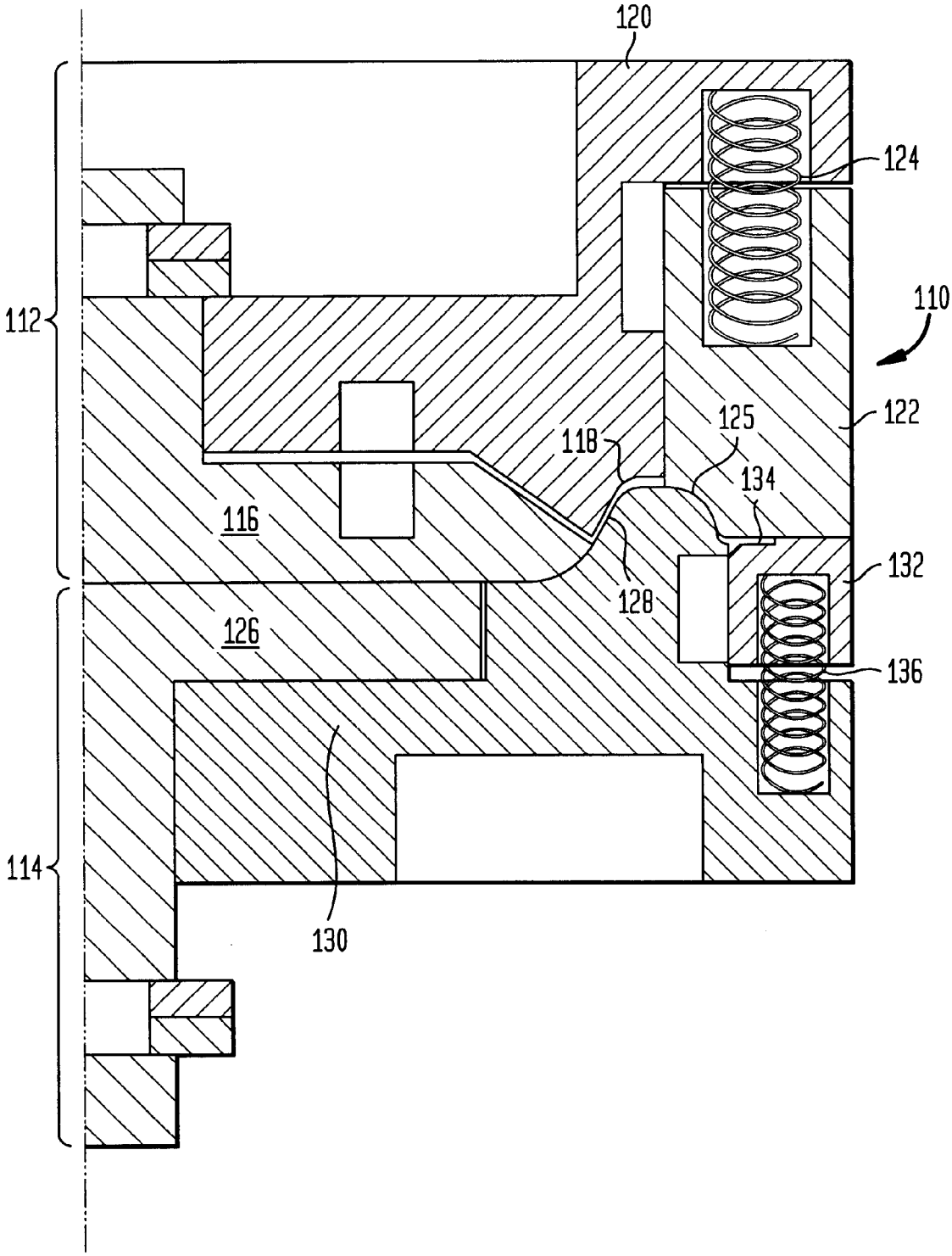
Figure 32:
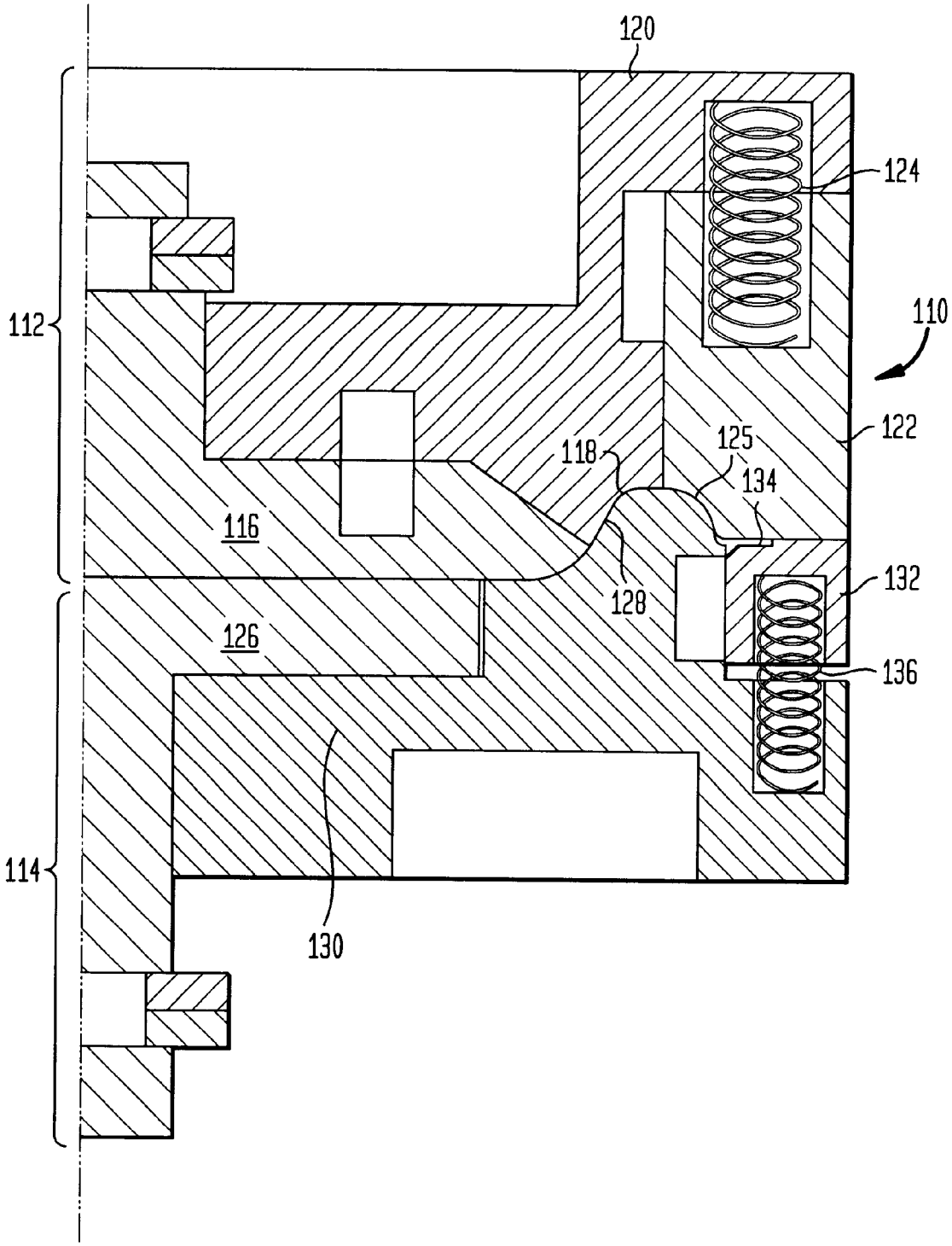

FIG. 27 shows die set 110 in an open position for receiving a blank to be formed. In FIG. 28, the die halves advance and pressure ring 122 and draw ring 132 engage the blank. In FIG. 29, the punch and die further advance so that a blank being formed is gripped between the pressure and draw ring as well as knock-outs 116, 126. In FIG. 30, the blank is clamped lightly between contour 125 of pressure ring 122 and die 114. The process continues as is shown in FIGS. 31 and 32. Upon opening to remove the product, staging is reversed.

Any suitable apparatus and components thereof may be employed in connection with a forming process for a paperboard blank to produce the containers of the present invention.

Draw and/or pressure rings may include one or more of the features: circular or other shape designed to match product shape; external location with respect to the forming die or punch base and die or base contour; stops (rigid or rotating) connected thereto, with an optional adjustment system, to locate the blank prior to formation; cut-out "relief" area that is approximately the same depth as the paperboard caliper to provide a reduced clamp force before pleating starts to occur; this provides initial pleating control before arcuate outer area contacts and provides final pleating control, the draw ring technique is preferred, believed to provide advantages over the no draw ring option; 3 to 4 L-shaped brackets each (stops) are bolted into both the draw and pressure rings around their perimeters and contact milled-out areas in the respective die and punch forming bases or contours to provide the springs with preload distances and forces; typical metal for the draw ring is steel, preferably AISI 1018, typical surface finishes of 125 rms are standard for the draw ring, 63 rms are desired for the horizontal top surface, and inner diameter; a 32 rms finish is desired on the horizontal relief surface; pins and bushings are optionally added to the draw and pressure rings and die and punch bases to minimize rotation of the rings; inner diameter of the pressure ring may be located relatively inwardly at a position generally corresponding to the outer part of the second annular transition of the container or relatively outwardly at a position generally corresponding to the inner part of the arcuate outer flange or at a suitable location therebetween; the draw and pressure ring inner diameters should be slightly larger than the matching bases/contours such as to provide for free movement, but not to allow significant misalignments due to loose tolerencing; 0.005" to 0.010" clearance per side (0.010" to 0.020" across the diameter) is typical;.4 to 8 compression springs each per draw ring and pressure ring typically are used to provide a preload and full load force under pre and full deflections; machined clearance holes for the springs should be chamfered to ensure no binding of the springs during the deflection; the spring diameters, free lengths, manufacturer and spring style can be chosen as desired to obtain the desired draw ring and pressure ring preloads, full load and resulting movements and clamping action; to obtain the desired clamping action the preload of the pressure ring springs (total force) should be slightly greater than the fully compressed load of the draw ring springs (total force); the preload of the draw ring springs should be chosen to provide adequate pleating control while not clamping excessively hard on the blank while in the draw ring relief; for example, (6) draw ring compression springs LC-059G-11 SS (0.48" outside diameter, 0.059" wire diameter, 2.25" free length, spring rate 18 lb/in×0.833 (for stainless steel)=14.99 lb/in, and a solid height of 0.915"); a 0.375" preload on each spring provides a total preload force of (6)×14.99 lb/in×0.375"=33.7 lbs; an additional deflection of the springs of 0.346" or (0.721 " total spring deflection) results in a total full load force of (6)×14.99 lb/in×0.721"=64.8 lbs; (6) pressure ring compression springs LC-080J-10 SS (0.75" outside diameter, 0.080" wire diameter, 3.00" free length, spring rate of 20.23 lb/in×0.833 (for stainless steel)=16.85 lb/in, and a solid height of 1.095"; a 0.835" preload on each spring provides a total preload force of (6)×16.85 lb/in×0.835"=84.4 lbs (greater than draw ring full deflection spring load total force); an additional deflection of the springs of 0.46" (1.295" total spring deflection) results in a total full load force of (6)×16.85 lb/in×1.295"=130.9 lbs; or for example, (4) draw ring compression springs LC-067H-7 SS (0.60" outside diameter, 0.067" wire diameter, 1.75" free length, spring rate 24 lb/in×0.833 (for stainless steel)=19.99 lb/in, and a solid height of 0.705"); a 0.500" preload on each spring provides a total preload force of (4)×19.99 lb/in×0.500"=40.0 lbs; an additional deflection of the springs of 0.40" or (0.90" total spring deflection) results in a total full load force of (4)×19.99 lb/in×0.90"=72.0 lbs; (8) pressure ring compression springs LC-049E-18 SS (0.36" outside diameter, 0.049" wire diameter, 2.75" free length, spring rate of 14 lb/in×0.833 (for stainless steel )=11.66 lb/in, and a solid height of 1.139"; a 1.00" preload on each spring provides a total preload force of (8)×11.66 lb/in×1.00"=93.3 lbs (greater than draw ring fully deflection spring load total force); an additional deflection of the springs of 0.50" (1.500" total spring deflection) results in a total full load force of (8)×11.66 lb/in×1.500"=140 lbs. The springs referred to above are available from Lee Spring Co. Many other suitable components may of course be employed when making the inventive containers from paperboard.

Figure 33:
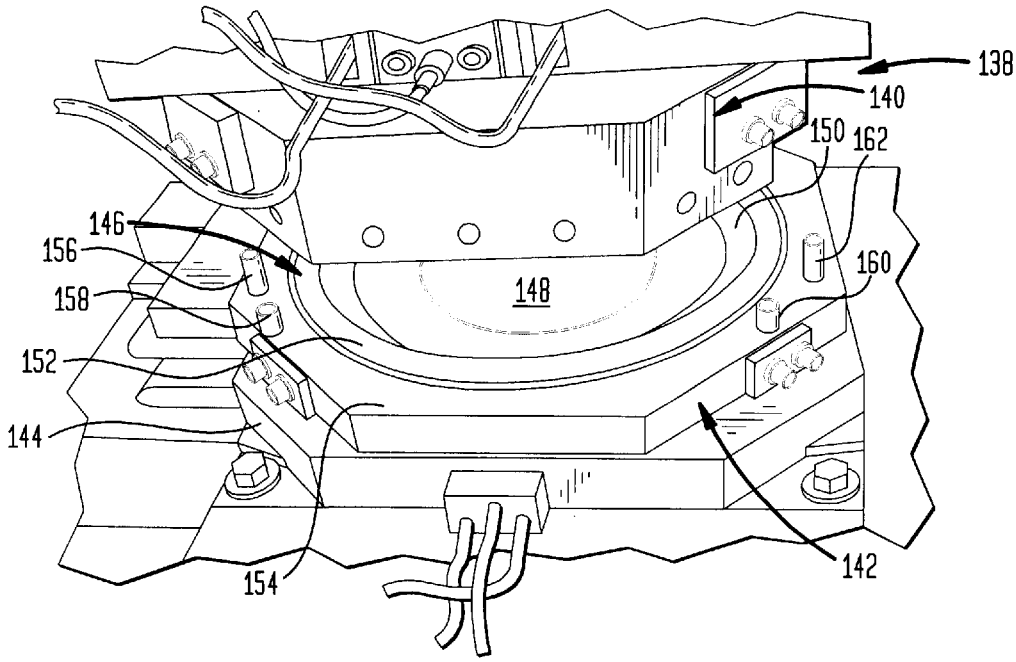
FIG. 33 is a schematic diagram of a matched die set showing a rotating pin blank stop system.
Figure 35:
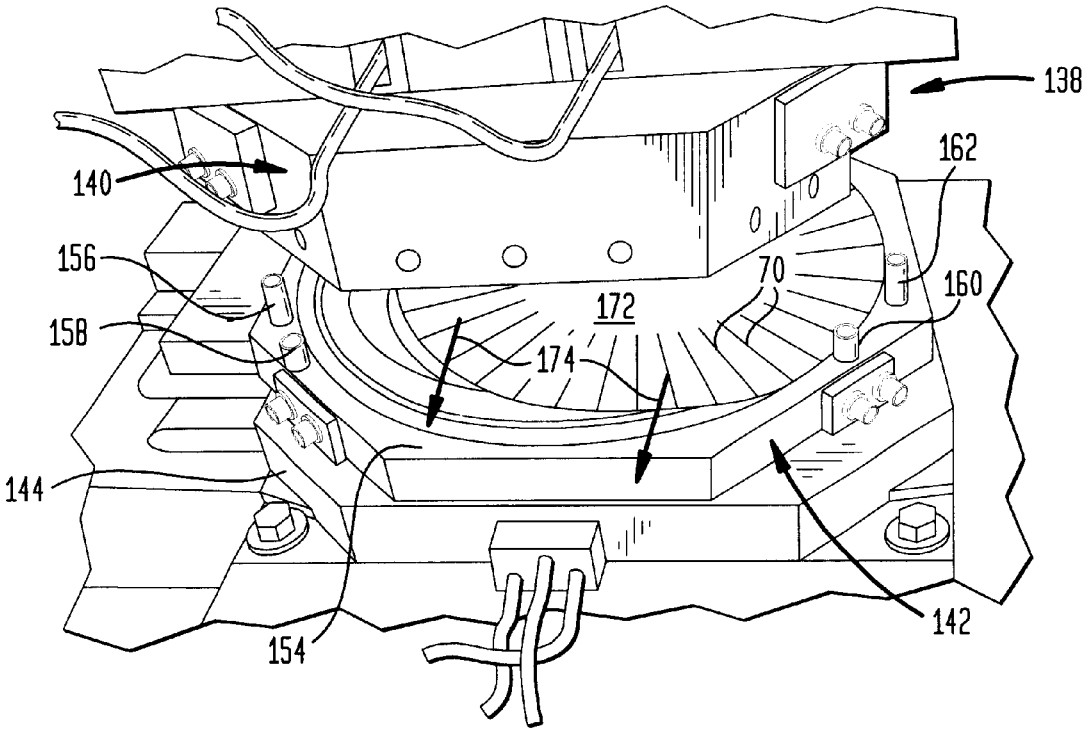
FIG. 35 is a schematic illustration of the apparatus of FIG. 33 showing a scored paperboard blank being supplied to the die set for forming.

As will be appreciated by those skilled in the art, it is important to position the paperboard blank on center during formation, particularly during high speed operation. There is shown in FIGS. 33 and 35 a metal die set 138 including an upper die set assembly 140, commonly referred to as a punch and a lower die set assembly 142 commonly referred to as a die. That is, assembly 142 includes a die base 144, a segmented die member 146 with a knock-out 148, a sidewall forming section 150, a rim forming portion 152 and a draw ring 154. It will be appreciated that metal die set 138 is ordinarily operated in an inclined state in accordance with the following United States Patents, the disclosures of which have been incorporated by reference into this application:

U.S. Pat. No. 5,249,946;

U.S. Pat. No. 4,832,676;

U.S. Pat. No. 4,721,500;

U.S. Pat. No. 4,609,140.

Figure 34:
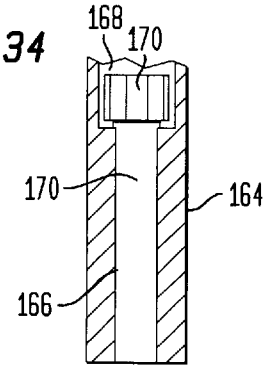
FIG. 34 is a drawing in section of a blank stop and retaining shoulder bolt which can be used in the apparatus of FIG. 33.

An important feature is a plurality of freely rotating stop pins 156, 158, 160 and 162 which may be constructed as shown in FIG. 34. Inner pins 158, 160 are optionally mounted on L-shaped, pivotally mounted plates so that their position may be readily adjusted. Likewise, outer pins 156, 162 may be positioned to act as guides so that a paperboard blank rests exclusively on pins 158, 160 when in proper position for forming. Each pin 156–162 is constructed of steel or other suitable material and includes an elongated shaft 164 as well as a central bore 166. There is additionally provided a "counter bore" cavity 168 for receiving a retaining bolt. Preferably the bolt 170 is recessed within the cavity so that it will not interfere with operation of the apparatus. Bolts, preferably socket head shoulder bolts, are used to secure pins 156–162 to draw ring 154 of segmented die 146 as shown in FIG. 28. The bolts in central bore 166 are close in size to the bore diameter to prevent chatter and horizontal movement of the rotating pin blank stops but enough clearance is preferably allowed so that pins 156–162 are freely rotating about their retaining bolts. If so desired, a slight tension or bias can be provided to damp the motion of rotating pin blank stops 156–162, particularly when very heavy stock is employed in the forming process.

Referring to FIG. 35 there is shown a blank 172 in the process of being supplied to die set 138. Blank 172 is provided with a plurality of scores 70 which are subsequently formed into pleats in the final product. That is to say, paperboard is gathered and pressed into pleats 72 (FIG. 36) about scores 70. Any suitable score pattern may be employed and the pleats preferably are formed with substantially integrated fibrous structures including rebonded lamellae as noted above.

As shown in FIG. 35 it would be appreciated that the rotating pin blank stops 156–162 are located on the forward portion of lower die assembly 142, that is, the downstream production portion of the die, such that a gravity fed blank, such as blank 172, will contact the blank stops as it is fed to the die set. Optionally, the rear, outer pins may be spaced slightly further apart so that they operate as guides and do not contact the blank when it is positioned for forming. It can be seen that blank stops 156 and 162 are in opposing relationship at the periphery of the lower die at a distance which is less than the maximum transverse dimension of the blank, in this case the diameter of blank 172 since it is a circular blank and that pins 158 and 160 are also located in opposing relationship at a distance which is also less than the diameter of the blank inasmuch as the plate will move in the direction indicated generally by arrows 174 in the production process, it is important that the rotating pin blank stops do not interfere with the motion of the finished product.

Figure 36:
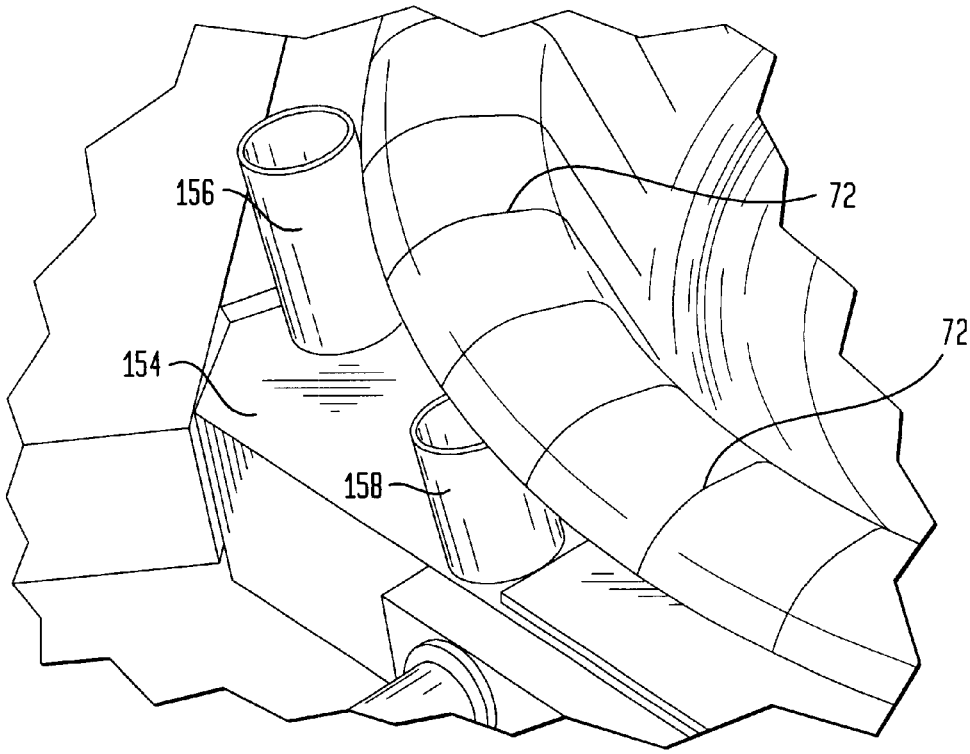
FIG. 36 is a schematic detail of the apparatus of FIG. 33 showing a finished product after forming.

After the blank is positioned, the top assembly 140 is lowered and the forming process is carried out in a conventional manner and the product is formed as shown in FIG. 36. It will be appreciated from FIG. 36 that the distances between the outer pin blank stops 156, 162 is such that the finished product will readily slide between these pins, i.e., the distance is greater than or equal to the diameter of the finished container. It should also be noted that the product will travel over pins 158 and 160 which are typically of the same or lower height than pins 156 and 162 and are closer together than the maximum diameter of the finished container.

The disposable containers of the present invention may be made of multilayer laminates with one or more paperboard layers. Some embodiments may include embossed layers to increase strength and/or insulative properties.

Figure 37:
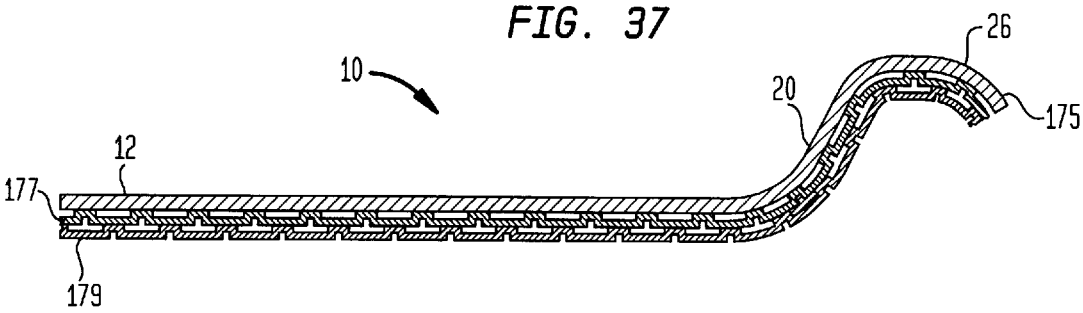
FIG. 37 is a schematic view showing a container of the invention prepared as a paperboard laminate.

Referring now to FIG. 37, there is shown schematically a container 10 of the invention formed from a composite paperboard material wherein the containers are formed by laminating separate layers 175, 177 and 179 to one another in the form of the container having the shape shown in FIG. 1. The particular manipulative steps of forming the plate of FIG. 37 are discussed in greater detail in U.S. Pat. Nos. 6,039,682, 6,186,394 and 6,287,247, the disclosures of which are incorporated herein by reference.

The disposable containers of the present invention may likewise be formed of a thermoplastic material. Suitable forming techniques include injection molding, injection blow molding, injection stretch molding and composite injection molding. Foamed material may be used if so desired. The containers may be thermoformed, thermoformed by the application of vacuum or thermoformed by a combination of vacuum and pressure.

The thermoplastic material may be a foamed or solid polymeric material selected from the group consisting of: polyamides, polyacrylates, polysulfones, polyetherketones, polycarbonates, acrylics, polyphenylene sulfides, acetals, cellulosic polymers, polyetherimides, polyphenylene ethers or oxides, styrene-maleic anhydride copolymers, styrene-acrylonitrile copolymers, polyvinylchlorides and mixtures thereof. A preferred thermoplastic material comprises a foamed or solid polymeric material selected from the group consisting of: polyesters, polystyrenes, polypropylenes, polyethylenes and mixtures thereof. In one embodiment, the container is made from a mineral-filled polypropylene sheet. The article may be made having a wall thickness from about 10 to about 80 mils and consists essentially of from about 40 to about 90 percent by weight of a polypropylene polymer, from about 10 to about 60 percent by weight of a mineral filler, from about 1 to about 15 percent by weight polyethylene, up to about 5 weight percent titanium dioxide and optionally including a basic organic or inorganic compound comprising the reaction product of an alkali metal or alkaline earth element with carbonates, phosphates, carboxylic acids as well as alkali metal and alkaline earth element oxides, hydroxides, or silicates and basic metal oxides, including mixtures of silicon dioxide with one or more of the following oxides: magnesium oxide, calcium oxide, barium oxide, and mixtures thereof.

A preferred wall thickness for plastic containers is from about 10 to about 50 mils; from about 15 to about 25 mils being typical. Mica is often a suitable filler.

Thermoforming is usually a preferred method of making the containers of the present invention from thermoplastic compositions. In the simplest form, thermoforming is the draping of a softened sheet over a shaped mold. In the more advanced form, thermoforming is the automatic high speed positioning of a sheet having an accurately controlled temperature into a pneumatically actuated forming station whereby the article's shape is defined by the mold, followed by trimming and regrind collection as is well known in the art. Still other alternative arrangements include the use of drape, vacuum, pressure, free blowing, matched die, billow drape, vacuum snap-back, billow vacuum, plug assist vacuum, reverse draw with plug assist, pressure bubble immersion, trapped sheet, slip, diaphragm, twin-sheet cut sheet, twin-sheet roll-fed forming or any suitable combinations of the above. Details are provided in J. L. Throne's book, *Thermoforming*, published in 1987 by Coulthard. Pages 21 through 29 of that book are incorporated herein by reference. Suitable alternate arrangements also include a pillow forming technique which creates a positive air pressure between two heat softened sheets to inflate them against a clamped male/female mold system to produce a hollow product. Metal molds are etched with patterns ranging from fine to coarse in order to simulate a natural or grain like texturized look. Suitable formed articles are trimmed in line with a cutting die and regrind is optionally reused since the material is thermoplastic in nature. Other arrangements for productivity enhancements include the simultaneous forming of multiple articles with multiple dies in order to maximize throughput and minimize scrap. The containers of the present invention may be produced utilizing polymeric compositions filled with conventional inorganic fillers such as talc, mica, wollastonite and the like, wherein the polymer component is, for example, a polyester, a polystyrene homopolymer or copolymer, a polyolefin or one or more of the polymers noted above. While any suitable polymer may be used, polypropylene polymers which are suitable are preferably selected from the group consisting of isotactic polypropylene, and copolymers of propylene and ethylene wherein the ethylene moiety is less than about 10% of the units making up the polymer, and mixtures thereof. Generally, such polymers have a melt flow index from about 0.3 to about 4, but most preferably the polymer is isotactic polypropylene with a melt-flow index of about 1.5. In some preferred embodiments, the melt-compounded composition from which the articles are made may include polypropylene and optionally further includes a polyethylene component and titanium dioxide. A polyethylene polymer or component may be any suitable polyethylene such as HDPE, LDPE, MDPE, LLDPE or mixtures thereof and may be melt-blended with polypropylene if so desired.

The various polyethylene polymers referred to herein are described at length in the *Encyclopedia of Polymer Science & Engineering* (2d Ed.), Vol. 6; pp: 383–522, Wiley 1986; the disclosure of which is incorporated herein by reference. HDPE refers to high density polyethylene which is substantially linear and has a density of generally greater that 0.94 up to about 0.97 g/cc. LDPE refers to low density polyethylene which is characterized by relatively long chain branching and a density of about 0.912 to about 0.925 g/cc. LLDPE or linear low density polyethylene is characterized by short chain branching and a density of from about 0.92 to about 0.94 g/cc. Finally, intermediate density polyethylene (MDPE) is characterized by relatively low branching and a density of from about 0.925 to about 0.94 g/cc.

Typically, in filled plastics the primary mineral filler is mica, talc, kaolin, bentonite, wollastonite, milled glass fiber, glass beads (solid or hollow), silica, or silicon carbide whiskers or mixtures thereof. Polypropylene may be melt-compounded with acidic-type minerals such as mica, as well as inorganic materials and/or basic materials such as calcium carbonate, talc, barium sulfate, calcium sulfate, magnesium sulfate, clays, glass, dolomite, alumina, ceramics, silica, pigments such as titanium dioxide based pigments and so on. Many of these materials are enumerated in the *Encyclopedia of Materials Science and Engineering*, Vol. #3, pp. 1745–1759, MIT Press, Cambridge, Mass. (1986), the disclosure of which is incorporated herein by reference. Combinations of fillers are preferred in some embodiments.

The invention has been described in detail hereinabove in connection with numerous embodiments which is not intended to limit in any way the scope of the present invention which is defined in the appended claims. It will be readily appreciated by one of skill in the art that the particular embodiments illustrated may be scaled up or down in size with the relative proportions shown herein or that product shapes such as square or rectangular with rounded corners, triangular, multi-sided, oval platters, polygonal platters with rounded corners and so forth may be formed in accordance with the present invention. Typical products include plates, bowls, trays, deep dish containers, platters and so forth. In cases where the product shape is not round, scaling may be based upon an average of major dimensions across the article thereof instead of based on the product diameter.

What is claimed is:

1. A disposable food container configured for rigidity and rim stiffness having a characteristic diameter comprising:

a generally planar bottom portion;

a first annular transition portion extending upwardly and outwardly from said generally planar bottom portion;

a sidewall portion extending upwardly and outwardly from said first annular transition portion;

a second annular transition portion extending outwardly from said sidewall portion;

said sidewall portion defining a generally linear, inclined sidewall profile over a length between said first annular transition portion and said second annular transition portion having an angle of inclination with respect to the vertical from said generally planar bottom portion; and an arcuate outer flange portion having a convex upper surface extending outwardly with respect to said second annular transition portion, the radius of curvature of said arcuate outer flange portion being between about 0.0175 and about 0.1 times the characteristic diameter of said disposable food container;

and an inner flange portion extending between said second annular transition portion and said arcuate outer flange portion having a ratio of a radial span to the characteristic diameter of from about 0 to about 0.1, said disposable food container being further characterized by a flange outer vertical drop wherein the ratio of the length of the flange outer vertical drop to the characteristic diameter of the container is greater than about 0.01.

2. The disposable food container according to claim 1, wherein said inclined sidewall profile has an angle of inclination with respect to the vertical from said generally planar bottom portion of from about 10° to about 50°.

3. The disposable food container according to claim 2, wherein said inclined sidewall profile has an angle of inclination with respect to the vertical from said generally planar bottom portion of from about 10° to about 40°.

4. The disposable food container according to claim 1, wherein the ratio of the length of the flange outer vertical drop to the characteristic diameter of the container is greater than about 0.013.

5. The disposable food container according to claim 4, wherein the ratio of the length of the flange outer vertical drop to the characteristic diameter of the container is greater than about 0.015.

6. The disposable food container according to claim 1, wherein the ratio of the radius of curvature of said arcuate outer flange portion to the characteristic diameter of said food container is greater than about 0.025.

7. The disposable food container according to claim 6, wherein the ratio of the radius of curvature of said arcuate outer flange portion to the characteristic diameter of said disposable food container is from about 0.035 to about 0.07.

8. The disposable food container according to claim 1, wherein the ratio of the length of the generally linear inclined sidewall profile to the characteristic diameter of the disposable food container is greater than about 0.025.

9. The disposable food container according to claim 8, wherein the ratio of the length of the generally linear inclined sidewall profile to the characteristic diameter of the disposable food container is greater than about 0.03.

10. The disposable food container according to claim 1, wherein said arcuate outer flange portion is characterized by having a single radius of curvature.

11. The disposable food container according to claim 1, wherein the outer periphery of the profile of said container terminates with an outer edge of said arcuate outer flange portion.

12. A disposable food container configured for rigidity and rim stiffness having a characteristic diameter comprising:

a generally planar bottom portion;

a first annular transition portion extending upwardly and outwardly from said generally planar bottom portion;

a sidewall portion extending upwardly and outwardly from said first annular transition portion;

a second annular transition portion extending outwardly from said sidewall portion, said sidewall portion defining a generally linear, inclined sidewall profile over a length between said first annular transition portion and said second annular transition portion, and having an angle of inclination of from about 10 degrees to about 50 degrees with respect to the vertical from said generally planar bottom portion wherein the ratio of the length of the generally linear inclined profile to the characteristic diameter of the disposable food container is greater than about 0.025; and an arcuate outer flange portion having a convex upper surface extending outwardly with respect to said second annular transition portion, the radius of curvature of said arcuate outer flange portion being between about 0.035 and about 0.07 times the characteristic diameter of said disposable food container; and an inner flange portion extending between said second annular transition portion and said arcuate outer flange portion having a ratio of a radial span to the characteristic diameter of from about 0 to about 0.1, said disposable food container being further characterized by an flange outer vertical drop wherein the ratio of the length of the flange outer vertical drop to the characteristic diameter of the container is greater than about 0.013.

13. The disposable food container according to claim 12 wherein the ratio of the length of the flange outer vertical drop to the characteristic diameter of the container is greater than about 0.015.

14. The disposable food container according to claim 13, wherein the ratio of the length of the flange outer vertical drop to the characteristic diameter of the container is greater than about 0.0175.

15. The disposable food container according to claim 12, wherein the ratio of the length of the generally linear inclined sidewall profile to the characteristic diameter of the disposable article is greater than about 0.03.

16. The disposable food container according to 12, wherein the ratio of the radius of curvature of said arcuate outer flange portion to the characteristic diameter of said disposable food container is from about 0.035 to about 0.06.

17. The disposable food container according to 16, wherein the ratio of the radius of curvature of said arcuate outer flange portion to the characteristic diameter of said disposable food container is from about 0.04 to about 0.055.

18. The disposable food container according to claim 12, wherein the generally linear, inclined sidewall profile between said first annular transition portion and said second annular transition portion has an angle of inclination of from about 15° to about 40° with respect to the vertical from said generally planar bottom portion.

19. The disposable food container according to claim 18, wherein the generally linear, inclined sidewall profile between said first annular transition portion and said second annular transition portion has an angle of inclination of from about 25° to about 35° with respect to the vertical from said generally planar bottom portion.

20. The disposable food container according to claim 12, wherein said convex upper surface of the arcuate outer flange portion is configured so that it defines its radius of curvature over an included angle of from about 30° to about 80°.

21. The disposable food container according to claim 20, wherein said convex upper surface of said arcuate outer flange portion is configured so that it defines its radius of curvature over an included angle of from about 50° to about 75°.

22. The disposable food container according to claim 21, wherein the convex upper surface of the arcuate outer flange portion is configured so that it defines its radius of curvature over an included angle of from about 55° to about 65°.

23. The disposable food container according to claim 12, wherein said first annular transition portion defines an upwardly concave upper surface defining an inner radius of curvature, wherein the ratio of said inner radius of curvature to the characteristic diameter of said disposable food container is from about 0.014 to about 0.14.

24. The disposable food container according to claim 23, wherein the ratio of the inner radius of curvature to the characteristic diameter of the disposable food container is from about 0.035 to about 0.07.

25. The disposable food container according to claim 12, wherein the ratio of the length of the generally linear inclined sidewall profile to the characteristic diameter of the disposable food container is from about 0.025 to about 0.06.

26. The disposable food container according to claim 12, wherein said food container is a plate or a deep dish container and wherein the ratio of the length of the generally linear inclined sidewall profile to the characteristic diameter of the food container is from about 0.025 to about 0.15.

27. The disposable food container according to claim 12, wherein said food container is a bowl and wherein the ratio of the length of the generally linear inclined sidewall profile to the characteristic diameter of the food container is from about 0.1 to about 0.3.

28. The disposable bowl according to claim 27, wherein the ratio of the length of the generally linear inclined sidewall profile to the characteristic diameter of the food container is from about 0.15 to about 0.25.

29. The disposable food container according to claim 12, wherein said second annular transition portion defines a convex upper surface defining an intermediate radius of curvature, wherein the ratio of said intermediate radius of curvature to the characteristic diameter of said disposable food container is from about 0.014 to about 0.07.

30. The disposable food container according to claim 12, wherein the ratio of the height of said container to said characteristic diameter is from about 0.06 to about 0.3.

31. The disposable food container according to claim 30, wherein said container is a plate and wherein the ratio of the height of said container to the characteristic diameter is from about 0.06 to about 0.12.

32. The disposable food container according to claim 30, wherein said container is a bowl or deep dish container and wherein the ratio of the height of said container to the characteristic diameter is from about 0.1 to about 0.3.

33. The disposable food container according to claim 12, including an inner flange portion extending between said second annular transition portion and said arcuate outer flange portion over a radial span, wherein the ratio of said radial span to the characteristic diameter of said food container is from about 0.01 to about 0.09.

34. The disposable food container according to claim 12 formed of paper.

35. The disposable food container according to claim 34, press-formed from a paperboard blank.

36. The disposable food container according to claim 35, wherein at least one surface of said paperboard blank is provided with a substantially liquid-impervious coating comprising an inorganic pigment or filler and a water-based, press applied overcoat.

37. The disposable food container according to claim 35, wherein at least one surface of said paperboard blank is provided with a styrene-butadiene polymer coating.

38. The disposable food container according to claim 37, wherein styrene-butadiene polymer is a carboxylated styrene-butadiene polymer.

39. The disposable food container according to claim 12, formed of a thermoplastic composition.

40. The disposable food container according to claim 39, fabricated from a thermoplastic material by way of a technique selected from the group consisting of injection molding, injection blow molding, injection stretch blow molding and composite injection molding.

41. The disposable food container according to claim 39, formed from a foamed polymeric material.

42. The disposable food container according to claim 39, formed from sheet stock of thermoplastic material.

43. The disposable food container according to claim 39, thermoformed, thermoformed by the application of vacuum or thermoformed by a combination of vacuum and pressure.

44. The disposable food container according to claim 43, thermoformed by the application of vacuum.

45. The disposable food container according to claim 42, wherein said thermoplastic material is a foamed or solid polymeric material selected from the group consisting of: polyamides, polyacrylates, polysulfones, polyetherketones, polycarbonates, acrylics, polyphenylene sulfides, acetals, cellulosic polymers, polyetherimides, polyphenylene ethers or oxides, styrene-maleic anhydride copolymers, styrene-acrylonitrile copolymers, polyvinylchlorides and mixtures thereof.

46. The disposable food container of claim 42, wherein said thermoplastic material comprises a foamed or solid polymeric material selected from the group consisting of: polyesters, polystyrenes, polypropylenes, polyethylenes and mixtures thereof.

47. The disposable food container according to claim 46, thermoformed from mineral-filled polypropylene sheet stock.

48. The disposable food container according to claim 47, wherein said mineral filler is predominantly mica.

49. The disposable food container according to claim 47, having a wall thickness from about 10 to about 80 mils and consisting essentially of from about 40 to about 90 percent by weight of a polypropylene polymer, from about 10 to about 60 percent by weight of a mineral filler, from about 1 to about 15 percent by weight polyethylene, up to about 5 weight percent titanium dioxide and optionally including a basic organic or basic inorganic compound comprising the reaction product of an alkali metal or alkaline earth element with carbonates, phosphates, carboxylic acids as well as alkali metal and alkaline earth element oxides, hydroxides, or silicates and basic metal oxides, including mixtures of silicon dioxide with one or more of the following oxides: magnesium oxide, calcium oxide, barium oxide, and mixtures thereof.

50. The disposable food container according to claim 39, having a wall caliper of from about 10 to about 50 mils.

51. The disposable food container according to claim 50, having a wall caliper of from about 15 to about 25 mils.

52. The disposable food container according to claim 39, formed of a styrene polymer composition.

53. The disposable food container according to claim 52, formed of polystyrene.

54. The disposable food container according to claim 39, formed from a mineral-filled thermoplastic composition.

55. A disposable food container press-formed from a generally planar paperboard blank and being configured for rigidity and rim stiffness having a characteristic diameter comprising:

a generally planar bottom portion;

a first annular transition portion extending upwardly and outwardly from said generally planar bottom portion;

a sidewall portion extending upwardly and outwardly from said first annular transition portion;

a second annular transition portion extending outwardly from said sidewall portion, said sidewall portion defining a generally linear, inclined sidewall profile over a length between said first annular transition portion and said second annular transition portion, and having an angle of inclination with respect to the vertical from said generally planar bottom portion; and an arcuate outer flange portion having a convex upper surface extending outwardly with respect to said second annular transition portion, the radius of curvature of said arcuate outer flange portion being between about 0.0175 and about 0.1 times the characteristic diameter of said disposable food container;

and an inner flange portion extending between said second annular transition portion and said arcuate outer flange portion having a ratio of a radial span to the characteristic diameter of from about 0 to about 0.1, said disposable food container being further characterized by a flange outer vertical drop wherein the ratio of the length of the flange outer vertical drop to the characteristic diameter of the container is greater than about 0.01;

wherein at least one of the sidewall portion, the second annular transition portion, the arcuate outer flange portion and, if present, the optional inner flange portion is provided with a plurality of circumferentially spaced, radially extending regions formed from a plurality of paperboard lamellae rebonded into substantially integrated fibrous structures generally inseparable into their constituent lamellae.

56. The disposable food container according to claim 55, wherein the plurality of circumferentially spaced, radially extending regions formed from a plurality of to paperboard lamellae rebonded into substantially integrated fibrous structures generally inseparable into their constituent lamellae extend around an annular region corresponding to at least part of the profile of the sidewall portion of the container.

57. The disposable food container according to claim 55, wherein the plurality of circumferentially spaced, radially extending regions formed from a plurality of paperboard lamellae rebonded into substantially integrated fibrous structures generally inseparable into their constituent lamellae extend around an annular region corresponding to at least part of the profile of the second annular transition portion of the container.

58. The disposable food container according to claim 55, wherein the plurality of circumferentially spaced, radially extending regions formed from a plurality of paperboard lamellae rebonded into substantially integrated fibrous structures generally inseparable into their constituent lamellae extend around an annular region corresponding to at least part of the profile of the arcuate outer flange portion of the container.

59. The disposable food container according to claim 55, having an inner flange portion between the second annular transition portion and the outer arcuate flange portion wherein the plurality of circumferentially spaced, radially extending regions formed from a plurality of paperboard lamellae rebonded into substantially integrated fibrous structures generally inseparable into their constituent lamellae extend around an annular region corresponding to at least part of the profile of the inner flange portion of the container.

60. The disposable food container according to claim 55, wherein the sidewall portion, the second annular transition portion, the arcuate outer flange portion and, if present, the optional inner flange portion all include a plurality of circumferentially spaced, radially extending regions formed from a plurality of paperboard lamellae rebonded into substantially integrated fibrous structures generally inseparable into their constituent lamellae extending around an annular region corresponding to at least a part of the respective profile of the sidewall portion, the second annular transition portion, the arcuate outer flange portion and, if present, the optional inner flange portion of the container.

61. The disposable food container according to claim 55, having a plurality of circumferentially spaced, radially extending pleats disposed in an annular arrangement which pleats include a substantially integrated fibrous structure formed from a plurality of rebonded paperboard lamellae generally extending over the length of the pleat.

62. The disposable food container according to claim 55, provided with a plurality of circumferentially spaced, radially extending pleats the majority of which include a substantially integrated fibrous structure formed from a plurality of rebonded paperboard lamellae extending over at least a portion of their length.

63. The disposable food container according to claim 62, wherein the plurality of substantially integrated fibrous structures formed from rebonded paperboard define an annular rebonded paperboard array extending radially in an annular region corresponding to at least a part of the profile of the sidewall portion, the second annular transition portion, the outer arcuate flange portion or the optional inner flange portion of the container.

64. The disposable food container according to claim 55, wherein said circumferentially spaced, radially extending regions formed from a plurality of paperboard lamellae rebonded into substantially integrated fibrous structures generally inseparable into their constituent layers are of generally the same thickness as adjacent areas of the food container.

65. The disposable food container according to claim 55, wherein said inclined sidewall profile has an angle of inclination with respect to the vertical from said generally planar bottom portion of from about 10° to about 50°.

66. The disposable food container according to claim 65, wherein said inclined sidewall profile has an angle of inclination with respect to the vertical from said generally planar bottom portion of from about 10° to about 40°.

67. The disposable food container according to claim 55, wherein the ratio of the length of the flange outer vertical drop to the characteristic diameter of the container is greater than about 0.013.

68. The disposable food container according to claim 67, wherein the ratio of the length of the flange outer vertical drop to the characteristic diameter of the container is greater than about 0.015.

69. The disposable food container according to claim 55, wherein the ratio of the radius of curvature of said arcuate outer flange portion to the characteristic diameter of said food container is greater than about 0.025.

70. The disposable food container according to claim 69, wherein the ratio of the radius of curvature of said arcuate outer flange portion to the characteristic diameter of said disposable food container is from about 0.035 to about 0.07.

71. The disposable food container according to claim 55, wherein the ratio of the length of the generally linear inclined sidewall profile to the characteristic diameter of the disposable food container is greater than about 0.025.

72. The disposable food container according to claim 71, wherein the ratio of the length of the generally linear inclined sidewall profile to the characteristic diameter of the disposable food container is greater than about 0.03.

73. The disposable food container according to claim 55, wherein said arcuate outer flange portion is characterized by having a single radius of curvature.

74. The disposable food container according to claim 55, wherein the outer periphery of the profile of said container terminates with an outer edge of said arcuate outer flange portion.

75. A disposable food container press-formed from a generally planar paperboard blank and being configured for rigidity and rim stiffness having a characteristic diameter comprising:

a generally planar bottom portion;

a first annular transition portion extending upwardly and outwardly from said generally planar bottom portion;

a sidewall portion extending upwardly and outwardly from said first annular transition portion;

a second annular transition portion extending outwardly from said sidewall portion, said sidewall portion defining a generally linear, inclined sidewall profile over a length between said first annular transition portion and said second annular transition portion, and having an angle of inclination of from about 10 degrees to about 40 degrees with respect to the vertical from said generally planar bottom portion wherein the ratio of the length of the generally linear inclined profile to the characteristic diameter of the disposable food container is greater than about 0.025; and an arcuate outer flange portion having a convex upper surface extending outwardly with respect to said second annular transition portion, the radius of curvature of said arcuate outer flange portion being between about 0.035 and about 0.07 times the characteristic diameter of said disposable food container; and an inner flange portion extending between said second annular transition portion and said arcuate outer flange portion having a ratio of a radial span to the characteristic diameter of from about 0 to about 0.1, said disposable food container being further characterized by a flange outer vertical drop wherein the ratio of the length of the flange outer vertical drop to the characteristic diameter of the container is greater than about 0.013;

wherein at least one of the sidewall portion, the second annular transition portion, the arcuate outer flange portion and, if present, the optional inner flange portion is provided with a plurality of circumferentially spaced, radially extending regions formed from a plurality of paperboard lamellae rebonded into substantially integrated fibrous structures generally inseparable into their constituent lamellae.

76. The disposable food container according to claim 75, wherein the plurality of circumferentially spaced, radially extending regions formed from a plurality of paperboard lamellae rebonded into substantially integrated fibrous structures generally inseparable into their constituent lamellae extend around an annular region corresponding to at least part of the profile of the sidewall portion of the container.

77. The disposable food container according to claim 75, wherein the plurality of circumferentially spaced, radially extending regions formed from a plurality of paperboard lamellae rebonded into substantially integrated fibrous structures generally inseparable into their constituent lamellae extend around an annular region corresponding to at least part of the profile of the second annular transition portion of the container.

78. The disposable food container according to claim 75, wherein the plurality of circumferentially spaced, radially extending regions formed from a plurality of paperboard lamellae rebonded into substantially integrated fibrous structures generally inseparable into their constituent lamellae extend around an annular region corresponding to at least part of the profile of the arcuate outer flange portion of the container.

79. The disposable food container according to claim 75, having an inner flange portion between the second annular transition portion and the outer arcuate flange portion wherein the plurality of circumferentially spaced, radially extending regions formed from a plurality of paperboard lamellae rebonded into substantially integrated fibrous structures generally inseparable into their constituent lamellae extend around an annular region corresponding to at least part of the profile of the inner flange portion of the container.

80. The disposable food container according to claim 75, wherein the sidewall portion, the second annular transition portion, the arcuate outer flange portion and, if present, the optional inner flange portion all include a plurality of circumferentially spaced, radially extending regions formed from a plurality of paperboard lamellae rebonded into substantially integrated fibrous structures generally inseparable into their constituent lamellae extending around an annular region corresponding to at least a part of the respective profile of the sidewall portion, the second annular transition portion, the arcuate outer flange portion and, if present, the optional inner flange portion of the container.

81. The disposable food container according to claim 75, having a plurality of circumferentially spaced, radially extending pleats disposed in an annular arrangement which pleats include a substantially integrated fibrous structure formed form a plurality of rebonded paperboard lamellae generally extending over the length of the pleat.

82. The disposable food container according to claim 75, provided with a plurality of circumferentially spaced, radially extending pleats the majority of which include a substantially integrated fibrous structure formed from a plurality of rebonded paperboard lamellae extending over at least a portion of their length.

83. The disposable food container according to claim 82, wherein the plurality of substantially integrated fibrous structures formed from rebonded paperboard define an annular rebonded paperboard array extending radially in an annular region corresponding to at least a part of the profile of the sidewall portion, the second annular transition portion, the outer arcuate flange portion or the optional inner flange portion of the container.

84. The disposable food container according to claim 75, wherein said circumferentially spaced, radially extending regions formed from a plurality of paperboard lamellae rebonded into substantially integrated fibrous structures generally inseparable into their constituent lamellae are of generally the same thickness as adjacent areas of the food container.

85. The disposable food container according to claim 75, wherein the ratio of the length of the flange outer vertical drop to the characteristic diameter of the container is greater than about 0.015.

86. The disposable food container according to claim 85, wherein the ratio of the length of the flange outer vertical drop to the characteristic diameter of the container is greater than about 0.0175.

87. The disposable food container according to claim 75, wherein the ratio of the length of the generally linear inclined sidewall profile to the characteristic diameter of the disposable article is greater than about 0.03.

88. The disposable food container according to claim 75, wherein the ratio of the radius of curvature of said arcuate outer flange portion to the characteristic diameter of said disposable food container is from about 0.035 to about 0.06.

89. The disposable food container according to claim 88, wherein the ratio of the radius of curvature of said arcuate outer flange portion to the characteristic diameter of said disposable food container is from about 0.04 to about 0.055.

90. The disposable food container according to claim 75, wherein the generally linear, inclined sidewall profile between said first annular transition portion and said second annular transition portion has an angle of inclination of from about 15° to about 40° with respect to the vertical from said generally planar bottom portion.

91. The disposable food container according to claim 90, wherein the generally linear, inclined sidewall profile between said first annular transition portion and said second annular transition portion has an angle of inclination of from about 25° to about 35° with respect to the vertical from said generally planar bottom portion.

92. The disposable food container according to claim 75, wherein said convex upper surface of the arcuate outer flange portion is configured so that it defines its radius of curvature over an included angle of from about 30° to about 80°.

93. The disposable food container according to claim 92, wherein said convex upper surface of said arcuate outer flange portion is configured so that it defines its radius of curvature over an included angle of from about 50° to about 75°.

94. The disposable food container according to claim 93, wherein the convex upper surface of the arcuate outer flange portion is configured so that it defines its radius of curvature over an included angle of from about 55° to about 65°.

95. The disposable food container according to claim 75, wherein said first annular transition portion defines an upwardly concave upper surface defining an inner radius of curvature, wherein the ratio of said inner radius of curvature to the characteristic diameter of said disposable food container is from about 0.014 to about 0.14.

96. The disposable food container according to claim 95, wherein the ratio of the inner radius of curvature to the characteristic diameter of the disposable food container is from about 0.035 to about 0.07.

97. The disposable food container according to claim 75, wherein the ratio of the length of the generally linear inclined sidewall profile to the characteristic diameter of the disposable food container is from about 0.025 to about 0.06.

98. The disposable food container according to claim 75, wherein said food container is a plate or a deep dish container and wherein the ratio of the length of the generally linear inclined sidewall profile to the characteristic diameter of the food container is from about 0.025 to about 0.15.

99. The disposable food container according to claim 75, wherein said food container is a bowl and wherein the ratio of the length of the generally linear inclined sidewall profile to the characteristic diameter of the food container is from about 0.1 to about 0.3.

100. The disposable bowl according to claim 99, wherein the ratio of the length of the generally linear inclined sidewall profile to the characteristic diameter of the food container is from about 0.15 to about 0.25.

101. The disposable food container according to claim 75, wherein said second annular transition portion defines a convex upper surface defining an intermediate radius of curvature, wherein the ratio of said intermediate radius of curvature to the characteristic diameter of said disposable food container is from about 0.014 to about 0.07.

102. The disposable food container according to claim 75, wherein the ratio of the height of said container to said characteristic diameter is from about 0.06 to about 0.3.

103. The disposable food container according to claim 102, wherein said container is a plate and wherein the ratio of the height of said container to the characteristic diameter is from about 0.06 to about 0.12.

104. The disposable food container according to claim 102, wherein said container is a bowl or deep dish container and wherein the ratio of the height of said container to the characteristic diameter is from about 0.1 to about 0.3.

105. The disposable food container according to claim 75, including an inner flange portion extending between said second annular transition portion and said arcuate outer flange portion over a radial span, wherein the ratio of said radial span to the characteristic diameter of said food container is from about 0.01 to about 0.09.

106. The disposable food container according to claim 75, in the form of a disposable plate having a caliper of at least about 10 mils.

107. The disposable food container according to claim 106, in the form of a disposable plate having a caliper of at least about 12 mils.

108. The disposable food container according to claim 107, in the form of a disposable plate having a caliper of at least about 15 mils and being provided with a coating comprising a clay filler.

109. The disposable paper plate according to claim 75, having a caliper of from about 10 to about 25 mils.

110. The disposable paper plate according to claim 109, having a caliper of from about 12 to about 22.5 mils.

111. A disposable food container press-formed from a radially scored, generally planar paperboard blank, the container being configured for rigidity and rim stiffness having a characteristic diameter comprising:

a generally planar-bottom portion;

a first annular transition portion extending upwardly and outwardly from said generally planar bottom portion;

a sidewall portion extending upwardly and outwardly from said first annular transition portion;

a second annular transition portion extending outwardly from said sidewall portion, said sidewall portion defining a generally linear, inclined sidewall profile over a length between said first annular transition portion and said second annular transition portion, and having an angle of inclination with respect to the vertical from said generally planar bottom portion; and an arcuate outer flange portion having a convex upper surface extending outwardly with respect to said second annular transition portion, the radius of curvature of said arcuate outer flange portion being between about 0.0175 and about 0.1 times the characteristic diameter of said disposable food container;

and an inner flange portion extending between said second annular transition portion and said arcuate outer flange portion having a ratio of a radial span to the characteristic diameter of from about 0 to about 0.1, said disposable food container being further characterized by a flange outer vertical drop wherein the ratio of the length of the flange outer vertical drop to the characteristic diameter of the container is greater than about 0.01; and wherein at least one of the sidewall portion, the second annular transition portion, the arcuate outer flange portion or, if present, the optional inner flange portion are provided with a plurality of circumferentially spaced radially extending regions formed from a plurality of paperboard lamellae rebonded into substantially integrated fibrous structures generally inseparable into their constituent lamellae, said rebonded paperboard lamellae regions extending over a profile distance corresponding to at least a portion of the length of the scores of the paperboard blank from which said container is formed.

112. The disposable food container according to claim 111, wherein the plurality of circumferentially spaced, radially extending regions formed from a plurality of paperboard lamellae rebonded into substantially integrated fibrous structures generally inseparable into their constituent lamellae extend around an annular region corresponding to at least part of the profile of the sidewall portion of the container.

113. The disposable food container according to claim 111, wherein the plurality of circumferentially spaced, radially extending regions formed from a plurality of paperboard lamellae rebonded into substantially integrated fibrous structures generally inseparable into their constituent lamellae extend around an annular region corresponding to at least part of the profile of the second annular transition portion of the container.

114. The disposable food container according to claim 111, wherein the plurality of circumferentially spaced, radially extending regions formed from a plurality of paperboard lamellae rebonded into substantially integrated fibrous structures generally inseparable into their constituent lamellae extend around an annular region corresponding to at least part of the profile of the arcuate outer flange portion of the container.

115. The disposable food container according to claim 111, having an inner flange portion between the second annular transition portion and the outer arcuate flange portion wherein the plurality of circumferentially spaced, radially extending regions formed from a plurality of paperboard lamellae rebonded into substantially integrated fibrous structures generally inseparable into their constituent lamellae extend around an annular region corresponding to at least part of the profile of the inner flange portion of the container.

116. The disposable food container according to claim 111, wherein the sidewall portion, the second annular transition portion, the arcuate outer flange portion and, if present, the optional inner flange portion all include a plurality of circumferentially spaced, radially extending regions formed from a plurality of paperboard lamellae rebonded into substantially integrated fibrous structures generally inseparable into their constituent lamellae extending around an annular region corresponding to at least a part of the respective profile of the sidewall portion, the second annular transition portion, the arcuate outer flange portion and, if present, the optional inner flange portion of the container.

117. The disposable food container according to claim 111, having a plurality of circumferentially spaced, radially extending pleats disposed in an annular arrangement which pleats include a substantially integrated fibrous structure formed form a plurality of rebonded paperboard lamellae generally extending over the length of the pleat.

118. The disposable food container according to claim 111, provided with a plurality of circumferentially spaced, radially extending pleats the majority of which include a substantially integrated fibrous structure formed from a plurality of rebonded paperboard lamellae extending over at least a portion of their length.

119. The disposable food container according to claim 111, wherein the plurality of substantially integrated fibrous structures formed from rebonded paperboard define an annular rebonded paperboard array extending radially in an annular region corresponding to at least a part of the profile of the sidewall portion, the second annular transition portion, the outer arcuate flange portion or the optional inner flange portion of the container.

120. The disposable food container according to claim 111, wherein said circumferentially spaced, radially extending regions formed from a plurality of paperboard lamellae rebonded into substantially integrated fibrous structures generally inseparable into their constituent layers are of generally the same thickness as adjacent areas of the food container.

121. The disposable food container according to claim 111, wherein said inclined sidewall profile has an angle of inclination with respect to the vertical from said generally planar bottom portion of from about 10° to about 50°.

122. The disposable food container according to claim 121, wherein said inclined sidewall profile has an angle of inclination with respect to the vertical from said generally planar bottom portion of from about 10° to about 40°.

123. The disposable food container according to claim 111, wherein the ratio of the length of the flange outer vertical drop to the characteristic diameter of the container is greater than about 0.013.

124. The disposable food container according to claim 123, wherein the ratio of the length of the flange outer vertical drop to the characteristic diameter of the container is greater than about 0.015.

125. The disposable food container according to claim 111, wherein the ratio of the radius of curvature of said arcuate outer flange portion to the characteristic diameter of said food container is greater than about 0.025.

126. The disposable food container according to claim 125, wherein the ratio of the radius of curvature of said arcuate outer flange portion to the characteristic diameter of said disposable food container is from about 0.035 to about 0.07.

127. The disposable food container according to claim 111, wherein the ratio of the length of the generally linear inclined sidewall profile to the characteristic diameter of the disposable food container is greater than about 0.025.

128. The disposable food container according to claim 127, wherein the ratio of the length of the generally linear inclined sidewall profile to the characteristic diameter of the disposable food container is greater than about 0.03.

129. The disposable food container according to claim 111, wherein said arcuate outer flange portion is characterized by having a single radius of curvature.

130. The disposable food container according to claim 111, wherein the outer periphery of the profile of said container terminates with an outer edge of said arcuate outer flange portion.

131. A disposable food container press-formed from a radially scored, generally planar paperboard blank the container being configured for rigidity and rim stiffness having a characteristic diameter comprising:

a generally planar bottom portion;

a first annular transition portion extending upwardly and outwardly from said generally planar bottom portion;

a sidewall portion extending upwardly and outwardly from said first annular transition portion;

a second annular transition portion extending outwardly from said sidewall portion, said sidewall portion defining a generally linear, inclined sidewall profile over a length between said first annular transition portion and said second annular transition portion, and having an angle of inclination of from about 10 degrees to about 50 degrees with respect to the vertical from said generally planar bottom portion wherein the ratio of the length of the generally linear inclined profile to the characteristic diameter of the disposable food container is greater than about 0.025; and an arcuate outer flange portion having a convex upper surface extending outwardly with respect to said second annular transition portion, the radius of curvature of said arcuate outer flange portion being between about 0.035 and about 0.07 times the characteristic diameter of said disposable food container; and an inner flange portion extending between said second annular transition portion and said arcuate outer flange portion having a ratio of a radial span to the characteristic diameter of from about 0 to about 0.1, said disposable food container being further characterized by a flange outer vertical drop wherein the ratio of the length of the flange outer vertical drop to the characteristic diameter of the container is greater than about 0.013;

wherein at least one of the sidewall portion, the second annular transition portion, the arcuate outer flange portion or, if present, the optional inner flange portion are provided with a plurality of circumferentially spaced radially extending regions formed from a plurality of paperboard lamellae rebonded into substantially integrated fibrous structures generally inseparable into their constituent lamellae, said rebonded paperboard lamellae regions extending over a profile distance corresponding to at least a portion of the length of the scores of the paperboard blank from which said container is formed.

132. The disposable food container according to claim 131, wherein the plurality of circumferentially spaced, radially extending regions formed from a plurality of paperboard lamellae rebonded into substantially integrated fibrous structures generally inseparable into their constituent lamellae extend around an annular region corresponding to at least part of the profile of the sidewall portion of the container.

133. The disposable food container according to claim 131, wherein the plurality of circumferentially spaced, radially extending regions formed from a plurality of paperboard lamellae rebonded into substantially integrated fibrous structures generally inseparable into their constituent lamellae extend around an annular region corresponding to at least part of the profile of the second annular transition portion of the container.

134. The disposable food container according to claim 131, wherein the plurality of circumferentially spaced, radially extending regions formed from a plurality of paperboard lamellae rebonded into substantially integrated fibrous structures generally inseparable into their constituent lamellae extend around an annular region corresponding to at least part of the profile of the arcuate outer flange portion of the container.

135. The disposable food container according to claim 131, having an inner flange portion between the second annular transition portion and the outer arcuate flange portion wherein the plurality of circumferentially spaced, radially extending regions formed from a plurality of paperboard lamellae rebonded into substantially integrated fibrous structures generally inseparable into their constituent lamellae extend around an annular region corresponding to at least part of the profile of the inner flange portion of the container.

136. The disposable food container according to claim 131, wherein the sidewall portion, the second annular transition portion, the arcuate outer flange portion and, if present, the optional inner flange portion all include a plurality of circumferentially spaced, radially extending regions formed from a plurality of paperboard lamellae rebonded into substantially integrated fibrous structures generally inseparable into their constituent lamellae extending around an annular region corresponding to at least a part of the respective profile of the sidewall portion, the second annular transition portion, the arcuate outer flange portion and, if present, the optional inner flange portion of the container.

137. The disposable food container according to claim 131, having a plurality of circumferentially spaced, radially extending pleats disposed in an annular arrangement which pleats include a substantially integrated fibrous structure formed form a plurality of rebonded paperboard lamellae generally extending over the length of the pleat.

138. The disposable food container according to claim 131, provided with a plurality of circumferentially spaced, radially extending pleats the majority of which include a substantially integrated fibrous structure formed from a plurality of rebonded paperboard lamellae extending over at least a portion of their length.

139. The disposable food container according to claim 138, wherein the plurality of substantially integrated fibrous structures formed from rebonded paperboard define an annular rebonded paperboard array extending radially in an annular region corresponding to at least a part of the profile of the sidewall portion, the second annular transition portion, the outer arcuate flange portion or the optional inner flange portion of the container.

140. The disposable food container according to claim 131, wherein said circumferentially spaced, radially extending regions formed from a plurality of paperboard lamellae rebonded into substantially integrated fibrous structures generally inseparable into their constituent layers are of generally the same thickness as adjacent areas of the food container.

141. The disposable food container according to claim 131, wherein the ratio of the length of the flange outer vertical drop to the characteristic diameter of the container is greater than about 0.015.

142. The disposable food container according to claim 141, wherein the ratio of the length of the flange outer vertical drop to the characteristic diameter of the container is greater than about 0.0175.

143. The disposable food container according to claim 131, wherein the ratio of the length of the generally linear inclined sidewall profile to the characteristic diameter of the disposable article is greater than about 0.03.

144. The disposable food container according to claim 131, wherein the ratio of the radius of curvature of said arcuate outer flange portion to the characteristic diameter of said disposable food container is from about 0.035 to about 0.06.

145. The disposable food container according to claim 144, wherein the ratio of the radius of curvature of said arcuate outer flange portion to the characteristic diameter of said disposable food container is from about 0.04 to about 0.055.

146. The disposable food container according to claim 131, wherein the generally linear, inclined sidewall profile between said first annular transition portion and said second annular transition portion has an angle of inclination of from about 15° to about 40° with respect to the vertical from said generally planar bottom portion.

147. The disposable food container according to claim 146, wherein the generally linear, inclined sidewall profile between said first annular transition portion and said second annular transition portion has an angle of inclination of from about 25° to about 35° with respect to the vertical from said generally planar bottom portion.

148. The disposable food container according to claim 131, wherein said convex upper surface of the arcuate outer flange portion is configured so that it defines its radius of curvature over an included angle of from about 30° to about 80°.

149. The disposable food container according to claim 148, wherein said convex upper surface of said arcuate outer flange portion is configured so that it defines its radius of curvature over an included angle of from about 50° to about 75°.

150. The disposable food container according to claim 149, wherein the convex upper surface of the arcuate outer flange portion is configured so that it defines its radius of curvature over an included angle of from about 55° to about 65°.

151. The disposable food container according to claim 131, wherein said first annular transition portion defines an upwardly concave upper surface defining an inner radius of curvature, wherein the ratio of said inner radius of curvature to the characteristic diameter of said disposable food container is from about 0.014 to about 0.14.

152. The disposable food container according to claim 151, wherein the ratio of the inner radius of curvature to the characteristic diameter of the disposable food container is from about 0.035 to about 0.07.

153. The disposable food container according to claim 131, wherein the ratio of the length of the generally linear inclined sidewall profile to the characteristic diameter of the disposable food container is from about 0.025 to about 0.06.

154. The disposable food container according to claim 131, wherein said food container is a plate or a deep dish container and wherein the ratio of the length of the generally linear inclined sidewall profile to the characteristic diameter of the food container is from about 0.025 to about 0.15.

155. The disposable food container according to claim 131, wherein said food container is a bowl and wherein the ratio of the length of the generally linear inclined sidewall profile to the characteristic diameter of the food container is from about 0.1 to about 0.3.

156. The disposable bowl according to claim 155, wherein the ratio of the length of the generally linear inclined sidewall profile to the characteristic diameter of the food container is from about 0.15 to about 0.25.

157. The disposable food container according to claim 131, wherein said second annular transition portion defines a convex upper surface defining an intermediate radius of curvature, wherein the ratio of said intermediate radius of curvature to the characteristic diameter of said disposable food container is from about 0.014 to about 0.07.

158. The disposable food container according to claim 131, wherein the ratio of the height of said container to said characteristic diameter is from about 0.06 to about 0.3.

159. The disposable food container according to claim 158, wherein said container is a plate and wherein the ratio of the height of said container to the characteristic diameter is from about 0.06 to about 0.12.

160. The disposable food container according to claim 158, wherein said container is a bowl or deep dish container and wherein the ratio of the height of said container to the characteristic diameter is from about 0.1 to about 0.3.

161. The disposable food container according to claim 131, including an inner flange portion extending between said second annular transition portion and said arcuate outer flange portion over a radial span, wherein the ratio of said radial span to the characteristic diameter of said food container is from about 0.01 to about 0.09.

162. The disposable food container according to claim 131, wherein said regions formed from a plurality of paperboard lamellae rebonded into substantially integrated structures extend over a profile distance corresponding to at least about 50 percent of the length of the scores in the paperboard blank from which the container is formed.

163. The disposable food container according to claim 162, wherein said regions formed from a plurality of paperboard lamellae rebonded into substantially integrated structures extend over a profile distance corresponding to at least about 75 percent of the length of the scores in the paperboard blank from which the container is formed.

164. The disposable food container according to claim 131, wherein said convex upper surface of said arcuate outer flange portion is configured so that it defines its radius of curvature over an included angle of from about 55° to about 75°.

165. The disposable food container according to claim 164, wherein said convex upper surface of said arcuate outer flange portion is configured so that it defines its radius of curvature over an included angle of from about 55° to about 65°.

166. The disposable food container according to claim 131, wherein said radially scored paperboard blank has from about 20 to about 150 radial scores.

167. The disposable food container according to claim 131, wherein the scores of said radially scored paperboard blank have a width of from about 0.01 inches to about 0.05 inches.

168. The disposable food container according to claim 167, wherein the scores of said radially scored paperboard blank have a width of about 0.03 inches.

169. The disposable food container according to claim 131, wherein said paperboard blank is provided with a substantially liquid-impervious coating comprising an inorganic pigment or filler and a water-based, press-applied overcoat.

170. The disposable food container according to claim 169, wherein said inorganic filler comprises kaolin.

171. A disposable food container configured for rigidity and rim stiffness having a characteristic diameter comprising:

a generally planar bottom portion;

a first annular transition portion extending upwardly and outwardly from said generally planar bottom portion;

a sidewall portion extending upwardly and outwardly from said first annular transition portion;

a second annular transition portion extending outwardly from said sidewall portion, said sidewall portion defining a generally linear, inclined profile over a length between said first annular transition portion and said second annular transition portion, and having an angle of inclination of from about 10 degrees to about 50 degrees with respect to the vertical from said generally planar bottom portion; and an arcuate outer flange portion having a convex upper surface extending outwardly with respect to said second annular transition portion, the product of the curvature of said arcuate outer flange portion and the characteristic diameter of said disposable food container being between about 10 and about 50;

and an inner transition flange portion extending between said second annular transition portion and said arcuate outer flange portion having a ratio of a radial span to the characteristic diameter of from about 0 to about 0.1, said disposable food container being further characterized by a flange outer vertical drop wherein the ratio of the length of the flange outer vertical drop to the characteristic diameter of the container is greater than about 0.01.

172. The disposable food container according to claim 171, wherein the product of the curvature of said arcuate outer flange portion and the characteristic diameter of said disposable food container is from about 15 to about 30.

173. The disposable food container according to claim 172, wherein the product of the curvature of said arcuate outer flange portion and the characteristic diameter of said disposable food container is from about 20 to about 30.

174. The disposable food container according to claim 173, wherein the product of the curvature of said arcuate outer flange portion and the characteristic diameter of said disposable food container is from about 22.5 to about 25.

175. The disposable food container according to claim 171, wherein said arcuate outer flange portion is of generally constant curvature.

176. A paperboard laminate configured as a food container exhibiting rigidity and rim stiffness having a characteristic diameter comprising:

a generally planar bottom portion;

a first annular transition portion extending upwardly and outwardly from said generally planar bottom portion;

a sidewall portion extending upwardly and outwardly from said first annular transition portion;

a second annular transition portion extending outwardly from said sidewall portion, said sidewall portion defining a generally linear, inclined sidewall profile over a length between said first annular transition portion and said second annular transition portion, and having an angle of inclination with respect to the vertical from said generally planar bottom portion; and an arcuate outer flange portion having a convex upper surface extending outwardly with respect to said second annular transition portion, the radius of curvature of said arcuate outer flange portion being between about 0.0175 and about 0.1 times the characteristic diameter of said disposable food container;

and an inner flange portion extending between said second annular transition portion and said arcuate outer flange portion having a ratio of a radial span to the characteristic diameter of from about 0 to about 0.1, said disposable food container being further characterized by a flange outer vertical drop wherein the ratio of the length of the flange outer vertical drop to the characteristic diameter of the laminate container is greater than about 0.01.

177. The laminate according to claim 176, including at least two paperboard layers.

178. The laminate according to claim 176, wherein said laminate includes an embossed paperboard layer.

179. The laminate according to claim 178, wherein the paperboard laminate includes at least two paperboard layers each of which layers has a basis weight of from about 20 lbs. to about 400 lbs. per 3000 square foot ream.

180. The laminate according to claim 179, wherein the paperboard laminate includes at least two paperboard layers each of which layers has a basis weight of from about 80 lbs. to about 220 lbs. per 3000 square foot ream.

181. The laminate according to claim 178, wherein the container includes two embossed paperboard layers and one planar paperboard layer.

182. The laminate according to claim 181, wherein each of the paperboard layers has a basis weight of from about 20 lbs. to about 400 lbs. per 3000 square foot ream.

* * * * *

UNITED STATES PATENT AND TRADEMARK OFFICE

CERTIFICATE OF CORRECTION

PATENT NO. : 6,715,630 B2
DATED : April 6, 2004
INVENTOR(S) : Mark B. Littlejohn et al.

It is certified that error appears in the above-identified patent and that said Letters Patent is hereby corrected as shown below:

Column 2,
Line 61, change "styrene acrylic" to -- styrene-acrylic --;

Column 6,
Line 23, after "Cover" insert -- , now U.S. Pat. No. 6,733,852 --;

Column 7,
Line 44, change "portion" to -- portions --;

Column 9,
Line 7, insert -- a -- before "view";
Line 12, delete ")" after "E";
Line 17, change "sq" to -- sq. --;

Column 10,
Line 22, insert -- , -- after "Inc.";

Column 11,
Line 64, change "Sheet stock" to -- "Sheet Stock" --;

Column 12,
Line 3, change "major component, predominant component" to
-- "major conponent", --"predominant component" --;

Column 13,
Line 39, change "ft" to -- ft. --;

Column 17,
Line 44, delete "that is";
Line 50, delete "is" and insert -- are --;
Line 50, delete the first instance of "that" and insert -- those --;

Column 18,
Line 17, delete "." after "26" and insert -- , --;

Column 24,
Table 10, line 25, change "gms/.5") to -- (gms/.5") --;
Table 10, line 25, change "gms/.l" to -- (gms/.l") --;
Line 45, change "Invnetion" to -- Invention --;

UNITED STATES PATENT AND TRADEMARK OFFICE

CERTIFICATE OF CORRECTION

PATENT NO. : 6,715,630 B2
DATED : April 6, 2004
INVENTOR(S) : Mark B. Littlejohn et al.

It is certified that error appears in the above-identified patent and that said Letters Patent is hereby corrected as shown below:

Column 25,
Line 25, change ";" to -- , --;
Table 13, Line 49, change "lb" to -- lb. --;

Column 29,
Line 11, change "DF-122 NS" to -- DF-177NS --;
Line 63, change "preload" to -- pre-load --;

Column 35,
Line 13, change "pp:" to -- pp. --;

Column 37,
Line 23, change "an" to -- a --;
Line 27, insert -- , -- after "12";
Line 38, insert -- Claim -- before "12";
Line 42, insert -- Claim -- before "16";

Column 40,
Line 40, delete "to";

Column 43,
Line 39, change "form" to -- from --;

Column 46,
Line 64, change "form" to -- from --;

Column 47,
Line 60, insert -- , -- after "blank";

Column 49,
Line 21, change "form" to -- from --; and

UNITED STATES PATENT AND TRADEMARK OFFICE

CERTIFICATE OF CORRECTION

PATENT NO. : 6,715,630 B2
DATED : April 6, 2004
INVENTOR(S) : Mark B. Littlejohn et al.

It is certified that error appears in the above-identified patent and that said Letters Patent is hereby corrected as shown below:

Column 54,
Line 2, change "container" to -- laminate--.

Signed and Sealed this

Eighteenth Day of January, 2005

JON W. DUDAS
*Director of the United States Patent and Trademark Office*